US008506103B2

(12) United States Patent
Iimura et al.

(10) Patent No.: US 8,506,103 B2
(45) Date of Patent: Aug. 13, 2013

(54) SEMICONDUCTOR LAMP AND LIGHT BULB TYPE LED LAMP

(76) Inventors: Keiji Iimura, Tokyo (JP); Hideki Iimura, Tokyo (JP)

( * ) Notice: Subject to any disclaimer, the term of this patent is extended or adjusted under 35 U.S.C. 154(b) by 242 days.

(21) Appl. No.: 13/134,192

(22) Filed: Jun. 2, 2011

(65) Prior Publication Data

US 2011/0286200 A1 Nov. 24, 2011

(51) Int. Cl.
*F21V 33/00* (2006.01)

(52) U.S. Cl.
USPC ..... 362/84; 362/254; 362/311.02

(58) Field of Classification Search
USPC ..... 362/84, 311.02, 254
See application file for complete search history.

(56) References Cited

U.S. PATENT DOCUMENTS 6,639,349 B1 * 10/2003 Bahadur ..... 313/483
7,960,872 B1 * 6/2011 Zhai et al. ..... 307/157
8,360,599 B2 * 1/2013 Ivey et al. ..... 362/218
8,376,580 B2 * 2/2013 Li ..... 362/249.02
2007/0264898 A1 * 11/2007 Ilmura ..... 445/23
2008/0093615 A1 * 4/2008 Lin et al. ..... 257/98
2009/0251882 A1 * 10/2009 Ratcliffe ..... 362/84

FOREIGN PATENT DOCUMENTS

JP 2001-243807 A 7/2001
JP 2006-156187 5/2006

* cited by examiner

*Primary Examiner* — Laura Tso

(57) ABSTRACT

The disclosed is an LED lamp comprising: a light transmitting globe/envelope having a plurality of fluorescent protrusions, fibers and/or grooves containing a phosphor; a light unit having a circuit board and one or more light emitting diode (LED/LEDs) mounted on the circuit board for emitting a short wavelength primary light for directing to the fluorescent protrusions, fibers and/or grooves to convert the primary light into visible secondary light. A light bulb type LED lamp is composed of the above LED lamp, a lighting circuit to drive the LED/LEDs and a light bulb type power supply connector (Edison screw base), thereby the LED lamp being compatible with an incandescent light bulb. This LED lamp irradiates illumination light having a high brightness and luminance, a wide light distribution angle and non-glare fluorescent illumination.

20 Claims, 33 Drawing Sheets

FIG.34
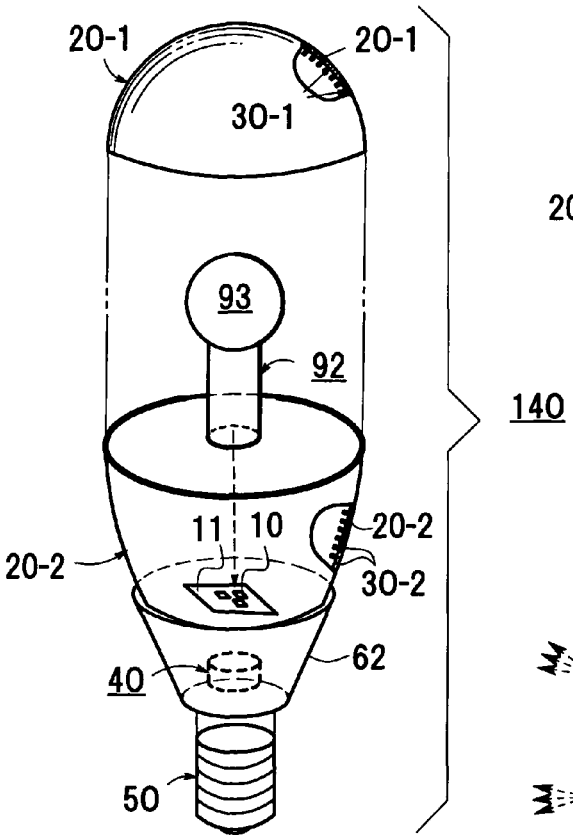
FIG.35
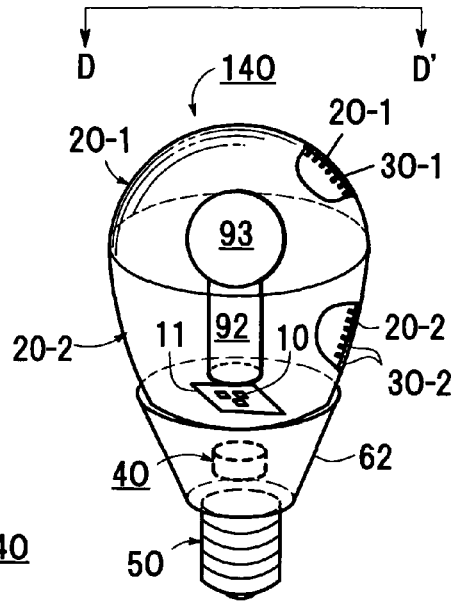
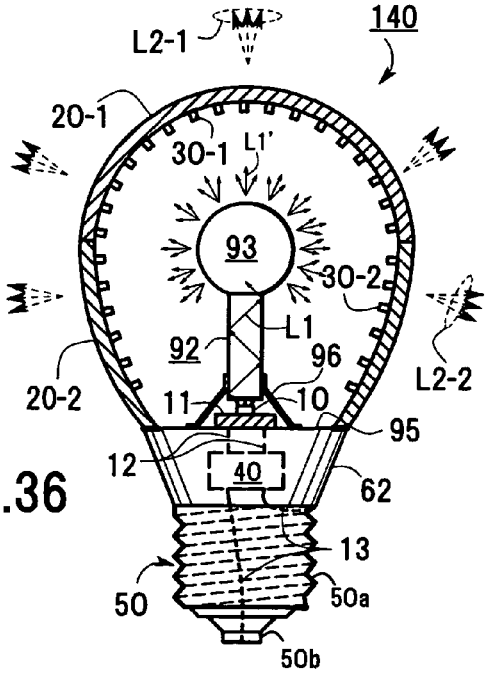
FIG.36

FIG.69
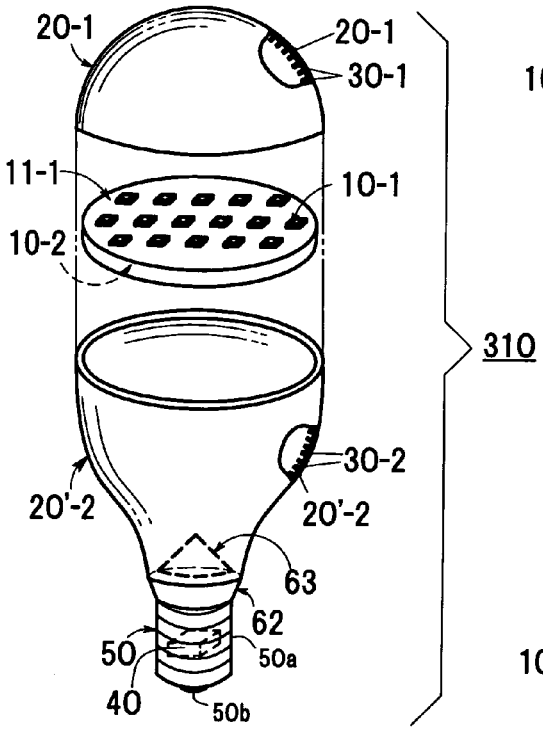
FIG.70
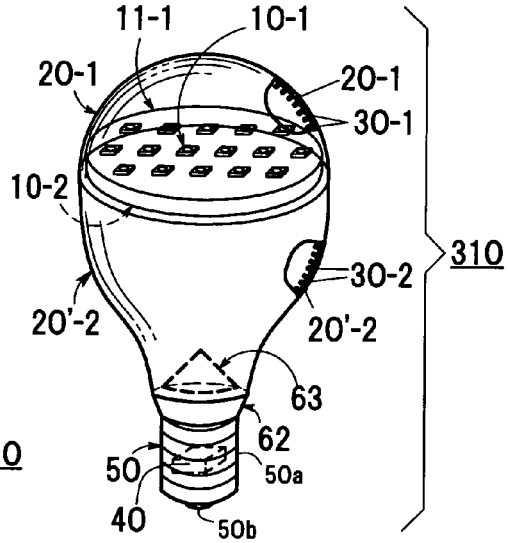
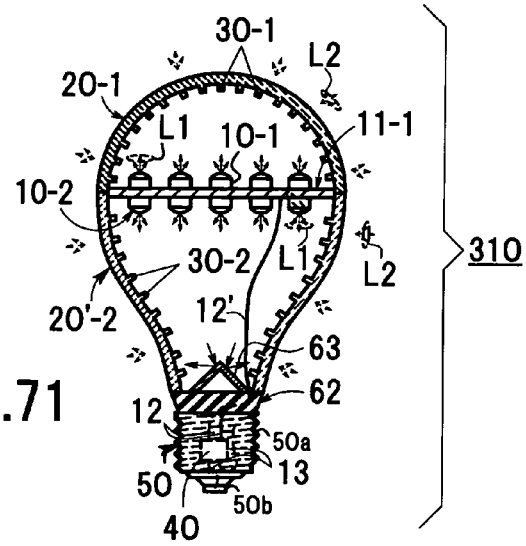
FIG.71

SEMICONDUCTOR LAMP AND LIGHT BULB TYPE LED LAMP

CROSS REFERENCE TO RELATED APPLICATION

This application is based on the prior Japanese Patent application No. P2008-301248 filed on Nov. 26, 2008 (Japanese Patent application publication No. P2010-129300A published on Jun. 10, 2010), further this application is based on the prior Japanese Patent application No. P2009-260310 filed on Nov. 13, 2009 and the entire disclosure of which is incorporated herein by reference in its entity.

FIELD OF THE INVENTION

The present invention relates to a semiconductor lamp having semiconductor light emitting element/elements such as light emitting diode/diodes (LED/LEDs).

The present invention relates to a light bulb type LED lamp having LED/LEDs and a power supply connector such as Edison type screw base, which can be easily attached/detached to a conventional light bulb socket, thereby it can replace a conventional incandescent light bulb.

BACKGROUND OF THE INVENTION

The prior art 1 is Japanese patent application publication No. 2001-243807 published on Jul. 9, 2001 discloses "LED ELECTRIC BULB" that PROBLEM TO BE SOLVED: To provide a LED electric bulb capable of obtaining a white light of large luminous flux and a wide illumination range with a simple structure and distributing luminous intensity in various light distributing patterns, and compatible with a conventional incandescent lamp. SOLUTION: This electric bulb is provided with a base 1 on one end, a bugle shaped member 2 expanding like a bugle toward an opening part on the other end, a translucent cover 5 attached to an opening part of the bugle shaped member 2 and having a fluorescent material layer on an inner surface of the same, a substrate 3 provided inside of a nearly spherical body 7 formed by the bugle shaped member 2 and the translucent cover 5, and LED elements 4 mounted on an outer surface of the substrate 3 facing the translucent cover 5. (See "Patent Abstract Japan" Publication No. 2001-243807 English version.)

The prior art 2 is Japanese patent application publication No. 2006-156187 published on May 6, 2006 discloses "LED LIGHT SOURCE DEVICE AND LED ELECTRIC BULB" that PROBLEM TO BE SOLVED: To promote life-prolongation of a phosphor and a light emitting diode element, while enabling the brightness of light to become approximately uniform of which the wavelength is converted with a wavelength conversion cover. SOLUTION: This is provided with an LED light emitting diode part 6 having a plurality of light emitting diode elements 12 which are arranged so as to have a plane surface and radiate near-ultraviolet rays or blue rays, and the wavelength conversion cover 9 which has a planar part 16 opposing to the light emitting diode elements 12 in a separated position at a prescribed distance from the face where the light emitting diode elements 12 are arranged, and in which a phosphor 15 is installed that carries out the wavelength conversion of the light radiated from the light emitting diode elements 12. (See "Patent Abstract Japan" Publication No. 2006-156187 English version.)

In the prior art 1, since a phosphor layer is only formed on the inner surface of the semi-spherical transparent cover (globe), a formation area of the phosphor layer is limited so that this LED lamp is not sufficient in a brightness, luminance and in a light distribution angle for use in a replacement of conventional incandescent light bulb.

In the prior art 2, since the wavelength conversion planer cover including the phosphor opposing the LED element is located in an inner space of the semi-spherical globe, a formation area of the phosphor layer is limited similarly to the prior art 1 so that this LED lamp is not sufficient in a brightness, luminance and in a light distribution angle for use in a replacement of conventional incandescent light bulb.

SUMMARY OF THE INVENTION

A purpose of the invention is to provide a semiconductor lamp emitting visible light having a higher brightness and luminance or a wider illumination angle than the semiconductor lamp of the prior arts 1 and 2.

Another purpose of the invention is to provide a light bulb type LED lamp emitting visible light having a higher brightness and luminance or wider illumination angle than the LED lamp of the prior arts 1 and 2, in which the light bulb type LED lamp of the invention can easily replace a conventional incandescent light bulb.

A first aspect of the invention is a semiconductor lamp comprising: a light transmitting globe having a plurality of fluorescent protrusions and/or grooves containing a phosphor disposed therein/thereon; at least one semiconductor light emitting element for emitting a short wavelength light for directing to the fluorescent protrusions and/or grooves; and wherein the fluorescent protrusions and/or grooves converts the short wavelength light into visible light.

A second aspect of the invention is an LED lamp comprising: a light transmitting globe having a plurality of fluorescent protrusions, fibers and/or grooves containing a phosphor disposed therein/thereon; a light unit having a printed circuit board and one or more light emitting diode (LED/LEDs) mounted on the printed circuit board for emitting a short wavelength light for directing to the fluorescent protrusions, fibers and/or grooves to convert the short wavelength light into visible light; a lighting circuit to drive the LED/LEDs; a light bulb type power supply connector. The light transmitting globe with the fluorescent protrusions, fibers and/or grooves; the light unit; the lighting circuit and the power supply connector are combined together to construct a light bulb type LED lamp, thereby the LED lamp being compatible with an incandescent light bulb, which can easily replace a conventional incandescent lamp. The LED lamp of the invention may provide an illumination light having a wide light distribution angle of about 200 degree or preferably about 300 degree or more similarly to the conventional incandescent lamp and the illumination light having a non glare (glare-less) fluorescent light.

BRIEF DESCRIPTION OF THE DRAWINGS

Various embodiments of the present invention are described with reference to the accompanying drawings, in which:

FIG. 34 is a schematic exploded perspective view of a semiconductor lamp 140;

FIG. 35 is a schematic perspective view of the LED lamp 140;

FIG. 36 is a schematic sectional view of the semiconductor lamp 140;

FIG. 69 is a schematic exploded perspective view of a semiconductor lamp 310;

FIG. 70 is a schematic perspective view of the semiconductor lamp 310;

FIG. 71 is a schematic sectional view of the semiconductor lamp 310;

DETAILED DESCRIPTION OF THE INVENTION

Figure 1:
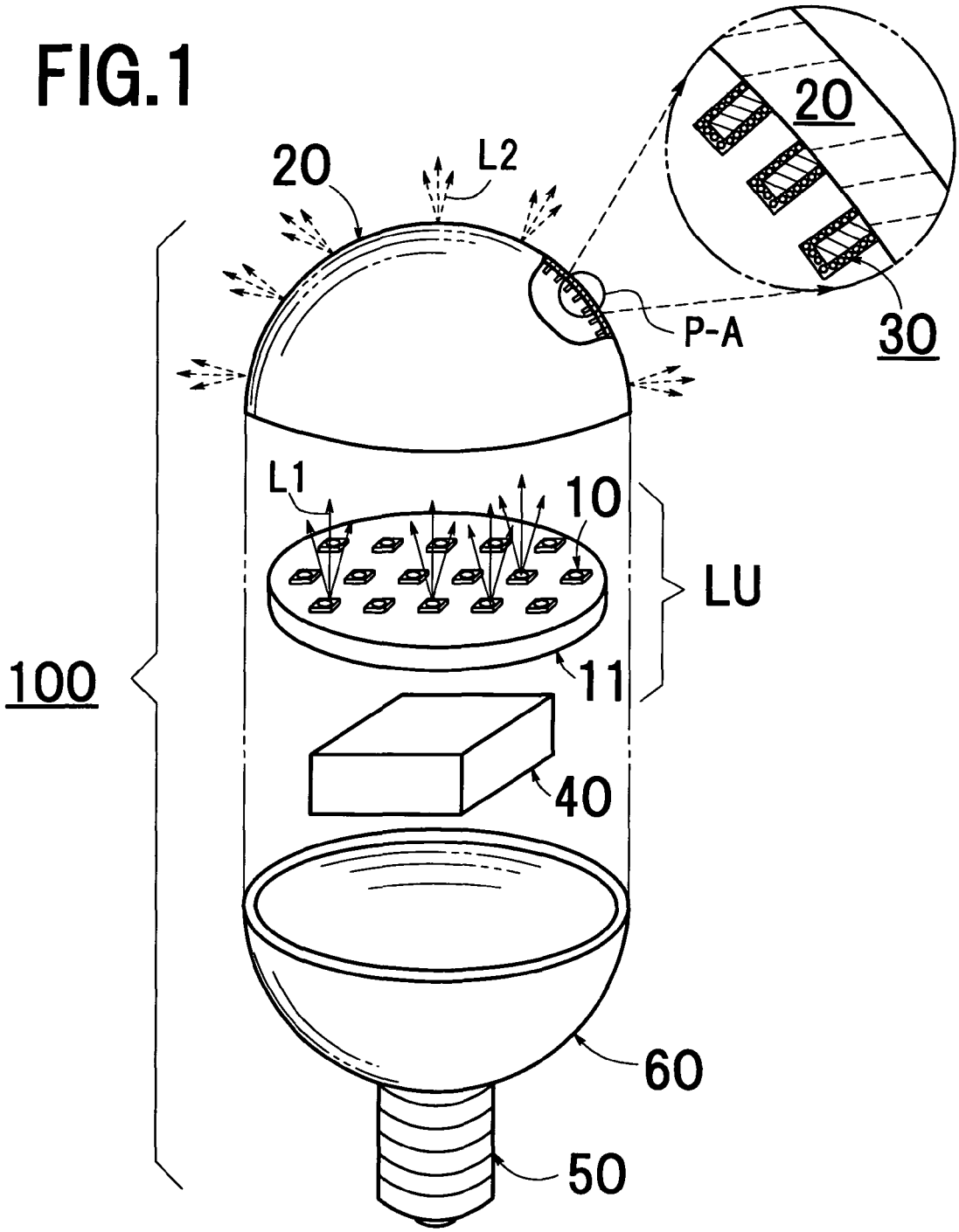
FIG. 1 is a schematic exploded perspective view of a semiconductor lamp 100.

Various embodiments of the present invention are described with reference to accompanying drawings as follows.

In all drawings, the same reference numeral or mark is given to identical parts/portions.

An Embodiment of the Invention

An embodiment of the invention is described based on FIG. 1 to FIG. 7.

Figure 2:
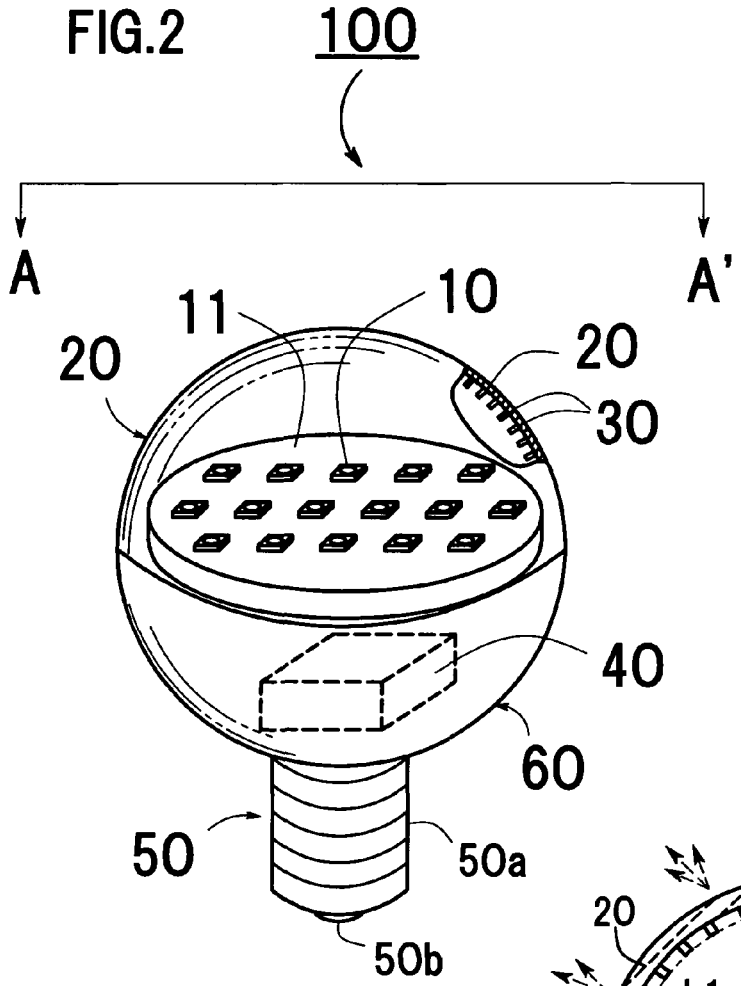
FIG. 2 is a schematic perspective view of the LED lamp 100.
Figure 3:
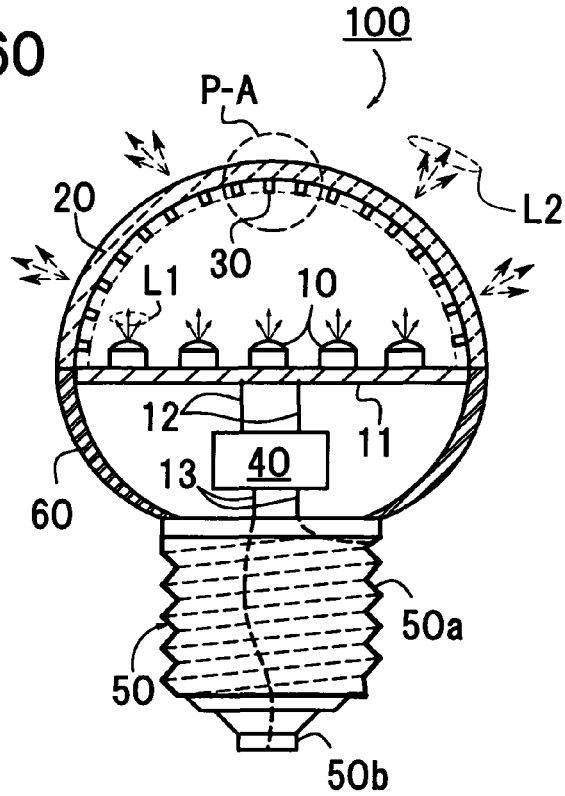
FIG. 3 is a schematic sectional view of the LED lamp 100.
Figure 4:
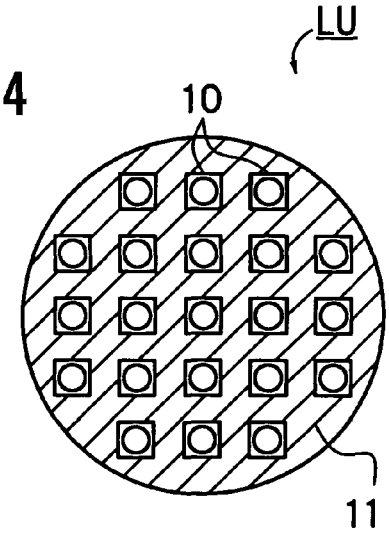
FIG. 4 is a schematic top view showing a light unit.
Figure 5:
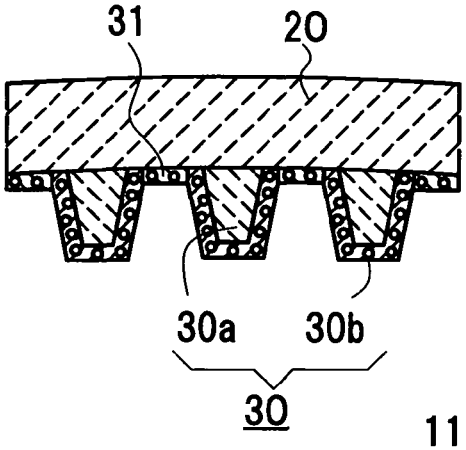
FIG. 5 is a schematic enlarged and partial sectional view showing a part (P-A) of FIG. 3.
Figure 6:
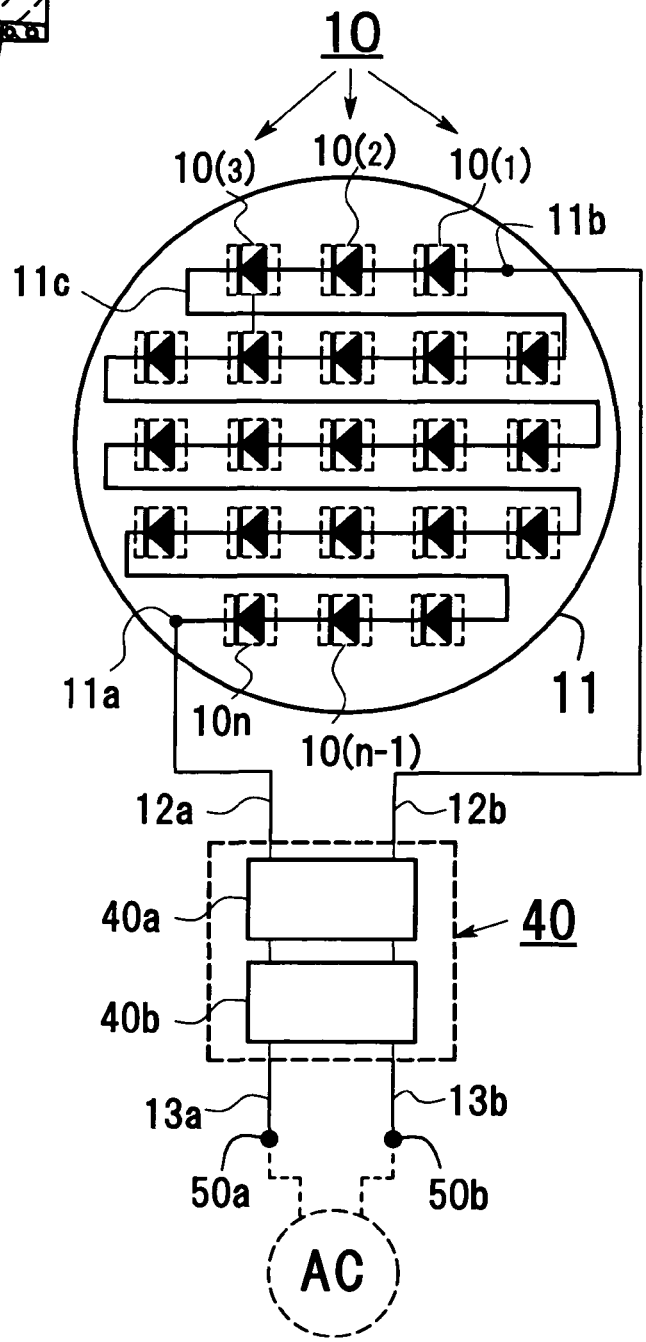
FIG. 6 is a schematic block diagram showing an electric driving circuit.

FIG. 1 is a schematic exploded perspective view of a semiconductor lamp (an LED lamp) 100 of an embodiment of the invention. FIG. 2 is a schematic perspective view of the LED lamp 100. FIG. 3 is a schematic sectional view of the LED lamp 100 cut along the A-A' line of FIG. 2. FIG. 4 is a schematic top view showing a light unit. FIG. 5 is a schematic enlarged and partial sectional view showing a part (P-A) of FIG. 3. FIG. 6 is a schematic block diagram showing an example of the electric driving circuit of the LED lamp 100. FIG. 7A, FIG. 7B, FIG. 7C or FIG. 7D is a schematic enlarged and partial sectional view showing a part of FIG. 5 explaining the principle and optical path of the LED lamp 100.

Figure 7A:
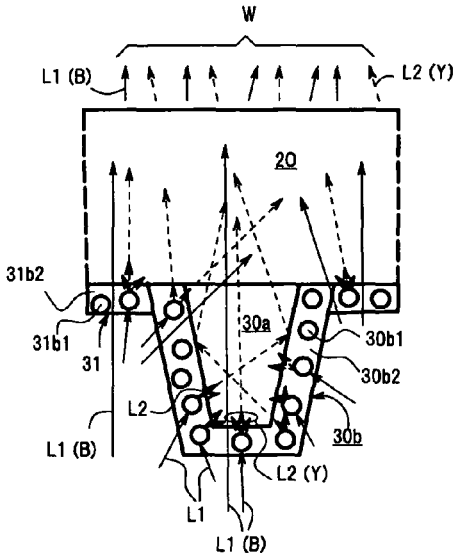
FIG. 7A, FIG. 7B, FIG. 7C or FIG. 7D is a schematic enlarged and partial sectional view showing a part of FIG. 5 explaining the principle and optical path of the LED lamp 100.
Figure 7B:
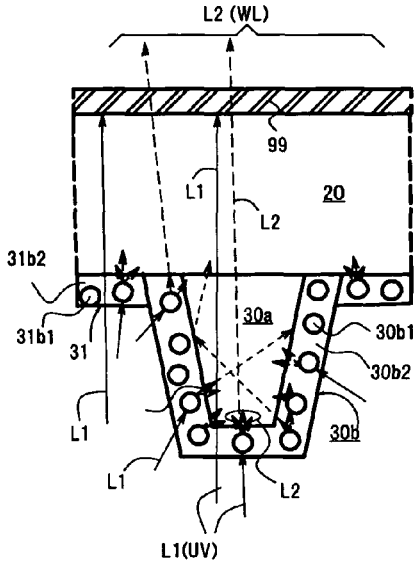
Figure 7C:
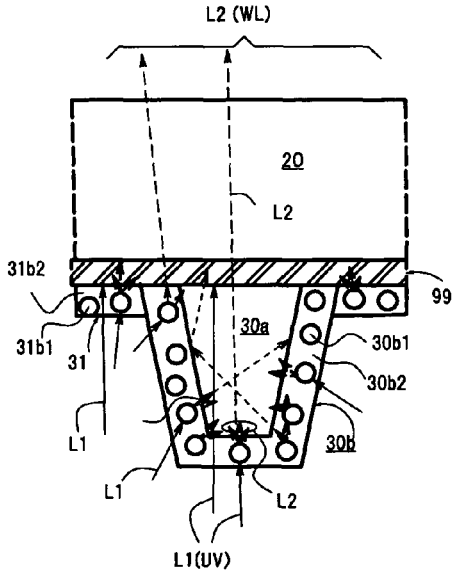
Figure 7D:
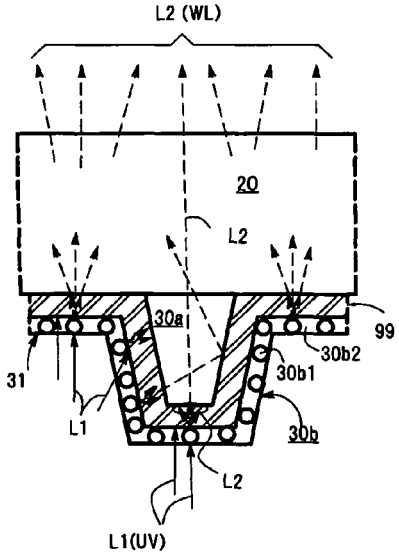

FIG. 7A explains the principle and optical path of the LED lamp 100 when blue LED is used as the semiconductor light emitting element 10. FIG. 7B, FIG. 7C or FIG. 7D explains the principle and optical path of the LED lamp 100 when a near ultraviolet (UV) LED is used as the semiconductor light emitting element 10.

As shown in FIG. 1 through FIG. 7, a semiconductor lamp (e.g. LED lamp) 100 of the first embodiment of the invention is composed of at least one semiconductor light emitting element (e.g. light emitting diode (LED)) 10 to emit short-wavelength light (ultraviolet (UV) or blue light), a light transmitting globe 20 having a transparent or semi-transparent material and a plurality of fluorescent protrusions (convexes) 30 disposed on/in an inner surface of the light transmitting globe 20.

A short wavelength type semiconductor light emitting element 10 is composed of a light emitting diode (LED) or laser diode (LD).

A light emitting unit "LU" may be composed of a printed circuit board 11 and at least one short wavelength type semiconductor light emitting element (e.g. LED) 10 mounted on the printed circuit board 11.

As shown in FIG. 5, a fluorescent protrusion 30 is composed of two or more light transmitting protrusions 30*a* and a phosphor (phosphor) 30*b* arranged in/on the protrusions 30*a*.

As shown in FIG. 1 to FIG. 3, in one embodiment of the invention, the light transmitting globe (i.e. a globe, an enclosure, an envelope) 20 may be composed of a substantially hemispherical or dome shaped member made of a light transmitting glass or resin (i.e. polymer), in which the fluorescent protrusions 30 including the phosphor material are formed on an inner surface of the light transmitting globe 20.

The light emitting unit "LU" which mounts the LEDs 10 on an upper surface of the printed circuit board 11 is arranged in the neighborhood of an opening of the lower part of the light transmitting hemispherical globe 20.

The light emitting unit "LU" is arranged such that light "L1" emitting from the LED/LEDs 10 may direct the inner surface of the light transmitting hemispherical globe 20 and the light "L1" can irradiate all the fluorescent protrusion 30 formed in/on the inner surface.

As shown in FIG. 1 through FIG. 3, a lighting circuit 40 which supplies a driving power to the LED/LEDs 10 may be housed in an inner space of a housing 60 with an upper opening, in which the housing 60 may be composed of a hemispherical or funnel shape member.

An electric power supply connector (i.e. lamp base) 50 e.g. Edison base for conventional electric light bulbs may be fixed to an lower part of the housing 60 so that the electric connector 50 can be detachable to external electric power supply sockets.

As well-known as the Edison base, the screw type lamp base 50 is composed of a first power supply terminal 50*a* (i.e. a conductive metal screw cap) and a second power supply terminal 50*b* (i.e. electric contact) positioned at a bottom part of the metal screw cap 50*a* in which dual terminals 50*a* and 50*b* are insulated to each other.

Instead of the cap 50 for electric light bulbs of the Edison base, the cap (not shown) of the hook type of a well-known swan base may be used, in which the swan base is composed of an insulator and a pair of linear shaped electric terminals.

As shown in FIG. 3 and FIG. 6, two electric supply leads 13 (13*a* and 13*b*) are connected to the first and power supply terminals 50*a* and 50*b* of the Edison base (cap) 50 for electric light bulbs at one end and are connected to input terminals of the lighting circuit 40 at other end.

Output electric leads 12*a* and 12*b* of the lighting circuit 40 are connected to two input terminals 11*a* and 11*b* of the printed circuit board 11.

Alternating current (AC) power supplied to the lighting circuit 40 is changed into direct current (DC) power by rectifying the AC power so that the DC power is supplied to the semiconductor light emitting element (e.g. LED/LEDs) 10 to emit short wavelength light.

A light bulb type semiconductor light lamp (LED lamp) 100 is composed of the hemispherical globe 20 containing the light emitting unit LU, the housing 60 containing the lighting circuit 40 which combines with the hemispherical globe 20 and the power supply base 50 for electric light bulbs.

As shown in FIG. 6, an example of the lighting circuit 40 may be composed of a voltage step-down circuit 40*b*, e.g. transformer, which drops the voltage of an external AC power such as a commercial AC power and a rectifier circuit 40*a* including a diode bridge and a capacitor which changes the AC power into the DC power.

As shown in FIG. 6, a plurality of LEDs 10 is mounted on the printed circuit board 11 in such a way that the LEDs 10(1), 10(2), 10(3), - - - , 10($n$−1) and 10*n*) are connected in a series connection by a printed wiring 11*c* on the circuit board 11.

Instead of the series connection as mentioned in above, the LEDs 10 may be carried out in a parallel connection or a series and parallel connection.

As shown in FIG. 5 and FIG. 7, a plurality of fluorescent protrusions 30 are formed in/on an inner surface of the light transmitting globe 20.

The fluorescent protrusion 30 is composed of a light transmitting protrusion (i.e. projection, convex) 30*a* and a fluorescent film 30*b* formed in/on an exposed surface of the light transmitting protrusion 30*a*.

A plurality of transparent protrusions 30*a* may be formed on the inner surface of the transparent globe 20.

The transparent globe 20 and the transparent protrusions 30*a* can be produced simultaneously by carrying out a heat molding of the transparent thermoplastic synthetic resin and thereby the transparent globe 20 having the transparent projections 30*a* in the inner surface of the globe 20 can be mass-produced with a low cost.

As shown in FIG. 5, a fluorescent film 31 same as or similar to the fluorescent film 30*b* may be formed on a non-formation area of the inner surface of the globe 20 where the fluorescent protrusions 30 (the light transmitting projection 30*a* and the fluorescent film 30*b*) do not exist.

The fluorescent film 30*b* and the fluorescent film 31 can be simultaneously formed by painting, printing, vacuum evaporation, etc.

As shown in FIG. 7A, FIG. 7B, FIG. 7C and FIG. 7D, the fluorescent film 30*b* formed on the exposed surface of the light transmitting projections (i.e. transparent protrusions) 30*a* may be composed of a transparent binder 30*b*2 and a plurality of phosphor particles 30*b*1 containing in the transparent binder 30*b*2.

Similarly to the fluorescent film 30*b* formed on the light transmitting projection 30*a*, the fluorescent film 31 formed on the inner surface of the light transmitting globe 20 may be composed of a transparent binder 30*b*2 and a plurality of phosphor particles 30*b*1 containing in the transparent binder 30*b*2.

Light emitting diode/diodes (LED/LEDs) or laser diode/diodes (LD/LDs) which irradiate blue light or near-ultraviolet light can be used as the short wavelength semiconductor light emitting element 10.

Combination of a Blue LED and a Yellow Phosphor

As shown in FIG. 7A, a plurality of fluorescent protrusions (30*a* and 30*b*) and a plurality of fluorescent films 31 are formed on an inner surface of the light transmitting globe 20.

Each of the fluorescent protrusions (30*a* and 30*b*) is composed of a light transmitting projection (protrusion) 30*a* and a fluorescent film 30*b* formed on the light transmitting projection (protrusion) 30*a* in which the yellow fluorescent film 30*b* is further composed of a plurality of yellow phosphor particles 30*b*1 containing in a light transmitting film 30*b*2.

The fluorescent films 31 are formed on an inner surface area where the fluorescent protrusions (30*a* and 30*b*) do not exist in which each of the yellow fluorescent films 31 is further composed of a plurality of yellow phosphor particles 31*b*1 containing in a light transmitting film 31*b*2.

The yellow phosphors 30*b*1 of the fluorescent film 30*b* and the yellow phosphors 31*b*1 of the fluorescent film 31*b* absorb blue light L1 (B) from the blue LED 10 so that the blue light L1 (B) is changed to yellow light L1 (Y) by a wavelength-conversion.

Some volume of the yellow light L1 (Y) passes through the transparent or semi-transparent globe 20 and the transparent projection 30*a* and exits from the globe 20 to an exterior space.

At the same time, other some volume of the blue light L1 (B) which is not absorbed in the yellow phosphor 31*b*1 passes through the transparent or semi-transparent globe 20 and the transparent projection 30*a* and exits from the globe 20 to an exterior space.

The blue light L1 (B) and the yellow light L2 (Y) exit to an outer space from the light transmitting globe 20 as white illumination light (WL), in which the white illumination light (WL) is substantially white light with mixed colors including the blue light L1 (B) and the yellow light L2 (Y) which is the complementary color relation of the blue light L1 (B).

With reference to FIG. 3 and FIG. 7, an optical path of the blue light L1 (B) and the yellow light L2 (Y) which carried out wavelength changing of the blue light L1 (B) is explained below.

As shown in FIG. 3 and FIG. 7A, the blue light L1 or L1 (B) indicated as a solid line is emitted from the blue LEDs 10 for directing to an inner surface of the light transmitting globe 20.

A part of the blue light L1 (B) is absorbed by the yellow phosphor particles 30*b*1 containing in the fluorescent film 30*b* formed on the surface of the projection 30*a* of the fluorescent protrusion 30, and it excites the phosphor particles 30*b*1.

Similarly, another part of blue light L1 (B) is absorbed by the yellow phosphor particles 31*b*1 of the fluorescent film 31 formed on the inner surface area of the light transmitting globe 20 where the fluorescent protrusions 30 do not exist, and it excites the phosphor particle 31*b*1.

As shown in FIG. 3 and FIG. 7A, the yellow phosphor particles 30*b*1 and 31*b*1 change a wavelength of absorbed light from the blue light L1 (B) into the yellow light L2 and L2 (Y) indicated as a chain line with an arrow.

The yellow light L2 and L2 (Y) transmit the light transmitting globe 20 and exit there-from to an outer space.

A part of blue light L1 (B) is not absorbed in the fluorescent film 30*b* formed on the surface of the light transmitting protrusion 30*a* and the fluorescent film 31 formed on the surface of the light transmitting globe 20, so that the blue light L1 (B) transmits the fluorescent films 30*b* and 31 and passes through the light transmitting globe 20 to exit to outer space.

As the result, both the yellow light L2/L2 (Y) and the blue light L1 (B) outgo to the outer space of the light transmitting globe 20 and an illumination white light (WL) is obtained in which the white light (WL) is mixed colors of the yellow light L2/L2 (Y) and the blue light L1 (B).

Blue LED: Nitride Based Compound Semiconductor

For example, the blue LED/LEDs used in the invention may be composed of blue LED elements having a center emission wavelength range between 400 nm and 500 nm, which are made of nitride based compound semiconductor (chip) such as a commercially available gallium nitride (GaN) system semiconductor compound.

Further, the blue light LED element may be the LED chip of a gallium nitride indium (InGaN) system which has a light emission peak (peak emission wavelength) between 420 nm and 490 nm.

The blue LED is commercially available, for example, from TOYODA GOSEI CO. LTD, Japan, the Nichia Chemical Industries, Japan, Lumileds Lighting U.S., LLC, U.S.A., Cree, Inc. U.S.A., etc.

A well-known yellow phosphor is excited by the blue light from the blue LED which has a wavelength range (from 400 nm to 500 nm) so that the yellow phosphor converts the blue light to yellow or orange visible light having a wavelength range from 500 nm to 600 nm.

Yellow Phosphor

The yellow phosphor used in the invention may be for example a YAG system phosphor such as an yttrium aluminum garnet which is activated with cerium, in which the YAG system phosphor absorbs a part of the blue light emit light with light emission peak near the wavelength of 510-600 nm.

Combination of a Near Ultraviolet LED and Three-Primary-Color Phosphors

A combination of a near ultraviolet LED and three-primary-color phosphors can be used in the invention in which the near ultraviolet LED element may be composed of gallium nitride (GaN) system semiconductor compound which emits near ultraviolet light having a peak wavelength between 300 nm and 400 nm.

The near ultraviolet LEDs, for example, are commercially available from NICHIA CORPORATION, Japan and NITRIDE SEMICONDUCTORS CO. LTD., Japan.

As shown in FIG. 3 and FIG. 7B, the near-ultraviolet light L1/L1 (UV) indicated as a solid line with an arrow is emitted from near ultraviolet LED 10 for directing to an inner surface of the light transmitting globe 20.

As shown in FIG. 7B, a plurality of fluorescent protrusions (30*a* and 30*b*) and a white fluorescent film 31 are formed on an inner surface of the light transmitting globe 20.

Each of the fluorescent protrusions (30*a* and 30*b*) is composed of a light transmitting projection (protrusion) 30*a* and a white fluorescent film 30*b* formed on the light transmitting projection (protrusion) 30*a*.

The white fluorescent film 30*b* and 31 are further composed of a plurality of three basic color phosphor particles 30*b*1 and 31*b*1 containing in a light transmitting film 30*b*2 and 31*b*2, in which the three-primary-color phosphor particles 30*b*1 and 31*b*1 are composed of a mixture of red, green and blue phosphors.

When the near-ultraviolet light L1 and L1 (UV) are irradiated by the mixture 30*b*1 of these three-primary-colors phosphors, and 31*b*1, a green phosphor, a green phosphor, and a red phosphor absorb the near-ultraviolet light L1 and L1 (UV), and are excited.

When the mixture of these three-primary-color phosphors 30*b*1 and 31*b*1 (R, B and G phosphors) is irradiated by the near-ultraviolet light L1/L1 (UV), the Red, Blue and Green phosphors 30*b*1 and 31*b*1 are excited.

As shown in FIG. 7B, the R, B and G phosphors 30*b*1/31*b*1 excited by the UV light L1/L1 (UV) indicated as a solid line with an arrow emit three primary color visible light L2 indicated as a chain line with an arrow.

Thereby, white light L2 (W) is obtained by a mixture of the red, green and blue light and the white light L2 (W) transmits the light transmitting globe 20 to exit there-from to an outer space.

As shown in FIG. 7B, an UV shielding film 99 is desirably provided on an outer surface of the light transmitting globe 20, in which the UV shielding film 99 absorbs or reflects back near-ultraviolet light L1/L1 (UV) and penetrates only the visible light L2/L2 (W).

For example, the UV shielding film 99 may be composed of an UV activated photo-catalyst such as titanium dioxide (TiO2) or a dichroic mirror film (visible light selective transmitting optical film).

Only a positioning of the UV shielding film 99 is different in FIG. 7B, FIG. 7C and FIG. 7D.

As shown in FIG. 7C, the UV shielding film 99 may be formed on the inner surface of the light transmitting globe 20, in which the fluorescent protrusions (30*a* and 30*b*) and the fluorescent film 31 are formed on the UV shielding film 99.

As shown in FIG. 7D, the UV shielding film 99 may be formed on a surface of the light transmitting projections 30*a* and the inner surface of the light transmitting globe 20, in which the fluorescent film 30*b* and the fluorescent film 31 are formed on the UV shielding film 99.

Three-Primary-Color Phosphors

Three-primary-color (R, G and B) phosphors used in the invention are for example as follows.

a) As a red phosphor, for example, Y2O2 S:Eu, Y2O3:Eu, VO4:Eu, Y(V, P, B) O4:Eu, YNbO4:Eu3, YTaO4:Eu, etc. can be used.

b) As a green phosphor, for example, 3(Ba, Mg, Mn)O and 8 Al2O3:Eu, LaPO4:Ce, Tb, ZnS:Cu, BaMgAl10O17:Eu, Mn, etc. can be used.

c) As a green phosphor, 10(Sr, Ca, Ba)(PO4) 6Cl2:Eu (10(Sr, Ca, Ba, Mg)(PO4) 6:Eu) etc. can be used.

Various Shapes of Projections/Fluorescent Protrusions

Figure 8:
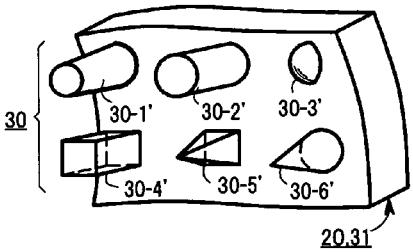
FIG. 8 is a schematic perspective partial view of fluorescent protrusions.
Figure 9:
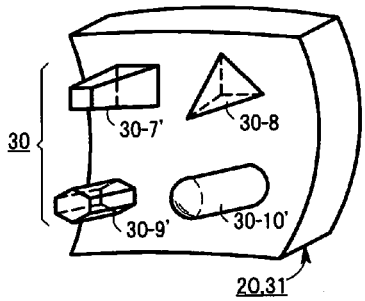
FIG. 9 is a schematic perspective partial view of fluorescent protrusions.

With reference to FIG. 8 and FIG. 9, various modified shapes of the above-mentioned projections and fluorescent protrusions are indicated below, in which FIG. 8 and FIG. 9 are schematic perspective views, As shown in FIG. 8, the fluorescent protrusions 30 (or projections 30*a*) may be modified to the shape selected from a circular truncated cone 30-1', a column 30-2', a hemisphere 30-3', a quadratic prism 30-4', a quadrangular pyramid 30-5', a conic 30-6' or those combinations, in which these fluorescent protrusions 30 can be stood on the fluorescent film 31 or the inner surface of the light transmitting globe 20.

As shown in FIG. 9, the fluorescent protrusions 30 (or projections 30*a*) may be modified to the shape selected from a four pyramidal frustum, a tetrahedron, a hexagon pillar, a column with hemisphere top or those combinations, in which these fluorescent protrusions 30 can be stood on the fluorescent film 31 or the inner surface of the light transmitting globe 20.

The plural fluorescent protrusions 30 shown in FIG. 8, FIG. 9 are arranged isolatedly to each other at an island or point like manner in a sea-like area of the inner surface of the transparent globe 20 or the fluorescent film 31.

Figure 10:
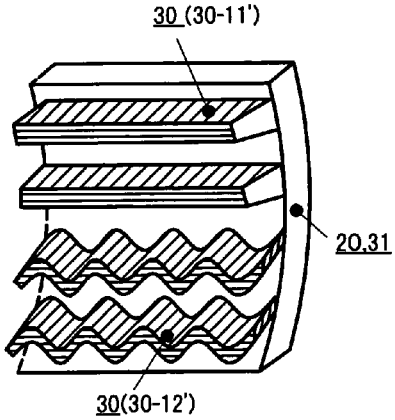
FIG. 10 is a schematic perspective partial view of fluorescent protrusions.

FIG. 10 is a schematic perspective view showing other modifications of the fluorescent protrusions 30 (or projections 30*a* shown in FIG. 7A, FIG. 7B, FIG. 7C and FIG. 7D).

As shown in FIG. 10, the fluorescent protrusions 30 (or projections 30*a* shown in FIG. 7A, FIG. 7B, FIG. 7C and FIG. 7D) are fluorescent walls (or fluorescent partitions) 30 provided on the inner surface of the light transmitting globe 20 or the fluorescent film 31, in which the fluorescent walls.

The fluorescent wall members 30 may be the fluorescent wall members 30-11' having a linear shape and the fluorescent wall members 30-12' having a wave shape.

Fluorescent Grooves

Figure 11:
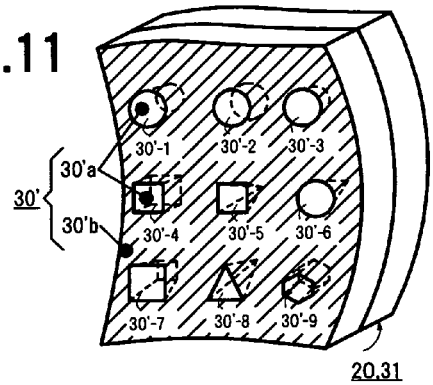
FIG. 11 is a schematic perspective partial view of fluorescent grooves.
Figure 12:
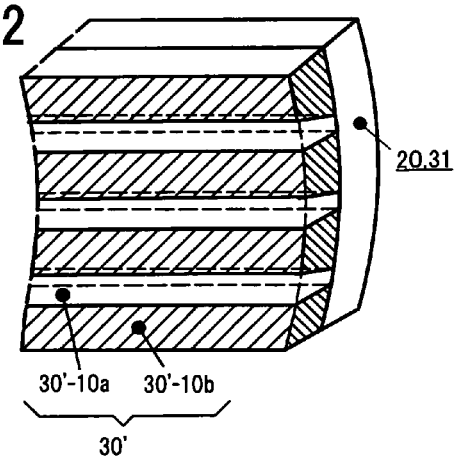
FIG. 12 is a schematic perspective partial view of fluorescent protrusions.

As shown in FIG. 11 and FIG. 12, fluorescent grooves 30' (or fluorescent ditches, fluorescent slots, fluorescent concaves) can be used instead of the fluorescent protrusions 30 shown in FIG. 8, FIG. 9 and FIG. 10.

FIG. 11 is a schematic perspective view showing various kinds of fluorescent protrusions 30'. FIG. 12 is a schematic perspective view showing other type of fluorescent protrusions 30'.

As shown in FIG. 11, the fluorescent grooves 30' (or projections 30'*a*) may have the shape selected from a circular truncated cone 30'-1, a column 30'-2, a hemisphere 30'-3, a quadratic prism 30'-4, a quadrangular pyramid 30'-5, a conic 30'-6, another quadrangular pyramid 30'-7, a triangular pyramid 30'-8 and a hexagonal pillar 30'-9, in which these fluorescent grooves 30' can be formed the fluorescent film 31 or the inner surface of the light transmitting globe 20.

As shown in FIG. 12, fluorescent grooves 30' are composed of linear shaped fluorescent grooves 30'-10*a* are separately arranged in a parallel manner formed between light transmitting layers 30'-10*b* formed on the inner surface of the light transmitting globe 20 or fluorescent film 31.

Other Embodiment of the Invention: A Use of a Dual-Sided Printed Circuit Board

Figure 13:
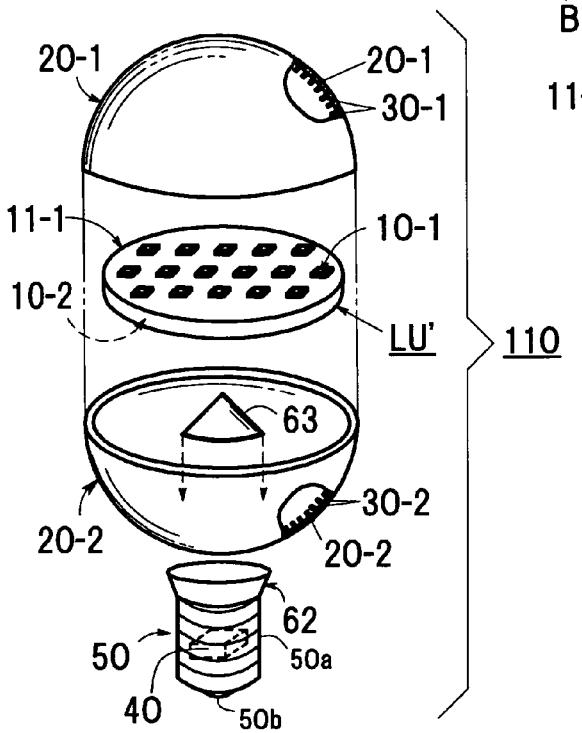
FIG. 13 is a schematic exploded perspective view of a semiconductor lamp 110.
Figure 14:
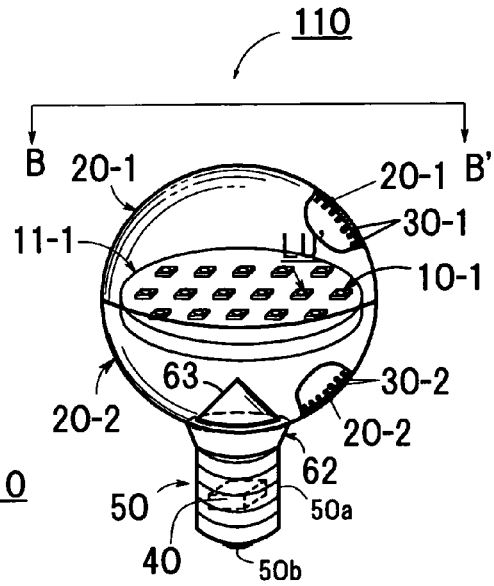
FIG. 14 is a schematic perspective view of the LED lamp 110.
Figure 15:
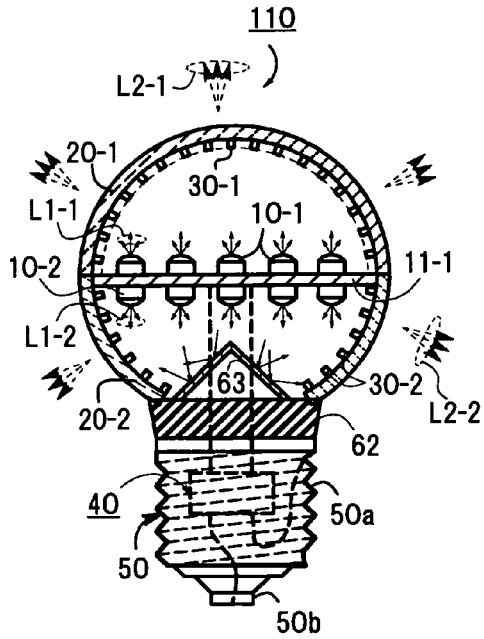
FIG. 15 is a schematic sectional view of the LED lamp 110.

Other embodiment of the invention is described based on FIG. 13 to FIG. 15.

In a description of this embodiment referring to FIG. 13-FIG. 15, the description of the same or similar portions/parts already made hereinbefore is omitted as much as possible, in which the same reference numerals or marks are given to the same or similar portions/parts.

FIG. 13 is a schematic exploded perspective view of a semiconductor lamp (solid-state lamp) 110. FIG. 14 is a schematic perspective view of the semiconductor lamp 110. FIG. 15 is a schematic sectional view of the semiconductor lamp 110 cut along the B-B' line of FIG. 14.

As shown in FIG. 13 to FIG. 15, a semiconductor lamp 110 is briefly composed of a dual-sided printed circuit board 11-1, at least one short wavelength type semiconductor light emitting element 10-1 and 10-2 mounted on dual sides of the dual-sided printed circuit board 11-1 and first/second light transmitting globe segments 20-1 and 20-2, in which first/second fluorescent protrusions 30-1 and 30-2 are provided on each inner surface of the first/second light transmitting globe segments 20-1/20-2, in which the first/second light transmitting globe segments are coupled together to form a unified light transmitting globe.

The semiconductor lamp 110 shown in FIG. 13 to FIG. 15 has a light transmitting globe 20-1 and 20-2 similar to the ball type conventional incandescent lamp with a wide light distribution angle.

The dual-sided printed circuit board 11-1 may be selected from a) an usual dual-sided printed circuit board composed of an insulator base plate or a metal base plate with both insulated surfaces and electric conduction wiring circuits formed on the both surfaces, b) two usual single-sided printed circuit boards laminated together and c) two usual single-sided printed circuit boards to sandwich a thermally conductive plate.

With reference to FIG. 13-FIG. 15, short wavelength type semiconductor light emitting elements 10-1 and 10-2 may be composed of light emitting diodes (LEDs) which emit light L-1 and L-2 with a short wavelength range such as UV or blue light, as same as the LED 10 shown in e.g. FIG. 1-FIG. 4, FIG. 6.

The first and second fluorescent protrusions 30-1 and 30-2 may be composed of the same fluorescent protrusions 30 as described hereinbefore.

When the fluorescent protrusions 30-1 and 30-2 is irradiated by the short wavelength light (UV or blue light) L1-1 and L1-2 emitting from the LEDs 10-1 and 10-2, the fluorescent protrusions 30-1 and 30-2 change the wavelength of the short wavelength light L1-1 and L1-2 into visible light L2-1 and L2-2 with longer wavelength.

A dual-sided printed circuit board 11-1 with substantially flat upper and under surfaces may be provided with a first plural LEDs 10-1 and a second plural LEDs 10-2, in which the first LEDs 10-1 are mounted on the upper surface and the second LEDs 10-2 are mounted on the under surface.

The light transmitting globe 20-1 and 20-2 may be made of light transmitting resin, such as acrylic resins (AC), PMMA, polystyrene resin (PS), polycarbonate resin (PC) and polyethylene terephthalate resin (PET), or light transmitting glass.

A substantially ball type globe 20-1 and 20-2 may be constructed so that opposed circular opening end faces of opposed dome-like first and second segment members 20-1 and 20-2 are coupled by an arbitrary coupling means 21 such as adhesion, welding and screw joining which describe hereinafter referring to FIG. 18A, FIG. 18B, . . . , FIG. 18I and FIG. 18J.

A light emitting unit (light emitting module) LU' is composed of the dual-sided printed circuit board 11-1 and the LED/LEDs (10-1 and 10-2) mounted on the both surfaces of the printed circuit board 11-1, in which the light emitting unit is accommodated in a substantially central position of an inner spherical space surrounded by the substantially ball type globe (20-1 and 20-2).

As shown in FIG. 15, the dual-sided printed circuit board 11-1 may be composed of a disc-like shape having a diameter slightly smaller than an inner diameter of the ball type globe (20-1 and 20-2).

The disk-like dual-sided printed circuit board 11-1, for example, may be fixed to the globe (20-1 and 20-2) in such a manner that a circular peripheral edge of the printed circuit board is partially or entirely adhered or bonded to a central inner surface of the globe (20-1 and 20-2).

An opening can be provided in a bottom of the under semi-spherical shell 20-2 (i.e. the second globe segment member).

It is desirable that a conical reflecting mirror 63 is provided in the inner space of the under semi-spherical shell 20-2.

A support member 62 may be provided between a bottom portion of the under semi-spherical shell 20-2 and an upper portion of a power supply base 50 for conventional electric light bulbs, in which a lighting circuit 40 to control a lighting of the light unit LU' (11-1, 10-1 and 10-2) may be provided in a inner cavity of the power supply base 50.

The electric light bulb type semiconductor lamp 110 as shown in FIG. 13, FIG. 14 and FIG. 15 can be easily attached/detached to a conventional light bulb socket, thereby the light bulb type semiconductor lamp (LED lamp) 110 can replace a conventional incandescent light bulb.

As shown in FIG. 15, the first LEDs 10-1 mounted on the upper surface of the dual-sided printed circuit board 11-1 emit short wavelength light L1-1 (indicated as a solid line with an arrow) irradiates the first fluorescent protrusions 30-1 which are stood on the inner surface of the upper globe 20-1 and/or the first fluorescent film which is formed on the inner surface of the upper globe segment 20-1.

Thereby, the first fluorescent protrusion 30-1 and the first fluorescent film change a part of short wavelength light L1-1 to visible light L2-1 with longer wavelength than the light L1-1 so that visible light L2-1 (indicated as a chain line with an arrow) exits from the upper globe segment 20-1 to outside.

The second LEDs 10-2 mounted on the under surface of the dual-sided printed circuit board 11-1 emit short wavelength light L1-2 (indicated as a solid line with an arrow) so as to irradiate the second fluorescent protrusions 30-2 which are stood on the inner surface of the under globe 20-2 and/or the second fluorescent film which is formed on the inner surface of the under globe segment 20-2.

Thereby, the second fluorescent protrusion 30-2 and the second fluorescent film change a part of short wavelength light L1-2 to visible light L2-2 with longer wavelength than the light L1-2 so that visible light L2-2 (indicated as a chain line with an arrow) exits from the under globe segment 20-2 to outside.

The second LEDs 10-2 mounted on the under surface of the dual-sided printed circuit board 11-1 emit a some volume of short wavelength light L1-2 (indicated as a solid line with an arrow), which irradiates directly the second fluorescent protrusions 30-2 stood on the inner surface of the under globe segment 20-2 and/or the second fluorescent film which is formed on the inner surface of the under globe segment 20-1.

Further, the rest volume of short wavelength light L1-2 irradiates indirectly through the conic reflector 63 the second fluorescent protrusions 30-2 stood on the inner surface of the under globe segment 20-2 and/or the second fluorescent film which is formed on the inner surface of the under globe segment 20-1, in which the conic reflector (reflecting mirror) 63 reflects the light L1-2 in a lateral direction.

Referring to FIG. 13-FIG. 15, as previously described, the semiconductor lamp 110 is roughly composed of the substantially spherical light transmitting globe (a combination of the upper and under globe segments (20-1 and 20-2) and the light unit LU' enclosed within the globe (20-1 and 20-2), in which the multiple fluorescent protrusions 30-1/30-2 stand on the inner surface of the globe (20-1 and 20-2) and the light unit LU' is composed of the both sided printed circuit board 11-1 to mount the LEDs 10-1/10-2 in the both surfaces.

Further, if the semiconductor lamp 110 is provided with the reflector 63, the reflector 63 changes a direction of the light L1-2 from the LEDs 10-2 laterally so that all fluorescent protrusions 30-2 on the under globe segment 20-2 can be irradiated by the light L1-2.

Since the LEDs 10-1/10-2 emit the short wavelength light L1-1/L1-2 (e.g. blue light) to irradiate the fluorescent protrusions 30-1/30-2 containing the yellow phosphor, the fluorescent protrusions 30-1/30-2 convert the blue light L1-1/L1-2 to yellow light L2-1/L2-2. The yellow light L2-1/L2-2 and a part of the blue light L1-1/L1-2 pass through the light transmitting globe (20-1 and 20-2) and thereby white illumination light mixed with the yellow and blue lights can exit from all areas of the ball type globe (20-1 and 20-2) to an exterior.

This ball like LED lamp 110 provides the illumination light having a wide light distribution angle of about 200 degree or preferably about 300 degree or more similarly to the conventional incandescent lamp and the illumination light having a no glare fluorescent light.

Other Embodiment of the Invention

Figure 16:
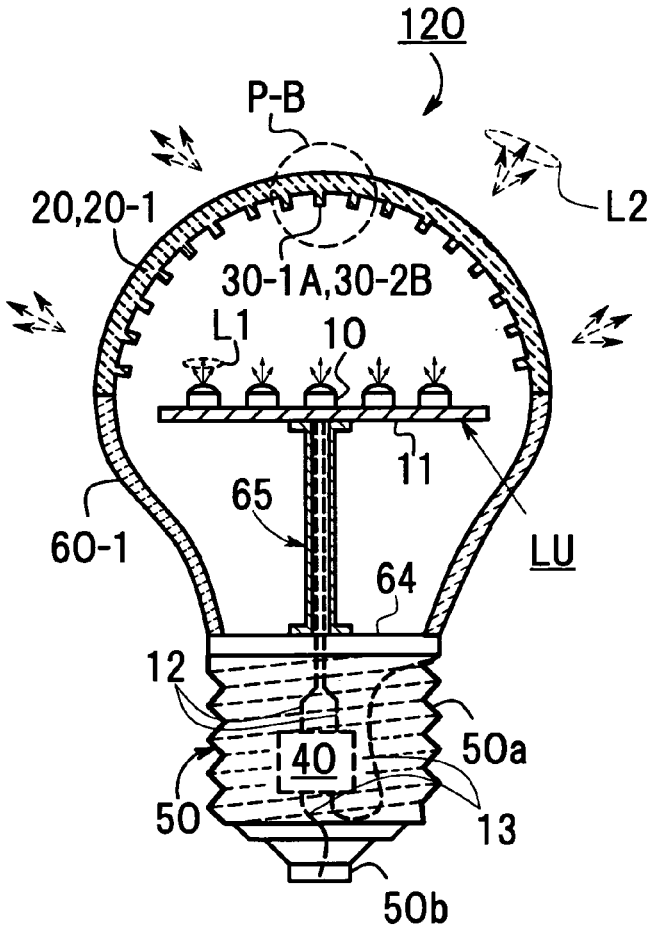
FIG. 16 is a schematic sectional view of a semiconductor lamp 120.
Figure 17A:
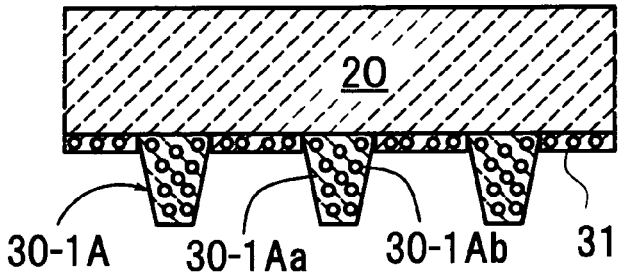
FIG. 17A and FIG. 17B are schematic enlarged sectional views of a part "P-B" of FIG. 16.
Figure 17B:
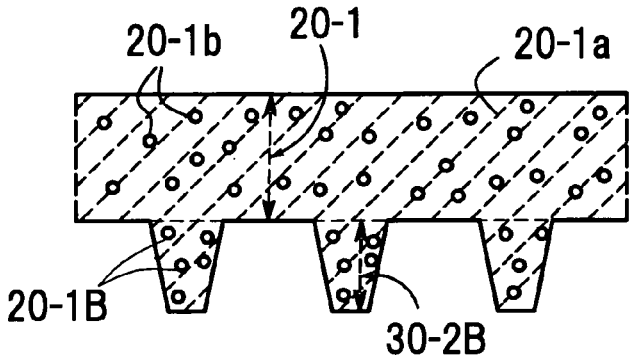

With reference to FIG. 16, FIG. 17A and FIG. 17B, other embodiment of the invention is described in detail.

In a description of this embodiment, the description of the same or similar portions/parts already made hereinbefore is omitted as much as possible, in which The same reference numerals or marks are given to the same or similar portions/parts.

FIG. 16 is a schematic sectional view of a semiconductor lamp 120. FIG. 17A is a schematic enlarged sectional view of a part "P-B" of in FIG. 16. FIG. 17B is another schematic enlarged sectional view of a part "P-B" of in FIG. 16.

As shown in FIG. 16, FIG. 17A, FIG. 17B, a semiconductor lamp 120 according to other embodiment of the invention is roughly composed of a light unit LU and a dome-like light transmitting globe 20/20-1, in which the light unit LU has at least one short wavelength type semiconductor light emitting element (LED/LEDs) 10 emitting blue/UV light L1 to be mounted on a single side printed circuit board 11 and the dome-like light transmitting globe 20/20-1 has a plurality of fluorescent protrusions 30-1A/30-2B formed on an inner surface thereof.

The short wavelength type semiconductor light emitting element 10 is composed of at least one light emitting diode (LED/LEDs) or laser diode (LD/LDs).

As shown in FIG. 16, LEDs 10 are mounted on the upper surface of the printed circuit board 11.

The light transmitting globe 20/20-1 is composed of a semi-spherical (dome-like) light transmitting resin or glass and plural fluorescent protrusions 30-1A/30-2B containing a phosphor and fluorescent film 31 containing the same phosphor are arranged on the inner surface of the light transmitting globe 20/20-1.

As shown on FIG. 16, a funnel shaped housing 60-1 may be composed of a funnel shaped heat conductive shell having an upper circular large opening and a lower circular small opening, in which the funnel shaped housing 60-1 may be coupled to the dome-like light transmitting globe 20/20-1 in the position where the upper large circular opening faces a circular bottom opening of the dome-like light transmitting globe 20/20-1.

Figure 18A:
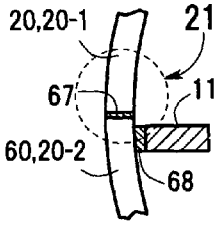
FIG. 18A, FIG. 18B, . . .
Figure 18B:
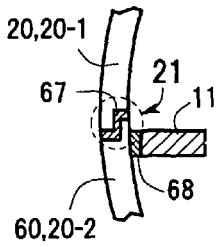
Figure 18C:
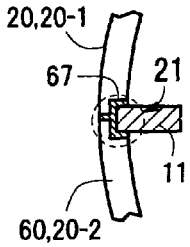
FIG. 18I and FIG. 18J are schematic sectional views of coupling means 21.
Figure 18D:
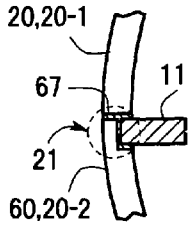
Figure 18E:
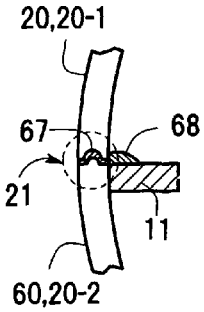
Figure 18F:
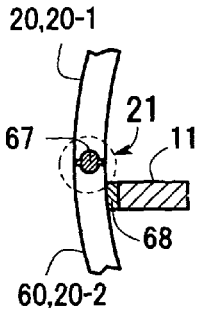
Figure 18G:
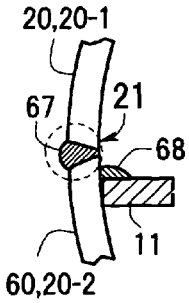
Figure 18H:
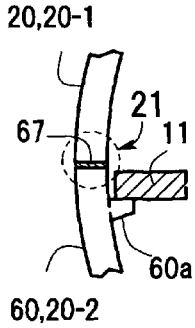
Figure 18I:
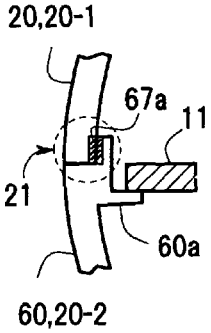
Figure 18J:
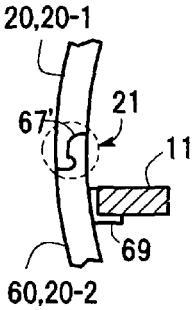

As shown in FIG. 16, FIG. 18A, FIG. 18B, . . . , FIG. 18I and FIG. 18J, the funnel shaped housing 60-1 may be connected together to the dome-like light transmitting globe 20/20-1 by any coupling means 21.

As shown in FIG. 16, the light unit LU having the LEDs 10 mounting on the upper surface of the printed circuit board 11 is arranged horizontally in an inner space surrounded by the semi-spherical light transmitting globe 20/20-1 and the funnel shaped housing 60-1.

A substantially circular support 64 is positioned between the bottom of the funnel like housing 60-1 and an upper part of a power supply connector 50 (e.g. Edison type screw base) having two electrical terminals 50*a* and 50*b*.

A post 65 having a hollow pipe extends from the circular support 64 to the printed circuit board 11 of the light unit LU so that the light unit LU is kept at substantially central position of the inner space surrounded by the semi-spherical light transmitting globe 20/20-1 and the funnel shaped housing 60-1.

A lighting circuit 40 controlling a lighting of the LEDs 10 may be accommodated in a cavity of the Edison base 50 with the two power supply electrical terminals 50*a* and 50*b*, in which output terminals of the lighting circuit 40 is connected to the LEDs 10 on the printed circuit board 11 via electric conductive lead wires 12 and input terminals of the lighting circuit 40 is connected to the electrical terminals 50*a* and 50*b* via electric conductive lead wires 13.

The light unit LU is arranged such that light L1 from the LEDs 10 is directed to the inner surface of the light transmitting semi-spherical globe 20/20-1 and the light L1 can irradiate the inner surface and all the plural fluorescent protrusions 30-1A/30-2B formed on the inner surface.

As shown in FIG. 16, an electric light bulb type semiconductor light lamp 110 may be composed of a) the semi-spherical globe 20/20-1 coupled to the funnel shaped housing 60-1 to be unified together, b) the light unit LU (the LEDs 10 and the printed circuit board 20) supported by the post 65 enclosed in the inner space surrounded by the globe 20/20-1 and the funnel shaped housing 60-1 and c) the Edison type power supply base 50 to enclose the lighting circuit 40 within the cavity of the base 50, in which the above members a), b) and c) are assembled to be united and thereby a light bulb type LED lamp 110 can be provide which is capable of attaching/detaching to existing power supply sockets for conventional incandescent lamps.

Fluorescent Protrusions

Fluorescent protrusions 30-1A and 30-2B formed on the dome like globe 20, 20-1 are described with reference to FIG. 17A and FIG. 17B below, in which FIG. 17A and FIG. 17B are schematic enlarged sectional views of a part "P-B" of FIG. 16.

As shown in FIG. 16 and FIG. 17A, in the LED lamp 120, the plural fluorescent protrusions 30-1A are arranged on the inner surface of the light transmitting globe 20, 20-1 in which each of the plural fluorescent protrusions 30-1A is composed of a light transmitting protrusion/projection 30-1Aa and a plurality of phosphor particles 30-1Ab containing within the light transmitting protrusion/projection 30-1Aa.

Further, the fluorescent film 31 containing the same phosphor particles within a light transmitting film may desirably be provided on the inner surface of the dome-like light transmitting globe 20 at the positions where the fluorescent protrusions do not exist on the inner surface.

As shown in FIG. 16 and FIG. 17B, in the LED lamp 110, a light transmitting globe 20-1 is provided with plural light transmitting protrusions 30-2B on an inner surface of the globe 20-1, in which plural phosphor particles 20-1B are contained within the light transmitting globe 20-1 and also within the light transmitting protrusions 30-2B.

Coupling Means for Two Globe Segment Members

With reference to FIG. 18A to FIG. 18J, various coupling means for two globe segment members are described in which the dome-like globe first segment 20/20-1 and the reversed dome-like globe second segment (or the funnel like housing) 20-2/60 are coupled together by coupling means 21, in which FIG. 18A to FIG. 18K is a schematic fragmentary sectional view showing various kinds of the coupling means 21.

As shown in FIG. 18A, the upper light transmitting first globe segment 20/20-1 and the under light transmitting second globe segment or housing 60, 60-1/20-2 are coupled together using an adhesive layer 67 (i.e. the coupling means 21) by which the both circular periphery end faces of the first segment 20/20-1 and the second segment or housing 60, 60-1/20-2 are jointed together.

The periphery end face of the printed circuit board 11 may be adhered to the housing 60 or the second globe segment 20-2 by an adhesive 68 (coupling means 21), so that the printed circuit board 11 is supported horizontally.

As shown in FIG. 18B similarly to in FIG. 18A, the upper light transmitting first globe segment 20/20-1 and the under light transmitting second globe segment or housing 60, 60-1/20-2 are coupled together using an adhesive layer 67 (i.e. the coupling means 21) by which the both circular periphery end faces of the first segment 20/20-1 and the second segment or housing 60, 60-1/20-2 are jointed together.

Different from in FIG. 18A, the upper light transmitting first globe segment 20/20-1 and the under light transmitting second globe segment or housing 60, 60-1/20-2 have first and second cutting faces in the periphery end faces in order to engage to each other, so that a bonding strength of the first and second globe segments are increased.

As shown in FIG. 18B, similarly to in FIG. 18A, the periphery end face of the printed circuit board 11 may be adhered to the housing 60 or the second globe segment 20-2 by an adhesive 68 (coupling means 21), so that the printed circuit board 11 is supported horizontally.

As shown in FIG. 18C similarly to in FIG. 18A, the upper light transmitting first globe segment 20/20-1 and the under light transmitting second globe segment or housing 60, 60-1/20-2 are coupled together using an adhesive layer 67 (i.e. the coupling means 21) by which the both circular periphery end faces of the first segment 20/20-1 and the second segment or housing 60, 60-1/20-2 are jointed together.

As shown in FIG. 18C different from in FIG. 18A, the upper light transmitting first globe segment 20/20-1 and the under light transmitting second globe segment or housing 60, 60-1/20-2 have first and second cutting faces to form a slitting in order to insert the periphery end face of the printed circuit board 11 so that the first globe segment 20/20-1, the second globe segment or housing 60, 60-1/20-2 and the printed circuit board 11 are bonded together by an adhesive 67 (coupling means 21).

As shown in FIG. 18D, the under light transmitting second globe segment or housing 60, 60-1/20-2 have a cutting face to form a slitting in order to insert the periphery end face of the printed circuit board 11 so that the first globe segment 20/20-1, the second globe segment or housing 60, 60-1/20-2 and the printed circuit board 11 are bonded together by an adhesive 67 (coupling means 21).

As shown in FIG. 18E, the upper light transmitting first globe segment 20/20-1 and the under light transmitting second globe segment or housing 60/20-2 have a concave and a convex respectively on these peripheral end faces in order to be bonded together by an adhesive 67 (coupling means 21) located between the concave and the convex.

As shown in FIG. 18E, further the printed circuit board 11 is fixed to the upper light transmitting first globe segment 20/20-1 and the under light transmitting second globe segment or housing 60/20-2 by another adhesive 68.

As shown in FIG. 18F, the upper light transmitting first globe segment 20/20-1 and the under light transmitting second globe segment or housing 60/20-2 have opposed concaves on these peripheral end faces in which an adhesive 67 (coupling means 21) is placed in an air gap between the opposed concaves in order to be bonded together, further the printed circuit board 11 is fixed to the under light transmitting second globe segment or housing 60/20-2 by another adhesive 68.

As shown in FIG. 18G, an upper first globe segment 20, 20-1 and an under second globe segment 20-2 (or housing 60) have opposed inclined periphery end faces which form a "V" shaped air gap where an adhesive 67 (coupling means 67) is filled by which the first globe segment 20, 20-1 and the under second globe segment 20-2 (or housing 60) is jointed or coupled together, further the printed circuit board 11 is fixed to the under light transmitting second globe segment or housing 60/20-2 by another adhesive 68.

As shown in FIG. 18H, similarly to in FIG. 18A, the upper light transmitting first globe segment 20/20-1 and the under light transmitting second globe segment or housing 60, 60-1/20-2 are coupled together using an adhesive layer 67 (i.e. the coupling means 21) by which the both circular periphery end faces of the first segment 20/20-1 and the second segment or housing 60, 60-1/20-2 are jointed together.

Different from in FIG. 18A, a support 60*a* is extended from an inner surface of the under light transmitting second globe segment or housing 60/20-2, in which a printed circuit board 11 is supported on the support 60*a* horizontally.

As shown in FIG. 18I, an upper light transmitting first globe segment 20/20-1 and an under light transmitting second globe segment or housing 60/20-2 are provided with a pair of screws 67*a* (coupling means 21) at the peripheral ends so that the upper light transmitting first globe segment 20/20-1 is easily coupled with the under light transmitting second globe segment or housing 60/20-2 by a screw joining using the screws 67*a*.

As shown in FIG. 18J, an upper light transmitting first globe segment 20/20-1 and an under light transmitting second globe segment or housing 60/20-2 are provided with opposed concave and convex 67' (coupling means 21) at the peripheral ends so that the upper light transmitting first globe segment 20/20-1 is easily coupled with the under light transmitting second globe segment or housing 60/20-2 by the coupling means 21 using an elasticity of the first globe segment 20/20-1 and second globe segment or housing 60/20-2 with the opposed concave and convex 67'.

Further, a "L" shaped support 69 is fixed to an inner surface of the second globe segment or housing 60/20-2 on which a printed circuit board 11 is fixed.

Other Embodiments of the Invention: Fluorescent Fiber

Other embodiments of the invention are described based on FIG. 19, FIG. 20A, FIG. 20B, FIG. 21 and FIG. 22.

In a description of the embodiments referring to FIG. 19, FIG. 20A, FIG. 20B, FIG. 21 and FIG. 22, the description of the same or similar portions/parts already made hereinbefore is omitted as much as possible, in which The same reference numerals or marks are given to the same or similar portions/parts.

In the embodiments referring to FIG. 19, FIG. 20A, FIG. 20B, FIG. 21 and FIG. 22, a plurality of fluorescent fibers 35 and 36 having a phosphor are used instead of the fluorescent protrusions 30 shown in FIG. 1 to FIG. 12.

Figure 19:
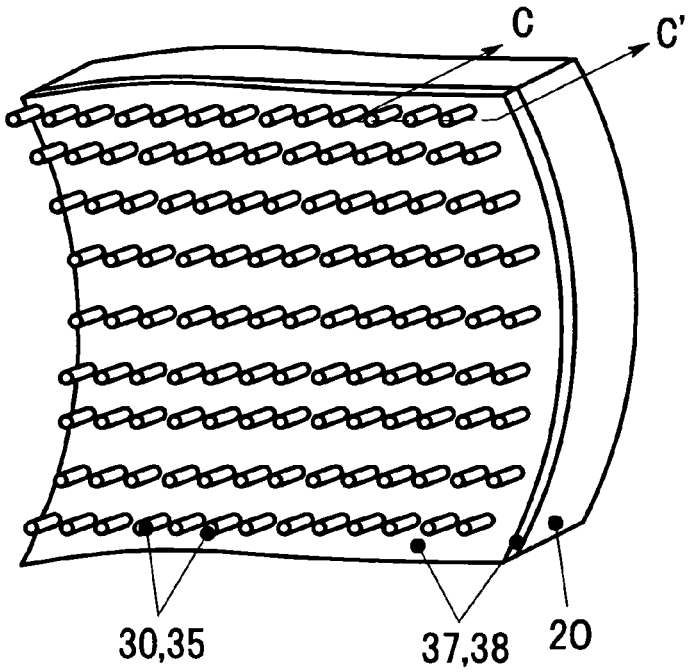
FIG. 19 is a schematic partial and enlarged sectional view showing fluorescent fibers.
Figure 20A:
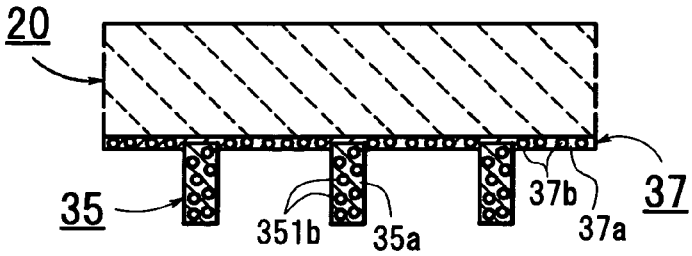
FIG. 20A and FIG. 20B are schematic enlarged fragmentary sectional views cut along the line C-C of FIG. 19.
Figure 20B:
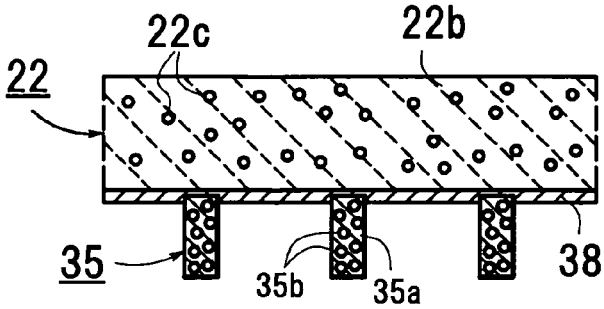
Figure 21:
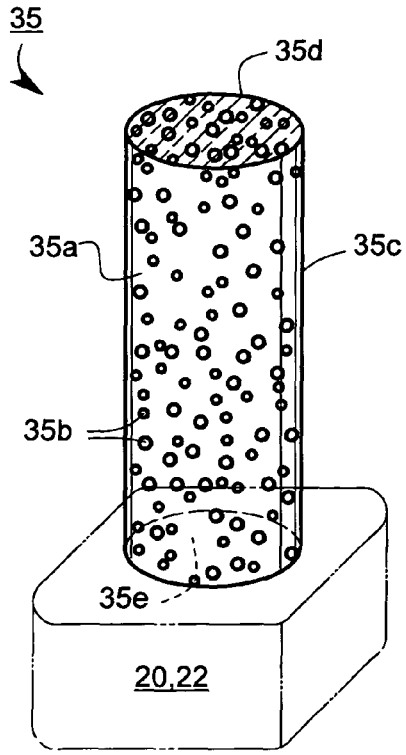
FIG. 21 is a schematic enlarged perspective view showing one fluorescent fiber 35.
Figure 22:
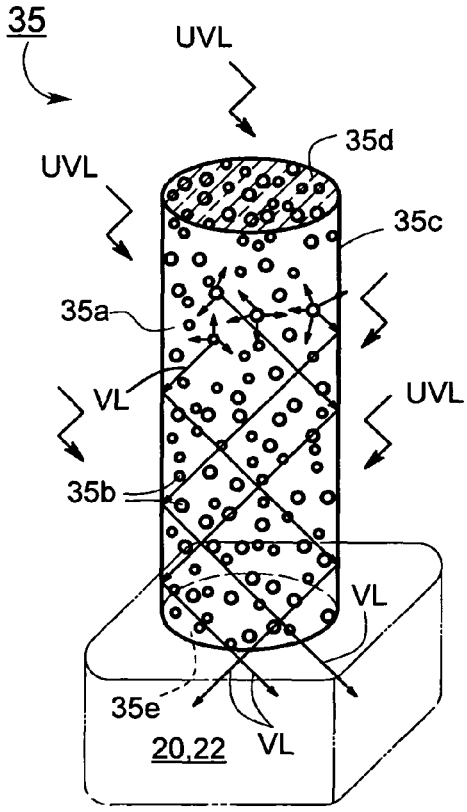
FIG. 22 is a schematic enlarged perspective view showing the principle of luminescence and optical path of the fluorescent fiber 35.

FIG. 19 is a schematic partial and enlarged sectional view showing fluorescent fibers stand on an inner surface of a light transmitting globe. FIG. 20A and FIG. 20B are schematic enlarged fragmentary sectional views cut along the line C-C of FIG. 19. FIG. 21 is a schematic enlarged perspective view showing one fluorescent fiber 35. FIG. 22 is a schematic enlarged perspective view showing the principle of luminescence and optical path of the fluorescent fiber 35.

As shown in FIG. 19, a plurality of fluorescent fibers 35 and 36 carrying a phosphor are arranged to stand on an inner surface of a light transmitting globes 20 and 22.

In the example shown in FIG. 20 A, each fluorescent fiber 35 may be composed of an optical fiber core (i.e. light transmitting fiber) 35*a* and a plurality of phosphor particles 35*b* which are contained within the optical fiber core 35*a*, in which a plurality of fluorescent fibers 35 are arranged to stand on the inner surface of a light transmitting globe 20.

Further, a fluorescent layer 37 is desirably arranged on the inner surface of the light transmitting globe 20, in which the fluorescent layer 37 is composed of a light transmitting film 37*a* (e.g. transparent adhesive/binder) and a plurality of phosphor particles 37*b* containing within the light transmitting film 37*a*.

In the example shown in FIG. 20 B, each fluorescent fiber 35 is composed of an optical fiber core (i.e. light transmitting fiber) 35*a* and a plurality of phosphor particles 35*b* which are contained within the optical fiber core 35*a*, and a fluorescent globe 22 is composed of a light transmitting globe 22*b* and a plurality of phosphor particles 22*c* which are contained within the light transmitting globe 22*b*, in which a plurality of the fluorescent fibers 35 is arranged to stand on the inner surface of the fluorescent globe 22.

The fluorescent fibers 35 may be flocked on a transparent adhesive layer 38 (see FIG. 20B) or the fluorescent adhesive layer 37 (see FIG. 20A) which is formed on the inner surface of the light transmitting globe 20 (see FIG. 20B) or the fluorescent globe 22 (see FIG. 20A).

Fluorescent Fiber Having a Single Core Structure

As shown in FIG. 21 and FIG. 22, a fluorescent fiber having a single core structure is used for this embodiment.

FIG. 21 is a schematic enlarged perspective view showing a fluorescent fiber which has a single core structure. FIG. 22 is a schematic enlarged perspective view explaining the principle and an optical path of the fluorescent fiber shown in FIG. 21.

As shown in FIG. 21 and FIG. 22, a fluorescent fiber 35 having a single core structure is composed of a light conductive core 35*a* and a plurality of phosphor particles 35*b* containing in the light conductive core 35*a*.

The fluorescent fiber 35 further composed of a fixed end (proximate end) 35*e*, a free end (distal end) 35*d* opposed to the fixed end 35*e* and a side surface 35*c*, in which the fluorescent fiber 35 stands on the inner surface of the globe 20 or 22.

As shown in FIG. 22, when light "UVL" emitted from ultraviolet LED enters into the light conductive core 35*a* from the free end 35*d* and the side surface 35*c*, the phosphor (phosphor particles) 35*b* contained in the light conductive core 35*a* is excited by the light "UVL" so that visible light "VL" is emitted from the phosphor 35*b* and passes through the globe 20, 22 to exit to an exterior space.

A part of the visible light "VL" from the phosphor 35*b* advances to the side surface 35*c*, the free end 35*d* and/or the fixed end 35*e* in the core 35*b*, so that the visible light "VL" exits from the core 35.

Another part of the visible light "VL" from the phosphor 35*b* advances to the side surface 35*c* of the core 35 and reflects at least one time at the side surface 35*c* by the total internal reflection (TIR) to advance in the direction of the free end 35*d* and/or the fixed end 35*e*, so that the visible light "VL" exits from the core 35.

Most of the visible light "VL" generated from the phosphor 35*b* of the fluorescent fiber 35 exits from the visible light transmitting globe (cover) 20, 22 to an outer space.

A size of the fluorescent fiber 35 may have an aspect ratio (a ratio of length/diameter) of about 1 to 200 and desirably 2-50.

Other Embodiments: Fluorescent Fiber Having a Core-Clad Composite Configuration In other embodiments referring to FIG. 23 to FIG. 25, a fluorescent fiber having a core-clad composite configuration is used, in which the fluorescent fiber is composed of a light conductive core and a phosphor contained clad to cover the core.

FIG. 21 is a schematic enlarged perspective view showing one fluorescent fiber 35. FIG. 22 is a schematic enlarged perspective view showing the principle of luminescence and optical path of the fluorescent fiber 35.

Figure 23:
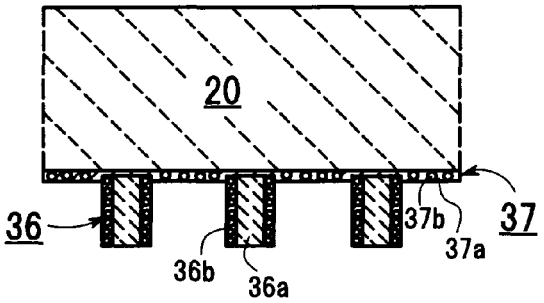
FIG. 23 is a schematic enlarged perspective view showing the fluorescent fibers 36.
Figure 24:
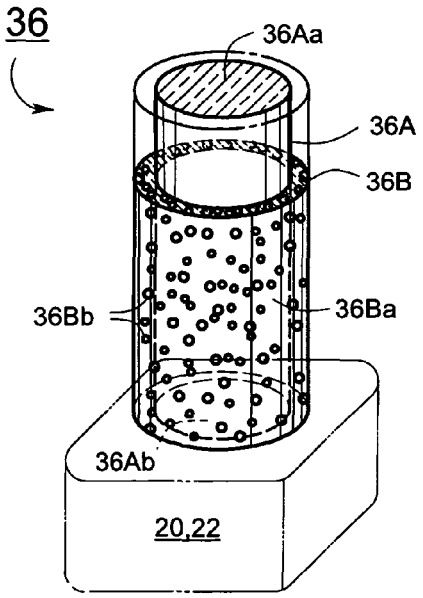
FIG. 24 is a schematic enlarged perspective view showing one fluorescent fiber 36.
Figure 25:
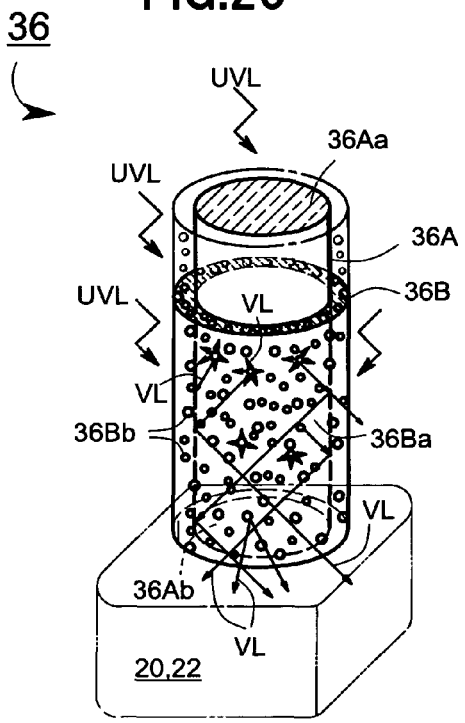
FIG. 25 is a schematic enlarged perspective view showing the principle of luminescence and optical path of the fluorescent fiber 36.

As shown in FIG. 23, FIG. 24 and FIG. 25, a fluorescent fiber 36 with a core-clad composite configuration is composed of a light conductive core 36A and a fluorescent clad 36B containing a plurality of phosphors 36Bb in a transparent clad 36Ba, in which the fluorescent clad 36B is covered on a side surface of the light conductive core 36A.

Further, the fluorescent fiber 36 is composed of a fixed end (proximate end) 36Ab, a free end (distal end) 36Aa opposed to the fixed end 36Ab and a length, in which the plural fluorescent fibers 36 stand on an inner surface of the globe 20, 22.

As shown in FIG. 25, light "UVL" emitted from ultraviolet LED enters into the fluorescent clad 36B arranged on the side surface of the fluorescent fiber 36 and further the light "UVL" enters into the light conductive core 36A from the free end 36Aa so that the light "UVL" advances within the light conductive core 36A to leak from the core 36A into the fluorescent clad 36B.

When the fluorescent clad 36B receives the UV light "UVL", the phosphor particles 30Bb contained in the fluorescent clad 36B are excited by the UV light "UVL" and visible light "VL" is emitted as scattered or diffused light which does not have a directivity.

A part of the visible light "VL" is introduced into the core 36A from the fluorescent clad 36B and this visible light "VL" advances the inside of the core 36A to the fixed end 36Ab and passes through the globe 20, 22 to an outer space.

Like the general step index type optical fiber used in optical communications etc., the refractive index of the core 36A is made larger than the refractive index of the clad 36B, 36Ba, a part of visible light "VL" entered into the core 36A reflects at the clad 36Ba, 36Ba at least one time based on the total internal reflection (TIR), and the light "VL" further advances toward the fixed end 36Ab and passes through the globe 20, 22 to exit to an outer space.

Another part of the visible light "VL" is emitted from an exposed side surface of the clad 36B, 36Ba.

As explained before, most of the visible light "VL" exits from the light transmitting globe (cover) 20, 22, in which the fluorescent fibers 36 are supported and fixed on the inner surface of the globe 20 and 22.

Other Embodiments of the Invention: Use of a Leaky Light Guide with a Linear Shape In the embodiments shown in FIG. 26 to FIG. 28, FIG. 29A and FIG. 29B, various leaky light guides with a linear shape are used for a main component.

In this embodiment, a description of the same part as various kinds of above-mentioned embodiments is omitted as much as possible. (The same reference numeral or mark is given to the same part or member.)

Figure 26:
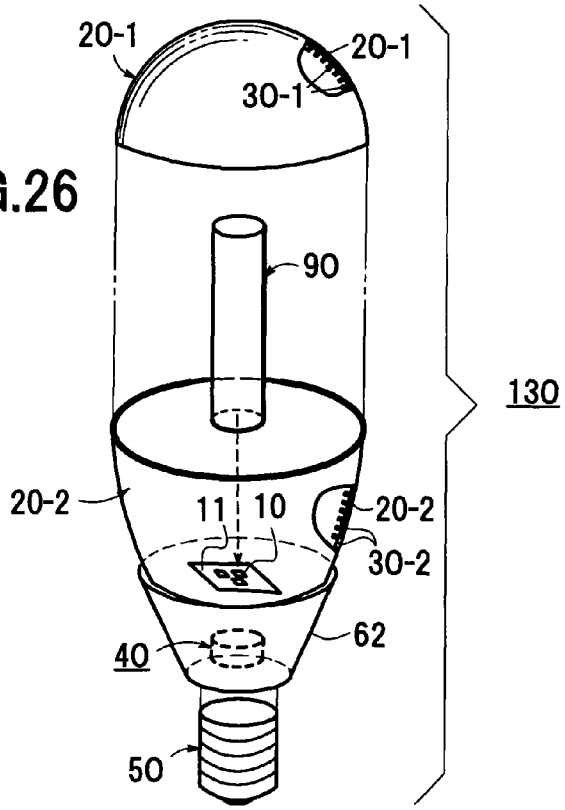
FIG. 26 is a schematic exploded perspective view of an LED lamp 130.
Figure 27:
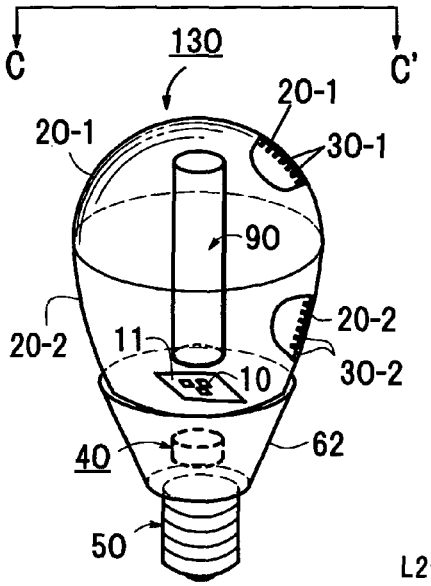
FIG. 27 is a schematic perspective view of the LED lamp 130.
Figure 28:
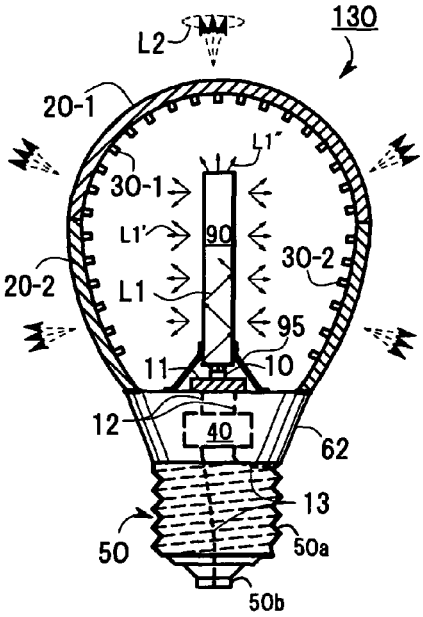
FIG. 28 is a schematic sectional view of the LED lamp 130.
Figure 29A:
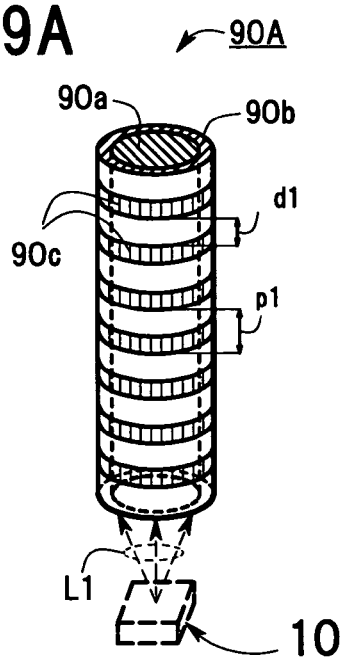
FIG. 29A is a schematic perspective view showing a leaky light guide 90A.
Figure 29B:
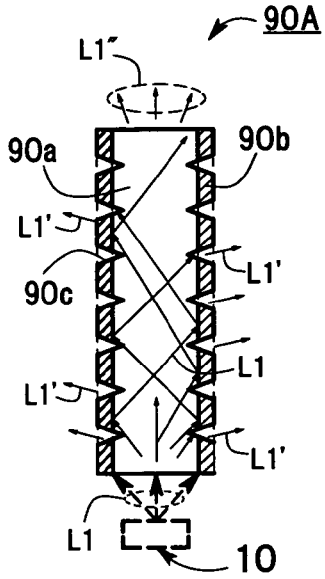
FIG. 29B is a schematic sectional view showing the leaky light guide 90A.

FIG. 26 is a schematic exploded perspective view of an LED lamp 130. FIG. 27 is a schematic perspective view of the LED lamp 130. FIG. 28 is a schematic sectional view of the semiconductor lamp 130 cut along the line C-C' of FIG. 27. FIG. 29A is a schematic perspective view showing a leaky light guide 90A with a linear shape. FIG. 29B is a schematic sectional view showing the leaky light guide 90A.

As shown in FIG. 26 to FIG. 28, FIG. 29A and FIG. 29B, a semiconductor lamp 130 may be composed of at least one short wavelength type semiconductor light emitting element (LED/LEDs) 10 which emits blue or UV light, a light transmitting first globe segment 20-1 having first fluorescent protrusions 30-1, a light transmitting second globe segment 20-2 having second fluorescent protrusions 30-2 and a leaky light guide with a linear shape 90, 90A.

The first globe segment 20-1 having a dome like shape and the second globe segment 20-2 having a reversed dome like shape are coupled together to form an envelope with an inner space (cavity) to accommodate the LED/LEDs 10 and a linear shaped leaky light guide 90, 90A.

The leaky light guide with a linear shape 90, 90A is a linear shaped leaky light guide or a leaky light guide rod which is arranged vertically within the globe (20-1 and 20-2), in which the leaky light guide 90, 90A can transmit light L1 inside along its length and leak light L1' from a side surface along its length.

The short wavelength type LED/LEDs 10 is mounted on a printed circuit board 11 to constitute a light unit.

The dome like light transmitting first globe segment 20-1 may be coupled together to the reversed dome like light transmitting second globe segment 20-2 to construct a single envelope with an inner cavity to house the light unit (LED/LEDs mounted circuit board) and the leaky light guide 90, in which first fluorescent fibers 30-1 and second fluorescent fibers 30-2 are arranged on inner surfaces of the first globe segment 20-1 and the second globe segment 20-2 respectively.

The linear leaky light guide 90 may be fixed to a support member 95 at that fixed end, in which the support member 95 is fixed to an upper portion of the housing 62 and the light unit (the LED/LEDs 10 and the printed circuit board 11) is located on the upper portion of the housing 62 so that light L1 from the LED/LEDs 10 enters into the fixed end (proximate end) of the linear leaky light guide 90.

The fixed end of the linear leaky light guide 90, 90A is located near the light unit (10 and 11) to face that light emitting surface so that light L1 from the LED/LEDs 10 enters into the light guide 90 and the free end of the linear leaky light guide 90, 90A is elongated near an inner surface of the dome like first globe segment 20-1.

A housing 62 having a funnel shape is fixed to a bottom of the reversed dome like second globe segment 20-2, in which a lighting circuit 40 to supply a driving power to the light unit (LED/LEDs 10 and the circuit board 11) may be accommodated within an inner space of the housing 62.

A power supply connector (e.g. Edison base) 50 for use in conventional electric light bulbs may be fixed to a bottom of the housing 62, so that the LED lamp 130 can be detached and attached to a conventional power supply socket for the electric light bulbs, thereby the LED lamp 130 can replace a conventional incandescent light bulb.

This LED lamp 130 having a liner leaky light guide 90 (90A, 90B, 90C, 90D, 90E, 90F, 90G, 90H, 90J, 90K and 90L) within the globe segments 20-1 and 20-2 provides the illumination light having a wide light distribution angle of about 200 degree or preferably about 300 degree or more similarly to the conventional incandescent lamp and the illumination light having a no glare fluorescent light.

As shown in FIG. 28, FIG. 29A and FIG. 29B, the leaky light guide 90 and 90A receive short wavelength light L1 emitted from the LED/LEDs 10 in the fixed end surface so that the light L1 advances to repeat the total internal reflection (TIR) or to go straight toward the free end.

A part of the light L1 exits from a side surface 90*b* to an outer space on the way to the transmission, so that the light L1 becomes leaky light L1'. Another part of the light L1 advances within the linear leaky light guide 90, 90A based on the TIR toward the free end at the top, so that the light L1 exits from the free end to an outer space to become light L1".

As shown in FIG. 28 and FIG. 29B, the short wavelength light L1' to exit from the side surface 90*b* and the short wavelength light L1" to exit from the free end can irradiate almost all the first and second fluorescent protrusions 30-1 and 30-2 formed on the inner surface of the unified light transmitting globe (first and second globes) 20-1 and 20-2.

When the first and second fluorescent protrusions 30-1 and 30-2 are irradiated by the short wavelength light L1' and L1", the phosphor contained in the fluorescent protrusions 30-1 and 30-2 absorbs some volume of the short wavelength light L1' and L1" so that the phosphor converts the short wavelength light L1' and L1" to visible light L2 with longer wavelength than the short wavelength light L1' and L1.

The rest volume of the short wavelength light (L1' and L1") passes through the unified light 30-2) and the light (L1' and L1") exits from the globe (20-1 and 20-2), in which the light (L1' and L1") and the light L2 are mixed together to become illumination light.

When a combination of the blue LED 10 and the yellow phosphor contained in the fluorescent protrusions 30-1 and 30-2 is used, the short wavelength light L1' and L1" to exit from the leaky light guide 90 and 90A are blue light and the yellow phosphor changes the blue light L1' and L1" to yellow light L2, and thereby substantially white illumination light mixed with the blue light L1' and L1" and the yellow light L2 exits from the light transmitting globe (20-1 and 20-2) to an outer space.

When a combination of the ultraviolet (UV) LED 10 and the three primary color phosphors contained in the fluorescent protrusions 30-1 and 30-2 is used, the short wavelength light L1' and L1" to exit from the leaky light guide 90 and 90A are UV light and the three primary color phosphors change the UV light L1' and L1" to white light L2-1 and L2-2 mixed with the red, green and blue color lights, and thereby true white illumination light exits from the light transmitting globe (20-1 and 20-2) to an outer space.

Further, a fluorescent film containing the three primary color phosphors is preferably provided on an inner surface of the light transmitting globe (20-1 and 20-2) in the area where the fluorescent protrusions (30-1 and 30-2) do not exist.

Since almost all the UV light L1' and L1" can be absorbed in both of the fluorescent protrusion (90 and 90A) and the fluorescent film on the light transmitting globe (20-1 and 20-2), and can be changed to white light (L2-1 and L2-2), a leakage of the UV lights (L1' and L1") from the light transmitting globe (20-1 and 20-2) to the outer space can be ignored or minimized.

An Example of Linear Leaky Light Guide

As shown in FIG. 29A (perspective view) and FIG. 29B (sectional view), an example of linear leaky light guide 90A is composed of a cylindrical light guide core 90*a* and a light guide clad 90*b* selectively covered on the side of the light guide core 90*a*.

The core 90*a* has a refractive index higher than the clad 90*b*, the clad 90*b* is removed selectively from the core 90*a* so that the core 90*a* is selectively exposed, and a clad lack part (i.e. a core exposed part) 90*c* can be used as a leaking portion from which light L1' can exit to an outside of the core 90*a* along its length.

In the leaky light guide 90A shown in FIG. 29A and FIG. 29B, the clad lack parts (core exposed parts) 90*c* having a ring shape are formed intermittently with a gap (d1) and a pitch (p1) along the length of the light guide 90A from a proximate end face to receive light L1 from the LED 10 to a distal end face, in which the gap (d1) and the pitch (p1) are made almost equal.

Instead, the gap (d1) and the pitch (p1) of the clad lack rings 90*c* in the linear (cylindrical) leaky light guide 90A may be changed from the proximate end face to the distal end face in order to adjust a light emitting side position and an amount of exiting light L1' and L1.

When the gap (d1) and/or the pitch (p1) of the clad lack rings 90*c* are increased from the proximate end face to the distal end face, a volume of the light L1' exiting from the clad lack rings 90*c* can be increased from a bottom to a top of the cylindrical light guide 90A.

Instead of the ring shaped clad lack parts 90*c*, a spiral clad lack part or a plurality of island shaped clad lack parts such as multiple dot like clad lack parts may be used.

A Modification of the Leaky Light Guide

Figure 30A:
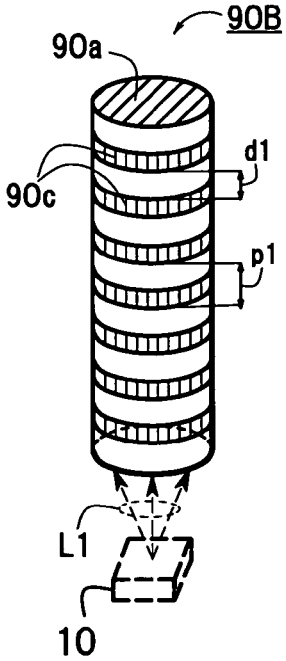
FIG. 30A is a schematic perspective view showing another leaky light guide 90B.
Figure 30B:
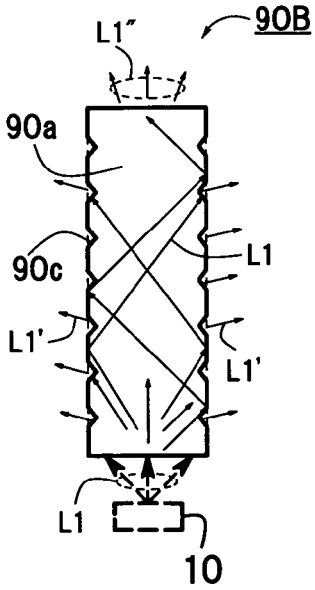
FIG. 30B is a schematic sectional view showing the leaky light guide 90B.

With reference to FIG. 30A and FIG. 30B, other leaky light guide 90B are described which is a modification of the leaky light guide 90A shown in FIG. 30A and FIG. 30B.

FIG. 30A is a schematic perspective view of a leaky light guide 90B. FIG. 30B is a schematic sectional view of the leaky light guide 90B.

As shown in FIG. 30A and FIG. 30B, a linear leaky light guide 90B is composed of a cylindrical core 91*a* and a plurality of ring like grooves 90*c* formed intermittently with a gap (d1) and a pitch (p1) along a side surface of the core 91*a*.

Different from the linear leaky light guide 90A, the linear leaky light guide 90B does not have a solid clad on the cylindrical optical core 91*a* in which an outer air with a refractive index lower than the core 91*a* is acting as an optical clad.

Other Modifications of a Linear Leaky Light Guide

Figure 31A:
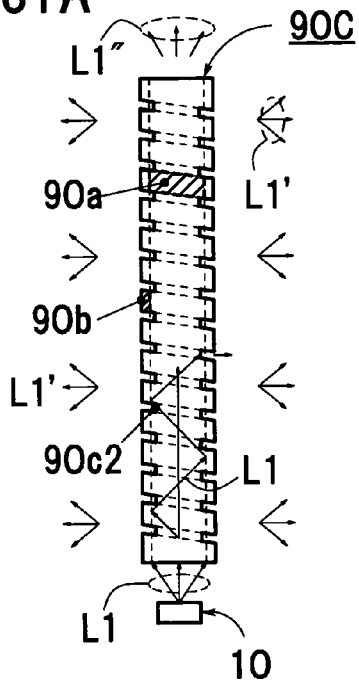
FIG. 31A is a schematic sectional view showing other leaky light guide 90C.
Figure 31B:
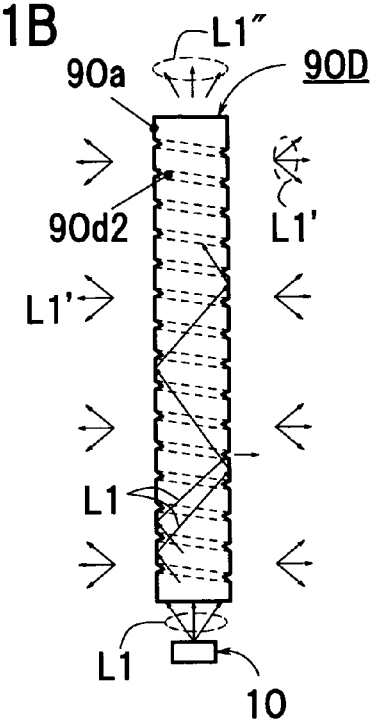
FIG. 31B is a schematic sectional view showing a still other leaky light guide 90D.

With reference to FIG. 31A and FIG. 31B, other linear leaky light guides 90C and 90D are described as follows.

FIG. 31A is a schematic sectional view of a linear leaky light guide 90C. FIG. 31B is a schematic sectional view of a linear leaky light guide 90D.

As shown in FIG. 31A, a linear leaky light guide 90C is a modification of the linear leaky light guide 90A shown in FIG. 29A and FIG. 29B, in which the linear leaky light guide 90C is composed of a linear rod like core 90*a*, a clad 90B covered on the core 90*a* having a refractive index lower than the core 90*a* and a clad lack part (I.e. a core exposed part) 90*c*2 which is a spiral groove formed continuously on the light guide 90C along the length.

As shown in FIG. 31B, a linear leaky light guide 90D is a modification of the linear leaky light guide 90B shown in FIG. 30A and FIG. 30B, in which the linear leaky light guide 90D is composed of a linear rod like core 90*a* and a spiral groove 90*d*2 formed continuously on the light guide 90D along the length.

As shown in FIG. 31 A and FIG. 31 B, UV or blue light L1 emitted from LED 10 is introduced into the linear leaky light guide 90C and 90D from a bottom end surface and the light L1 advances to go straight or reflect repeatedly based on the TIR within the core 90*a* to a top end surface Some volume of the light L1 exits gradually as leaked light L1' on a way of transmitting within the core 90*a* from the spiral groove 90*c*2 and 90*d*2 to the outside of the leaky light guide 90C and 90D.

When the rest volume of the light L1 reaches the top end surface of the core 90*a*, the light L1 exits there-from as light L1" to an outside of the light guide 90C and 90D.

Other Modification of a Linear Leaky Light Guide

Figure 32A:
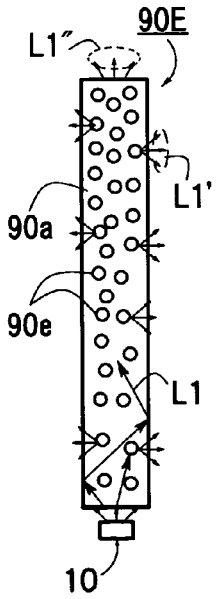
FIG. 32A is a schematic sectional view showing other leaky light guide 90E.
Figure 32B:
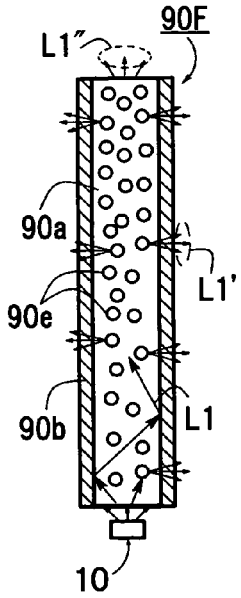
FIG. 32B is a schematic sectional view showing a still other leaky light guide 90F.

With reference to FIG. 32A and FIG. 32B, modification of a linear leaky light guide 90E and 90F are described as follows.

FIG. 32A is a schematic sectional view of a linear leaky light guide 90E. FIG. 32B is a schematic sectional view of a linear leaky light guide 90F.

As shown in FIG. 32B, a linear leaky light guide 90F is composed of a linear light guide core 90*a* and a clad 90*b* to cover a side surface of the core 90*a*, the clad 90*b* having a refractive index lower than the core 90*a*, in which a plurality of light scattering or diffusing elements (light direction changing elements) 90*e* contained in the core 90*a*.

The light scattering or diffusing elements (light direction changing elements) 90*e* may be composed of light diffusing particles having a refractive index different from the core 90*a* such as air bubbles, glass or polymer beads, reflective metal pieces such as aluminum or colorants such as white titanium oxide.

As shown in FIG. 32A and FIG. 32B, UV or blue light L1 emitted from LED 10 is introduced into the linear leaky light guide 90E and 90F from a bottom end surface and the light L1 advances to go straight or reflect repeatedly based on the TIR within the core 90*a* to a top end surface Some volume of the light L1 strikes upon the light diffusing elements (light direction changing elements) 90*e* on a way of transmitting within the core 90*a* so that the light diffusing elements 90*e* diffuses the light L1 non-directionally and exits from the side surface of the core 90*a* or the clad 90*b* to become leaked light L1'.

When rest volume of light L1 reaches a top surface of the light guide 90E and 90F, the light L1 exits from the top surface to become light L".

Other Modifications of a Linear Leaky Light Guide

With reference to FIG. 33A, FIG. 33B, FIG. 33C, FIG. 33D and FIG. 33E, other modification of linear leaky light guides 90G, 90H, 90J, 90K and 90L are described as follows FIG. 33A, FIG. 33B, FIG. 33C, FIG. 33D and FIG. 33E are schematic sectional views of linear leaky light guides 90G, 90H, 90J, 90K and 90L respectively, in which the linear leaky light guide 90G, 90H, 90J, 90K or 90L r is provided with a light direction changing means on a top end surface (distal end) 90G2, 90H2, 90J2, 90K2 and 90L2.

Figure 33A:
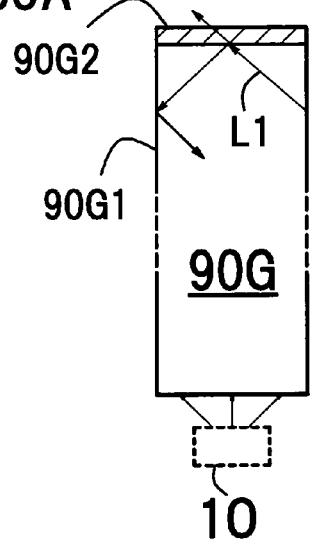
FIG. 33A, FIG. 33B, FIG. 33C, FIG. 33D and FIG. 33E are schematic sectional views of linear light guides 90G, 90H, 90J, 90K and 90L, respectively.

As shown in FIG. 33A, a linear leaky light guide 90G is composed of a linear leaky light guide (e.g. cylindrical leaky light guide) 90G1 which may be basically the same linear leaky light guide e.g. 90 as shown in e.g. FIG. 26-FIG. 28 and a mirror 90G2 (a total reflection mirror or a semi-transmission mirror) 90G2 formed on a top end surface (distal end) of the light guide 90G1.

In the linear leaky light guide 90G which has the semi transmission mirror 90G2, some volume light L1 which arrived at the top end surface is reflected back toward a bottom end surface and also the rest volume light L1 exits from the top end surface to outside.

Figure 33B:
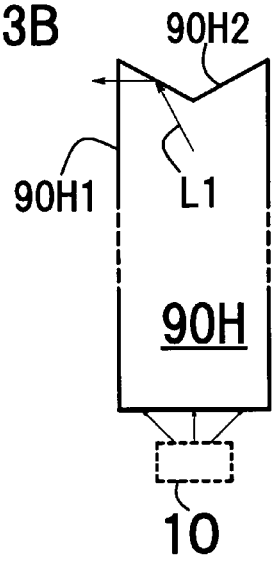

As shown in FIG. 33B, a linear leaky light guide 90H is composed of a linear leaky light guide (e.g. cylindrical leaky light guide) 90H1 basically the same linear leaky light guide e.g. 90 as shown in e.g. FIG. 26-FIG. 28 and a conic surface 90H2 with a conic cavity formed on a top end surface (distal end) of the light guide 90H2.

In the linear leaky light guide 90G which has the top end conic surface 90H2, light L1 which arrived at the top end conic surface 90H2 exits to outside so that a direction of the light L1 can be changed into a lateral direction at the top end conic surface 90H2.

Figure 33C:
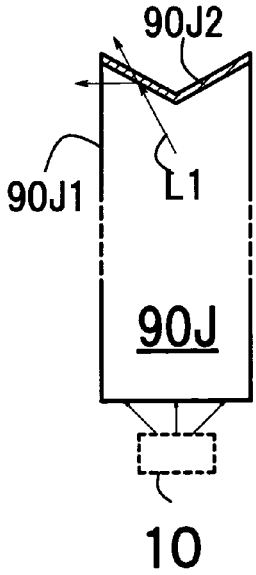

As shown in FIG. 33C, a linear leaky light guide 90J is composed of a linear leaky light guide (e.g. cylindrical leaky light guide) 90J1 basically the same linear leaky light guide e.g. 90 as shown in e.g. FIG. 26-FIG. 28, a conic surface with a conic cavity formed on a top end surface (distal end) of the light guide 90J1 and a conic half mirror 90J2 is formed on the conic surface.

In the linear leaky light guide 90J which has the conic half mirror 90J2, light L1 which arrived at the top end conic surface exits to outside so that a direction of a part of the light L1 can be reflected to change into a lateral direction at the conic half mirror 90J2 and the rest part of the light L1 can pass through the conic half mirror 90J2 to an upper direction.

Figure 33D:
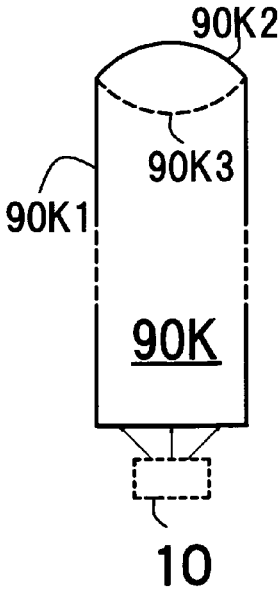

As shown in FIG. 33D, a linear leaky light guide 90K is composed of a linear leaky light guide (e.g. cylindrical leaky light guide) 90K1 basically the same linear leaky light guide e.g. 90 as shown in e.g. FIG. 26-FIG. 28 and a convex lens 90K2 (or a concave lens 90K3) formed on a top end surface (distal end) of the light guide 90K1.

Since the linear leaky light guide 90K has the convex lens 90K2 or the concave lens 90K3, light reached the top end surface can exits there-from to outside to be in a converged or diffused manner.

Figure 33E:
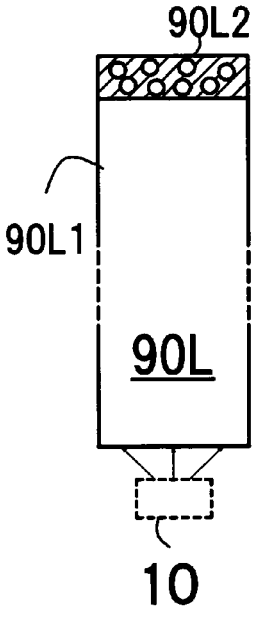

As shown in FIG. 33E, a linear leaky light guide 90L is composed of a linear leaky light guide (e.g. cylindrical leaky light guide) 90L1 basically the same linear leaky light guide e.g. 90 as shown in e.g. FIG. 26-FIG. 28 and a light diffusing layer 90L2 formed on a top end surface (distal end) of the light guide 90L1, in which the light diffusing layer 90L2 contains a plurality of diffusing elements.

Since the linear leaky light guide 90L has the light diffusing layer 90L2 on the top end surface, light reached the top end surface can exits non-directionally there-from to outside to be in a diffused manner.

Other Embodiment of the Invention: A Use of Light Spreading Ball Member

Other embodiment of the invention which uses a light spreading ball member is explained based on FIG. 34 to FIG. 36 and FIG. 37A to FIG. 37D.

FIG. 34 is a schematic exploded perspective view of a semiconductor lamp 140. FIG. 35 is a schematic perspective view of the semiconductor lamp 140. FIG. 36 is a schematic sectional view of the semiconductor lamp 140 cut along the line D-D' of FIG. 35. FIG. 37A, FIG. 37B, FIG. 37C and FIG. 37D are schematic sectional views of various examples of light spreading ball members 93A, 93B, 93C and 93D used for a semiconductor lamp 140.

As shown in FIG. 34 to FIG. 36, similarly to the above-mentioned embodiment shown in FIG. 26 to FIG. 28, a semiconductor lamp 140 of an embodiment of the invention is compost of at least one short wavelength type semiconductor light emitting element/elements (e.g. LED/LEDs) 10 which emit the short wavelength light (UV or blue light) L1, a light transmitting first globe segment 20-1 that has the first fluorescent protrusions 30-1 on its inner surface and a light transmitting second globe segment 20-2 that has the second fluorescent protrusions 30-2 on its inner surface, the first and second globe segments 20-1 and 20-2 being coupled together to form a single light transmitting combined globe.

As shown in FIG. 34 to FIG. 36, a linear light guide 92 (e.g. cylindrical light guide) having a top end surface and a bottom end surface and a light spreading ball member 93 are provided within an inner space of the combined globe (the first and second globe segments 20-1 and 20-2).

The light spreading ball member 93 is arranged on the top end surface of the cylindrical light guide 92 and a light unit (the LED/LEDs 10 and a printed circuit board 11) is arranged to face the bottom end surface of the cylindrical light guide 92.

The linear light guide 92 may be a non-leaky light guide which exits light from the top end surface without leaking the light from a side surface, instead the linear leaky light guide 90 shown in FIG. 26 to FIG. 28 which exits the light from the top end surface and exits to leak the light from the side surface may be used.

The light transmitting first globe segment 20-1 may have a hemispherical shaped dome and the light transmitting second globe segment 20-2 may have a reversed hemispherical shaped dome.

The light unit (LED 10 mounted printed circuit board 11) may be fixed to an upper surface of a funnel shaped housing 62 by a support member 95, in which a top of the housing 62 may be fixed to a bottom of the second globe segment 20-2.

The cylindrical light guide 92 is fixed on the support member 95 by a fixing member 96, the light guide 92 extends vertically from the bottom end surface to the top end surface and the light spreading ball member 93 is fixed on the top end surface.

A lighting circuit 40 which supplies a driving power to the LED/LEDs 10 can be housed in an inner cavity of the housing 62 with funnel shape or conical shape.

Further, a power supply connector 50 such as Edison type light bulb base is fixed at the bottom of the housing 62, thereby the light bulb type LED lamp 140 is presented which can be detached and attached to existing incandescent light bulb sockets, thereby it can replace a conventional incandescent light bulb.

Light L1 from the LED/LEDs 10 received at the bottom end surface (proximate end) of the cylindrical light guide 92 is transmitted to the top end surface (distal end), so that light L1' exits non-directionally in a radial manner from all spherical surface of the light spreading ball member 93 to irradiate substantially all inner surface areas of the globe (20-1 and 20-2) including the first and second fluorescent protrusions 30-1 and 30-2.

When the phosphor included in/on the fluorescent protrusions 30-1 and 30-2 absorbs short wavelength light L1' outgoing from the light spreading ball member 93, the phosphor is excited to change a wavelength of the light L1' to visible light L2-1 and L2-2 with a longer wavelength of the light L1', in which the visible light L2-1 and L2-2 passes through the first and second globe segments 20-1 and 20-2 to become a part of white illumination light.

If a combination of the blue LED 10 to emit blue light L1, L1' and the fluorescent protrusions 30-1 and 30-2 including yellow phosphor is used, some volume of the blue light L1' from the light spreading ball member 93 is absorbed in the fluorescent protrusions 30-1 and 30-2 to change into yellow light L2-1 and L2-2 and the rest volume of the blue light L1' is not absorbed in the phosphor, so that the yellow light (L2-1 and L2-2) and the blue light L1' exit from the globe 20-1 and 20-2 to become white illumination light mixed with yellow light (L2-1 and L2-2) and the blue light L1'.

If a combination of the ultraviolet (UV) LED 10 and three primary color phosphors contained in the fluorescent protrusions (30-1 and 30-2) and a fluorescent film in the area where the protrusions (30-1 and 30-2) do not exist is used, the short wavelength light L1' to exit from the light spreading ball member 93 is UV light L1' and the three primary color phosphors change the UV light L1' to white light (L2-1 and L2-2) mixed with the red, green and blue color lights, and thereby true white illumination light exits from the light transmitting globe (20-1 and 20-2) to an outer space.

Since almost all the UV light L1' can be absorbed in both of the fluorescent protrusions (90 and 90A) and the fluorescent film on the light transmitting globe (20-1 and 20-2) and the UV light L1' can be changed to white light (L2-1 and L2-2), a leakage of the UV lights L1' from the light transmitting globe (20-1 and 20-2) to the outer space can be ignored or minimized.

Some Examples of the Light Spreading Ball Member 93

FIG. 37A, FIG. 37B, FIG. 37C and FIG. 37D are schematic sectional views showing some examples of the light spreading ball member 93 (93A, 93B, 93C and 93D).

Figure 37A:
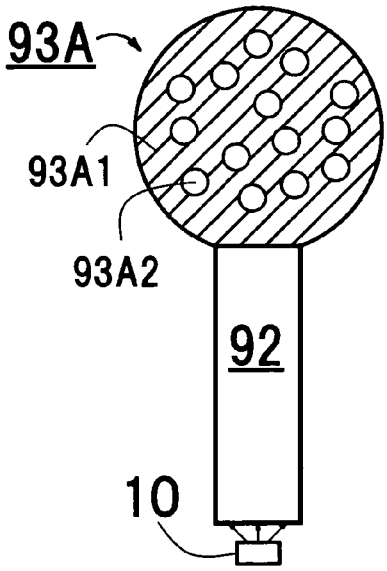
FIG. 37A, FIG. 37B, FIG. 37C and FIG. 37D are schematic sectional views of various examples of light spreading ball members 93A, 93B, 93C and 93D, respectively.

As shown in FIG. 37A, a light spreading ball member 93A is fixed to an top end surface (light emitting end) of a cylindrical light guide 92.

The light spreading ball member 93A is composed of a light transmitting ball member 93A1 having a substantially spherical light transmitting polymer or glass containing a plurality of light diffusing (or scattering) elements 93A2 therein, in which the light diffusing elements 93A2 are selected from light diffusing particles such as air bubbles, glass or polymer beads having a different refractive index than the spherical polymer or glass, light reflective pieces such as aluminum and white pigments such as titanium oxide.

Figure 37B:
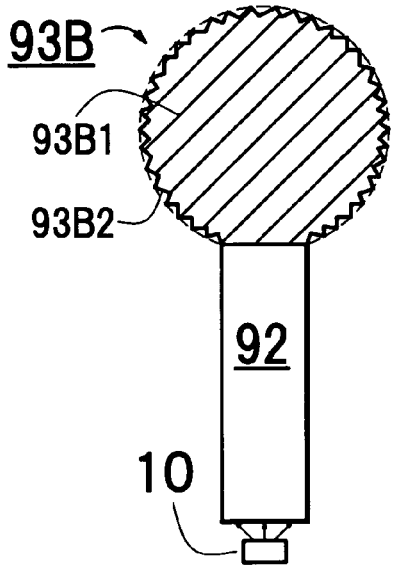

As shown in FIG. 37B, a light spreading ball member 93B is fixed to an top end surface (light emitting end) of a cylindrical light guide 92.

The light spreading ball member 93B is composed of a light transmitting spherical glass or polymer 93B1 and a plurality of concave-convex parts 93B2 such as a rough or multiple prism-like surface formed on a spherical surface of the spherical glass or polymer 93B1.

Figure 37C:
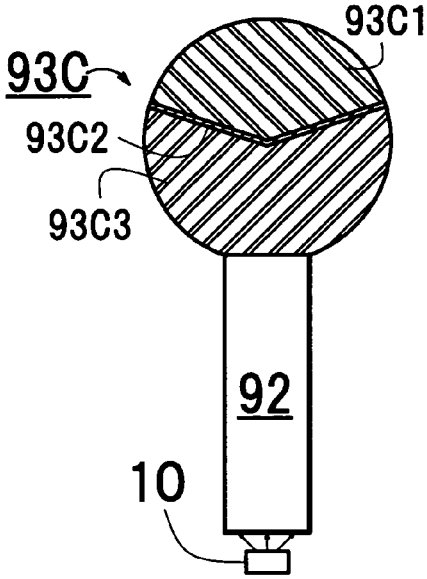

As shown in FIG. 37C, a light spreading ball member 93C is fixed to an top end surface (light emitting end) of a cylindrical light guide 92.

The light spreading ball member 93C is composed of a semi-spherical light transmitting reversed dome like member 93C3 having a conic cavity on that top, a semi-spherical light transmitting dome like member 93C1 formed on the conic cavity and a V shaped half mirror 93C2 is formed between the dome like member 93C1 and the reversed dome like member 93C3, in which these three members 93C1, 93C2 and 93C3 are unified to form a ball like member.

Figure 37D:
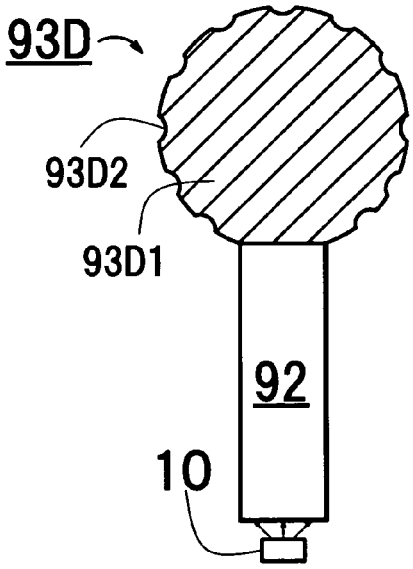

As shown in FIG. 37D, a light spreading ball member 93D is fixed to an top end surface (light emitting end) of a cylindrical light guide 92.

The light spreading ball member 93D is composed of a spherical light transmitting member 93D1 and a plurality of concave lenses 93D2 (or convex lenses) formed on a spherical surface of the spherical light transmitting member 93D1.

Other Embodiment of the Invention: A Curved Leaky Light Guide

Other embodiment of the invention which uses a curved leaky light guide is explained based on FIG. 38 to FIG. 40 as follows.

Figure 38:
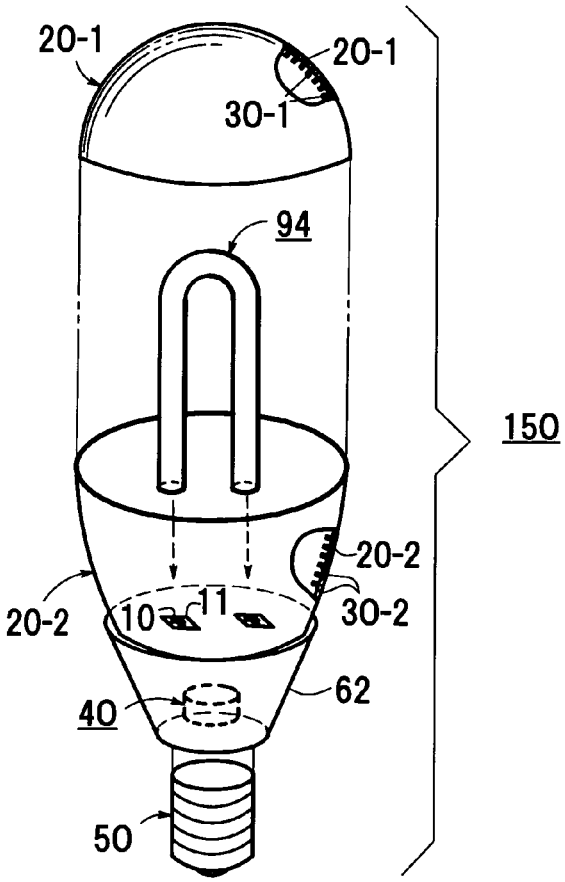
FIG. 38 is a schematic exploded perspective view of a semiconductor lamp 150.
Figure 39:
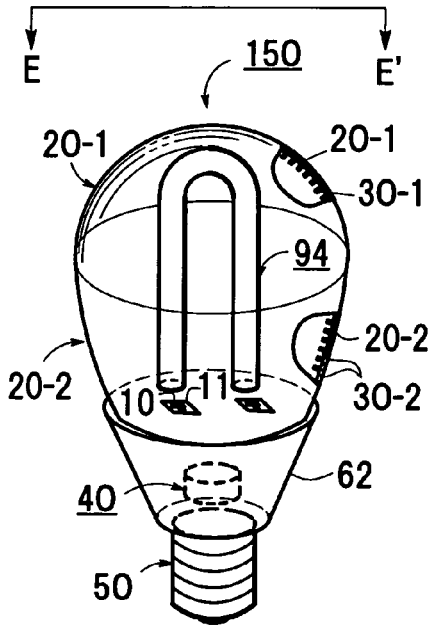
FIG. 39 is a schematic perspective view of the LED lamp 150.
Figure 40:
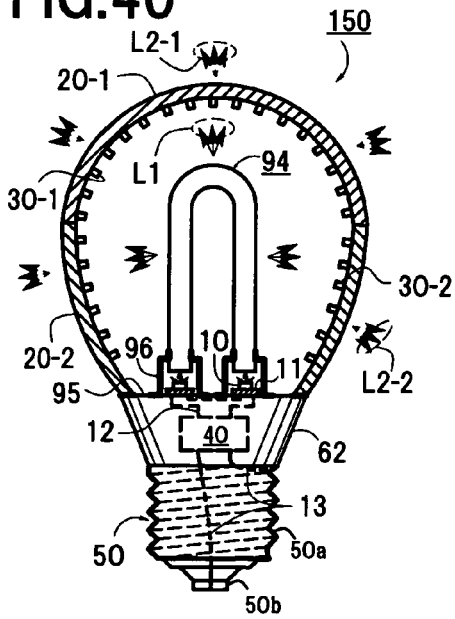
FIG. 40 is a schematic sectional view of the LED lamp 150.

In this embodiment referring to FIG. 38-FIG. 40, the description of the same or similar portions/parts as the above-mentioned embodiments is omitted as much as possible, in which the same reference numerals or marks are given to the same or similar portions/parts.

This embodiment referring to FIG. 38-FIG. 40 is a modification of the other embodiment referring to FIG. 26-FIG. 28, FIG. 29A, FIG. 29B, FIG. 30A, FIG. 30B, FIG. 31A, FIG. 31B, FIG. 32A, FIG. 32B, in which a LED lamp 150 in this embodiment is basically the same as the LED lamp 130 in the other embodiment.

FIG. 38 is a schematic exploded perspective view of a semiconductor lamp 150. FIG. 39 is a schematic perspective view of the semiconductor lamp 150. FIG. 40 is a schematic sectional view of the semiconductor lamp 150 cut along the line E-E' of FIG. 39.

As shown in FIG. 38 to FIG. 40, a semiconductor lamp 150 may be composed of a leaky light guide 94, at least one short wavelength type semiconductor light emitting element (LED/LEDs) 10 which emits blue or UV light which is located to face each end face of the curved leaky light guide 94, a light transmitting first globe segment 20-1 having first fluorescent protrusions 30-1 and a light transmitting second globe segment 20-2 having second fluorescent protrusions 30-24, in which the first and second globe segments 20-1 and 20-2 are coupled together to form a unified light transmitting globe.

As shown in FIG. 38 to FIG. 40, the leaky light guide 94 may be composed of a curved leaky light guide having a substantially "U" shaped curvature, in which the curved leaky light guide 94 has a reversed "U" or "C" shaped curved portion 94*c*, a pair of leg portions (94*a* and 94*b*) and a pair of light entrance end surfaces (94*a*' and 94*b*') to enter light from first and second LED/LEDs 10 mounted on first and second circuit boards 11.

The "U" shaped leaky light guide 94 may be fixed to a support member 95 at the light entrance ends (94*a*' and 94*b*') and the support member 95 is fixed to an upper portion of a funnel shaped housing 62 having a funnel shaped heat conductive shell 62 having an upper circular large opening and a lower circular small opening, in which each of the light entrance ends (94*a*' and 94*b*') receives light L1 from the first and second LED/LEDs 10.

The first and second globe segments 20-1 and 20-2 are coupled together to form a unified globe having an inner cavity to accommodate the first and second LED/LEDs 10 and the U shaped leaky light guide 94.

A lighting circuit 40 which supplies a driving power to the LED/LEDs 10 can be housed in the funnel shaped housing 62.

An electric power supply connector (i.e. lamp base) 50 e.g. Edison base for conventional electric light bulbs may be fixed to an lower part of the housing 60 so that the electric connector 50 can be attachable/detachable to external electric power supply sockets.

The "U" shaped leaky light guide 94 receives short wavelength light L1 from the first and second light receiving end faces 94*a*' and 94*b*', the light L1 entered within the light guide 94 leaks gradually during transmitting within the light guide 94 along the first and second leg portions 94*a* and 94*b* and the "U" shape curved portion 94*c*.

As shown in FIG. 40, the short wavelength light L1 to exit from the leg portions (94*a* and 94*b*) and the curved portion 94*c* irradiates all the fluorescent protrusions (30-1 and 30-2) and a fluorescent film formed on an inner surface of the first and second light transmitting globe segments 20-1 and 20-2.

In this embodiment, the "U" shaped leaky light guide 94 is used as a curved leaky light guide, instead another type of the curved leaky light guide such as a "M" shaped leaky light guide may be used.

Other Embodiment of the Invention: Use of a Reflector

Other embodiment of the invention is described based on FIG. 41 to FIG. 44.

In this embodiment referring to FIG. 41 to FIG. 44, the description of the same or similar portions/parts as the above-mentioned embodiments is omitted as much as possible, in which The same reference numerals or marks are given to the same or similar portions/parts.

Figure 41:
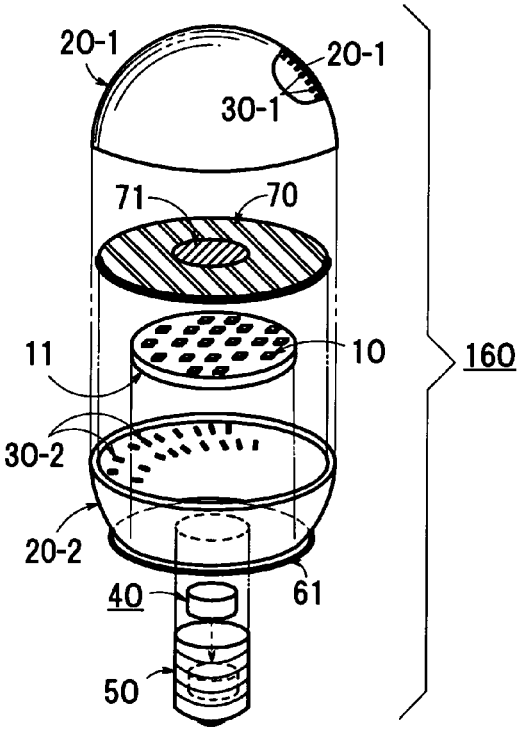
FIG. 41 is a schematic exploded perspective view of a semiconductor lamp 160.
Figure 42:
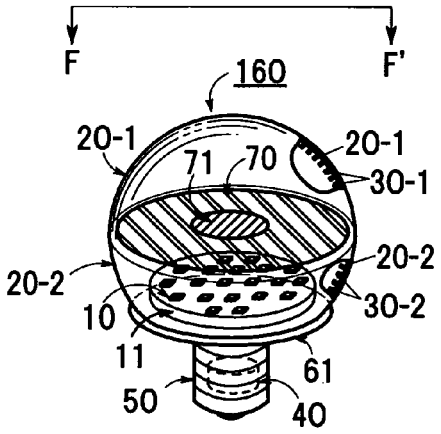
FIG. 42 is a schematic perspective view of the LED lamp 160.
Figure 43:
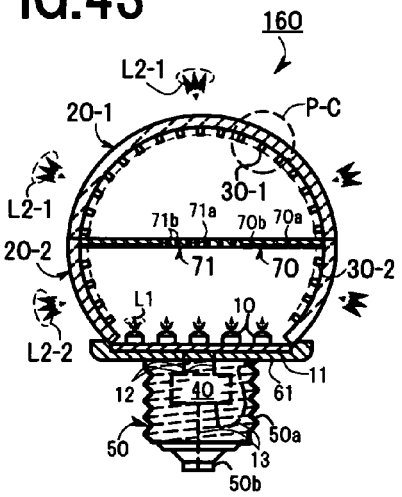
FIG. 43 is a schematic sectional view of the LED lamp 160.
Figure 44:
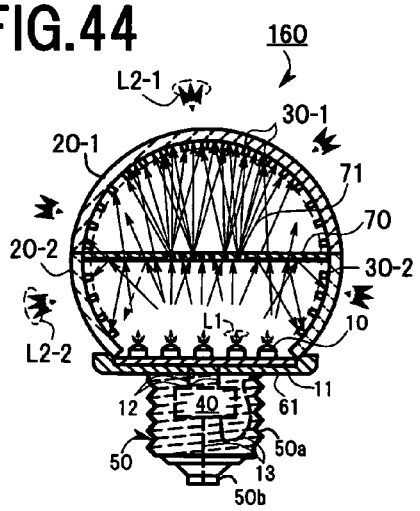
FIG. 44 is a schematic sectional view showing an optical path of the LED lamp 160.

FIG. 41 is a schematic exploded perspective view of a semiconductor lamp (LED lamp) 160. FIG. 42 is a schematic perspective view of the LED lamp 160. FIG. 43 is a schematic sectional view of the semiconductor lamp 160 cut along the line F-F' of FIG. 42. FIG. 44 is a schematic sectional view showing an optical path of the semiconductor lamp 160.

As shown in FIG. 41 to FIG. 44, a semiconductor lamp 160 is composed of a light unit having a printed circuit board 11 and plural short wavelength type LEDs 10 mounted on an upper surface of the printed circuit board 11), and light transmitting first and second globe segments 20-1 and 20-2 having first and second fluorescent protrusions 30-1 and 30-2 formed on an inner surface of the first and second globe segments 20-1 and 20-2.

A unified light transmitting globe is composed of the light transmitting first globe segment 20-1 having a dome shaped semi-spherical shell having a circular bottom opening and the light transmitting second globe segment 20-2 having a reversed dome shaped semi-spherical shell having a circular top large opening and a circular bottom small opening.

The first and second globe segments 20-1 and 20-2 are coupled to form the unified light transmitting globe having a substantially ball shape globe, a circular heat conductive support member 61 is fixed to a bottom of the second globe segment 20-2, the light unit with LEDs mounted printed circuit board 10 and 11 is mounted on a top surface of the support member 61.

As shown in FIG. 41 to FIG. 44, it is noted that the LED lamp 160 is further provided with a substantially disc-like reflector 70 housed at a middle position in a substantially spherical inner cavity of the globe 20-1 and 20-2, in which the disc-like reflector 70 is composed of a totally reflecting mirror or half reflecting mirror and the disc-like reflector 70 may have a circular center opening.

Further, a disk-like light diffusing member 71 may be fixed to the disc-like reflector 70 at the center opening, in which the disk-like light diffusing member 71 may be composed of a circular light transmitting plate and a plurality of light diffusing elements contained in the light transmitting plate.

As shown in FIG. 43, the totally reflecting or half reflecting reflector 70 is composed of a light transmitting disk 70*a* and a totally reflecting or half reflecting film 70*b* formed on the disk 70*a*, in which the totally reflecting or half reflecting film 70*b* may be a light reflective vacuum evaporation film such as aluminum, silver and gold.

A ratio of reflectivity and transmittance of the semi-reflecting mirror 70 may be freely adjusted by changing a thickness of the reflective film 70*b*.

Further, a conventional light bulb type base (power supply connector) 50 is fixed to a bottom of the support member 61, a lighting circuit 40 is accommodated in an inner cavity of the light bulb type base 50, so that all necessary parts is assembled to become the light bulb type semiconductor lamp 160 which can be detached and attached to well-known power supply sockets for use in electric light bulbs, thereby it can replace a conventional incandescent light bulb.

As shown as FIG. 44, the disk-like reflector 70 with the disk-like light diffusing member 71 is arranged in the inner cavity within the globe 20-1 and 20-2 in which the disk-like reflector 70 is positioned distant from the light unit (the LEDs 10 and the circuit board 11) to keep a predetermined distance to each other so that almost light L1 from the LEDs 10 spreads to irradiate the disk-like reflector 70 and the disk-like light diffusing member 71.

With reference to FIG. 44 to show an optical path (light path), the short wavelength light L1 from the LEDs 10 located near a center section of the circular printed circuit board 11 mainly irradiates the disc-like light diffusion member 71 and the light L1 from LED 10 located outside from the center section of the printed circuit board 11 mainly irradiates the disc-like reflector 70.

When the total reflection mirror is used as the disc-like reflector 70, the most short wavelength light L1 which reached the reflector 70 is reflected back to irradiate the second fluorescent protrusions 30-2 and the second fluorescent film formed on the inner surface of the light transmitting second globe segment 20-2, so that the light L1 which is absorbed in the second fluorescent protrusions 30-2 and the second fluorescent film is changed into visible light L2-2 by a wavelength conversion and the visible light L2-2 exits from the second globe segment 20-2 to become a part of illumination light L2-2.

When the semi-reflecting mirror (half mirror) is used for the reflector 70, some volume of the short wavelength light L1 which reached the disc-like half mirror 70 is reflected back to irradiate the second fluorescent protrusions 30-2 and the second fluorescent film, and the rest volume of the light L1 reached the disc-like reflector 70 passes through the disc-like half mirror 70 to irradiate the first fluorescent protrusions 30-1 and the first fluorescent film on the first globe segment 20-1, so that visible illumination light L2-1 exits from the first globe segment 20-1 and also visible illumination light L2-2 exits from the first globe segment 20-2.

When the short wavelength light L1 from the LEDs 10 located near the center section of the printed circuit board 11 reaches the disc-like light diffusion member 71, the light L1 is diffused mainly upwardly with a wide spread angle at the disc-like light diffusion member 71, so that the spread light L1 to pass the diffusion member 71 irradiates the first fluorescent protrusions 30-1 and the first fluorescent film on the first globe segment 20-1, thereby visible illumination light L2-1 exits from the first globe segment 20-1.

Other Embodiments of the Invention: Use of an LED Mounting Cubic Circuit Board As shown in FIG. 45 and FIG. 46, other embodiments of the invention use an LED mounting cubic circuit board.

Figure 45:
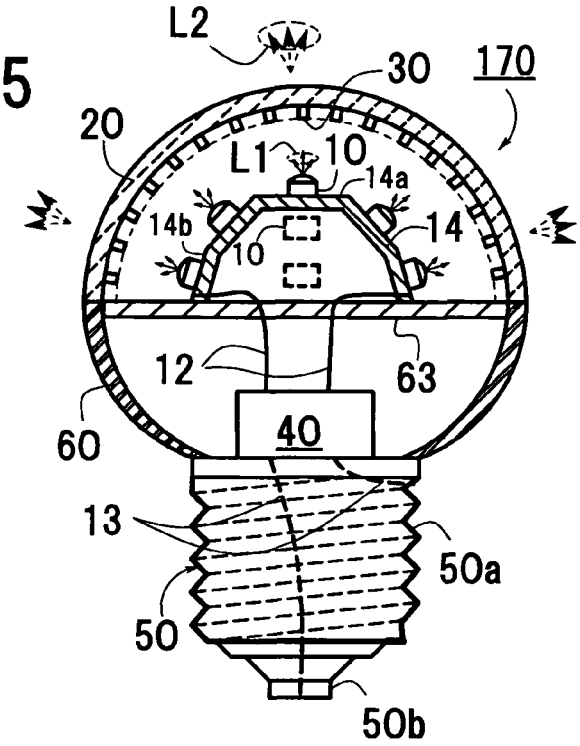
FIG. 45 is a schematic sectional view showing a semiconductor lamp 170.

FIG. 45 is a schematic sectional view showing a semiconductor lamp 170 which has an LED mounting cubic circuit board. FIG. 46 is a schematic sectional view showing other semiconductor lamp 180 which has an LED mounting cubic circuit board.

Figure 46:
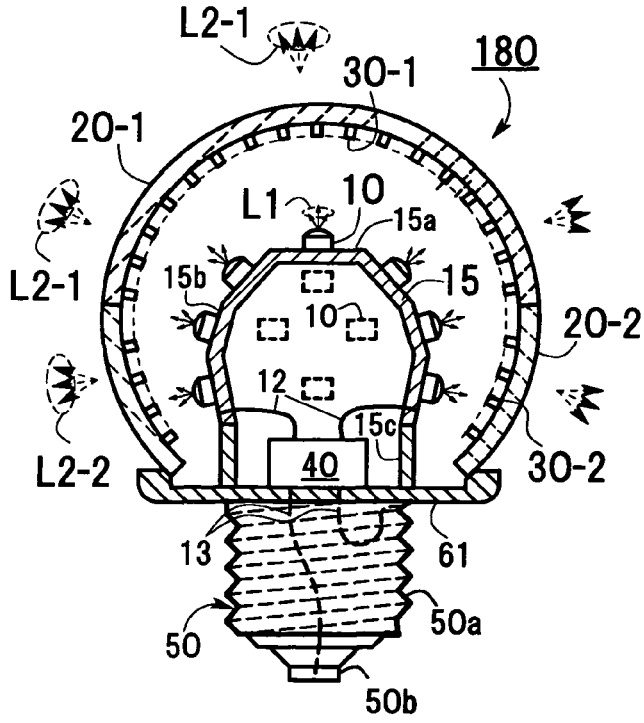
FIG. 46 is a schematic sectional view showing other semiconductor lamp 180.

In the description of the semiconductor lamps 160 and 170 shown in FIG. 45 and FIG. 46, the same description as various embodiments shown in FIG. 1 to FIG. 44 is omitted as much as possible. (The same reference numeral or mark is given to the same parts/portions.)

As shown in FIG. 45, a semiconductor lamp 170 is composed of a cubic printed circuit board 14, a plurality of LEDs 10 mounted on an upper surface of the cubic printed circuit board, a semi-spherical light transmitting globe 20 having a plurality of fluorescent protrusions 30 and a fluorescent film formed on that inner surface and a housing 60 having a reversed dome-like shell.

The cubic circuit board 14 is composed of a dome shaped printed circuit board which has at least one plane surface 14*a* to mount LED/LEDs 10 and plural inclined surface 14*b* to mount LED/LEDs 10.

The dome shaped cubic printed circuit board 14 is fixed on a heat conductive circular support 63 which is fixed to an inner surface of the globe 20 or the housing 60.

The dome-like light transmitting globe 20 and the reversed dome-like housing 60 is coupled together to form a spherical inner cavity, so that a light unit having the cubic printed circuit board 14 to mount the LEDs 10, the circular support 63 to support the cubic printed circuit board 14 and a lighting circuit 40 to drive the LEDs 10 are accommodated within the spherical inner cavity.

The semiconductor lamp 170 is further provided with light a bulb type power supply base 50 which is fixed to a bottom of the housing 60, thereby the semiconductor lamp 170 can be freely detached and attached to well-known light bulb type sockets, and it can replace a conventional incandescent light bulb.

Same as the fluorescent protrusions 30, 30-1 and 30-2 in the above-mentioned embodiments, the fluorescent protrusions 30 absorbs short wavelength light L1 from the LEDs 10 to change the light L1 into light L2 with visible light which exits from the dome-like globe 20.

In this semiconductor lamp 170, an interval between the LED mounting surface (14*a* and 14*b*) of the cubic printed circuit board 14 and the inner surface of the light transmitting globe 20 can be set up almost uniformly.

Therefore, the fluorescent protrusions 30 and the fluorescent film of the inner surface of the globe 20 can receive the short wavelength light L1 with almost uniform luminance in almost all areas.

Thereby, almost all the fluorescent protrusions 30 and fluorescent films can change short wavelength light L1 into visible light L2, so that visible illumination light L2 with uniform luminance can exit from almost all surface of the globe 20.

As shown in FIG. 46, a semiconductor lamp 180 is composed of a substantially spherical light transmitting globe (20-1 and 20-2) with a spherical inner cavity and a light unit accommodated in the spherical inner cavity, in which the light unit is composed of a cubic printed circuit board 15 and a plurality of LEDs 10 mounted on a surface of the circuit board 15.

The substantially spherical light transmitting globe (20-1 and 20-2) is composed of a light transmitting dome-like first globe segment 20-1 and a light transmitting reversed dome-like second globe segment 20-2 which are coupled together to form a unified ball-like envelope.

The first globe segment 20-1 and the second globe segment 20-2 have a plurality of first fluorescent protrusions 30-1 and a plurality of second fluorescent protrusions 30-2 on the inner surface respectively.

The cubic circuit board 15 is composed of a dome shaped printed circuit board which has at least one plane surface 15*a* to mount LED/LEDs 10 and plural inclined surface 15*b* to mount LED/LEDs 10.

The cubic printed circuit board 15 of dome shape has an extension 15*c* in the lower part and the extension 15*c* is fixed on a circular support member 6, in which the lighting circuit 40 is fixed on the support component 61.

The second globe segment 20-2 is fixed to the periphery of the support member 61 in a bottom of the segment 20-2.

The semiconductor lamp 180 is further composed of a lighting circuit 40 fixed on the support member 61 and a light bulb type power supply base 50 fixed to the support member 61, thereby a light bulb type semiconductor lamp 170 is proposed which can be freely detached and attached to a well-known light bulb type power supply socket.

Since this LED lamp 180 is provided with the substantially ball type envelope (20-1 and 20-2) having the protrusions (30-1 and 30-2) over almost all inner surface, the LED lamp 180 can exit illumination light L2-1 with upward and lateral directions and also illumination light L2-2 with downward and lateral directions, thereby super wide angle illumination (i.e. wide light distribution angle) is obtained.

Other Embodiment of the Invention: Use of a Conical Shape Reflector

Other embodiment of the invention is described based on FIG. 47 to FIG. 50 which uses a conical shape reflector.

In the description of a semiconductor lamps 190 in this embodiment referring to FIG. 47 to FIG. 50, the same description as the above-mentioned various embodiments is omitted as much as possible. (The same reference numeral or mark is given to the same parts/portions.)

Figure 47:
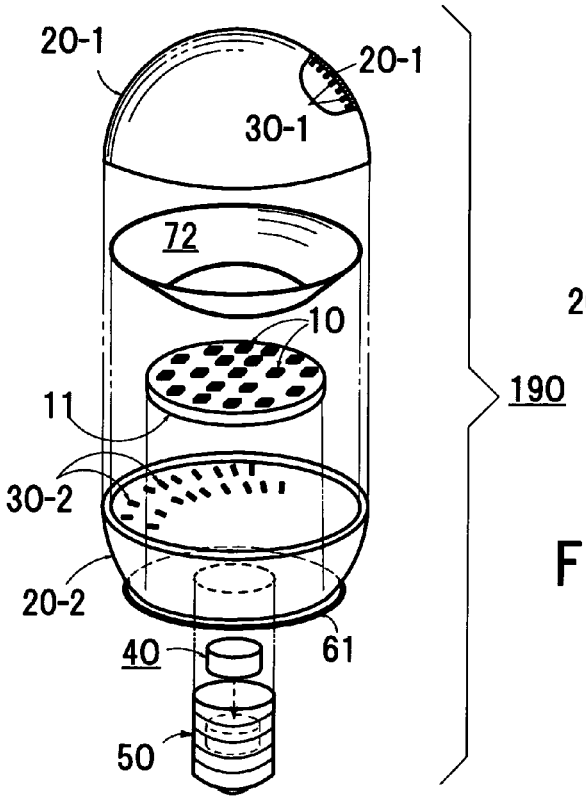
FIG. 47 is a schematic exploded perspective view of an LED lamp 190.
Figure 48:
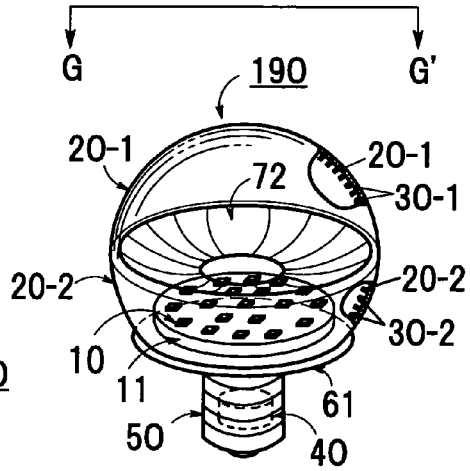
FIG. 48 is a schematic perspective view of the LED lamp 190.
Figure 50:
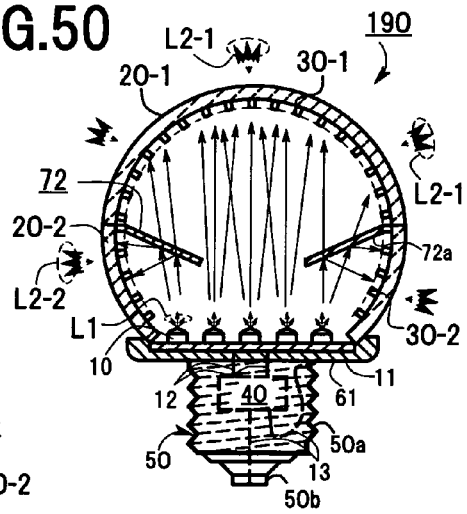
FIG. 50 is a schematic sectional view showing an optical path of the LED lamp 190.
Figure 49:
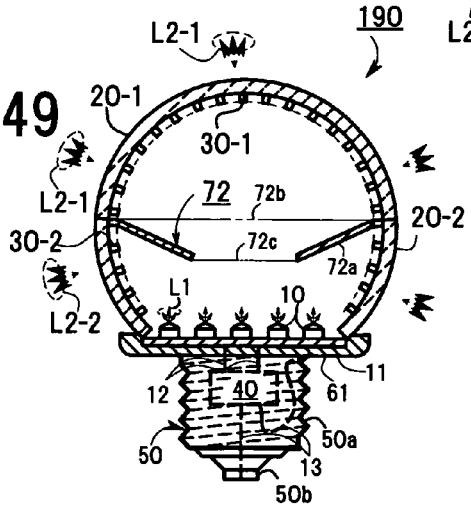
FIG. 49 is a schematic sectional view of the LED lamp 190.
Figure 51:
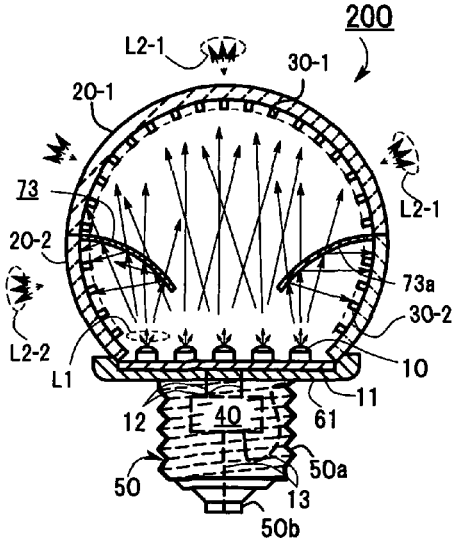
FIG. 51 is a schematic sectional view showing a semiconductor lamp 200.
Figure 52:
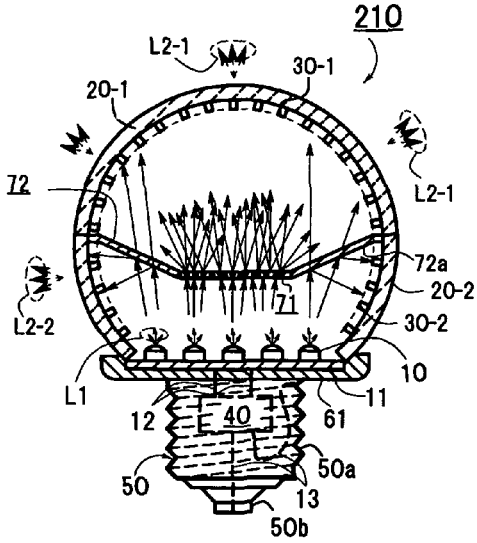
FIG. 52 is a schematic sectional view showing a semiconductor lamp 210.

FIG. 47 is a schematic exploded perspective view of an LED lamp 190. FIG. 48 is a schematic perspective view of the LED lamp 190. FIG. 49 is a schematic sectional view of the LED lamp 190 cut along the line G-G' of FIG. 48. FIG. 50 is a schematic sectional view showing an optical path of the LED lamp 190. FIG. 51 is a schematic sectional view showing a semiconductor lamp 200 which is a modification of the semiconductor lamp 190 shown in FIG. 47-FIG. 50. FIG. 52 is a schematic sectional view showing a semiconductor lamp 210 which is another modification of the semiconductor lamp 190 shown in FIG. 47-FIG. 50.

A semiconductor lamp 190 shown in FIG. 47-FIG. 50, a semiconductor lamp 200 shown in FIG. 51 or a semiconductor lamp 210 shown in FIG. 52 is composed of first and second light transmitting globe segments (20-1 and 20-2) coupled together to form a unified ball like envelope and a light unit accommodated in an inner cavity of the unified ball like envelope (20-1 and 20-2) having a printed circuit board 11 and LEDs 10 mounted on the circuit board 11.

The unified ball like envelope (20-1 and 20-2) is further composed of the dome-like shaped first globe segment 20-1 and the reversed dome-like shaped second globe segment 20-2, having first and second fluorescent protrusions 30-1 and 30-2 on first and second inner surfaces of the first and second segments (20-1 and 20-2).

As shown in FIG. 47-FIG. 50, the LED lamp 190 is further composed of a conic partially reflecting reflector 72 which is accommodated in a cavity of the globe (20-1 and 20-2).

As shown in FIG. 51, the LED lamp 200 is further composed of a conic partially reflecting reflector 73 which is accommodated in a cavity of the globe (20-1 and 20-2).

The conic partially reflecting reflector 72 or 73 is provided with a reflecting film 72*a* or 73*a* and a ratio of reflectivity and transmittance of the reflecting film 72*a* or 73*a* can be freely set up by adjusting a thickness of the reflecting film 72*a* or 73*a*.

The conic partially reflecting reflector 72 or 73 may be composed of a conic half mirror 72*a* or 73*a*, an upper circular opening 72*b* with a first diameter and a bottom circular opening 72*c* with a second diameter smaller than the first diameter.

As shown in FIG. 49 to FIG. 50, the conic partially reflecting reflector 72 in the LED lamp 190 is expanded linearly from the small second opening 72*c* to the large first opening 72*c* with a predetermined inclined angle.

As shown in FIG. 51, the conic partially reflecting reflector 73 in the LED lamp 200 (a modification of the LED lamp 190) is extended in a parabolic manner from the small second opening 72*c* to the large first opening 72*c*

As shown in FIG. 52, a LED lamp 210 is another modification of the LED lamp 190, in which the LED lamp 210 has the conic partially reflecting reflector 72*a*, 72 of the LED lamp 190 and a light diffusing disk 71 located in a second circular opening of the conic partially reflecting reflector 72*a*, 72.

Referring to FIG. 49, FIG. 50 and FIG. 51, short wavelength light L1 from the LEDs 10 located near a center section of the printed circuit board 11 advances mainly in a direction of the first globe segment 20-1 via the bottom small opening 72*c* of the conic reflector 72 or 73.

Referring to FIG. 52, short wavelength light L1 from the LEDs 10 located near a center section of the printed circuit board 11 is diffused at the light diffusing disk 71 located in the bottom small opening 72*c* of the conic reflector 72 or 73 and the light L1 advances mainly in a direction of the first globe segment 20-1.

The short wavelength light L1 irradiates first fluorescent protrusions 30-1 (and the first fluorescent film) formed on the inner surface of the first globe segment 20-1 so that visible illumination light L2-1 generates from the first fluorescent protrusions 30-1 (and the first fluorescent film) and the light L2-1 exits to an outer space via the first globe segment 20-1.

The short wavelength light L1 which reached the conic reflector 72 or 73 having the semi reflecting mirror (half mirror) 72*a* partially reflects at the reflector 72 or 73 and advances in the direction of a second globe segment 20-2, and the rest light L1 passes through the reflector 72 or 73 to advance in the direction of the first globe segment 20-1.

The short wavelength light L1 which advanced in the direction of the second globe segment 20-2 irradiates second fluorescent protrusions 30-2 (and second fluorescent film) formed in the inner surface of the second globe segment 20-2, so that visible illumination light L2-2 generates from the second fluorescent protrusions 30-2 (and the first fluorescent film) and the light L2-2 exits to an outer space via the second globe segment 20-2.

Other Embodiments of the Invention: Various Modifications in Use of Disc-Like Reflector Various modifications of the above-mentioned embodiments using the disc-like reflector based on FIG. 41 to FIG. 44 are described based on FIG. 53 to FIG. 59 as follows.

In the description of various semiconductor lamps shown in FIG. 53 to FIG. 59 below, the same description as the embodiment shown in FIG. 41 to FIG. 44 is omitted as much as possible. In these drawings, the same reference numerals or marks are given to the same parts/portions.

Figure 53:
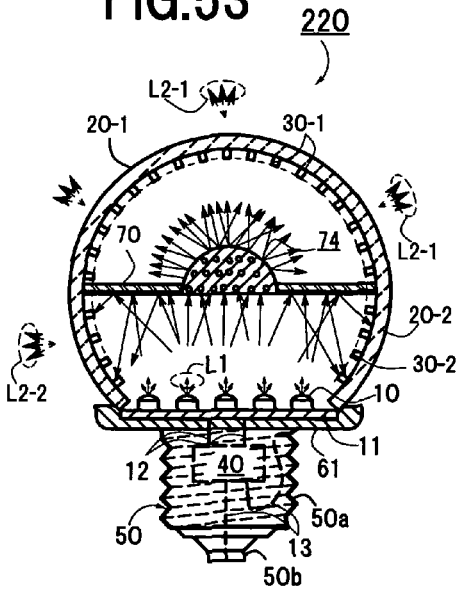
FIG. 53 is a schematic sectional view showing an LED lamp 220.
Figure 54:
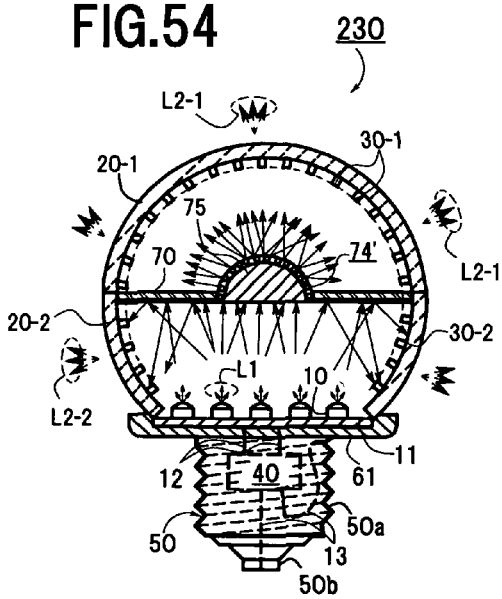
FIG. 54 is a schematic sectional view showing an LED lamp 230.
Figure 55:
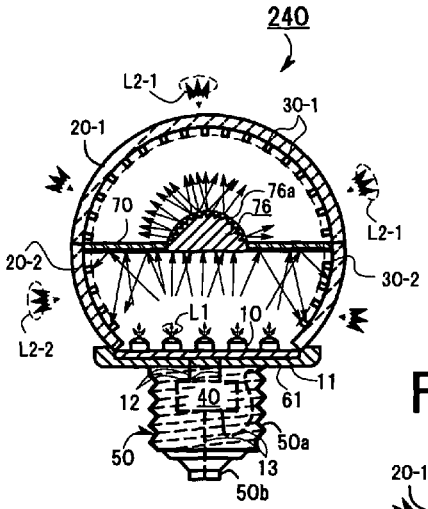
FIG. 55 is a schematic sectional view showing an LED 240.
Figure 56:
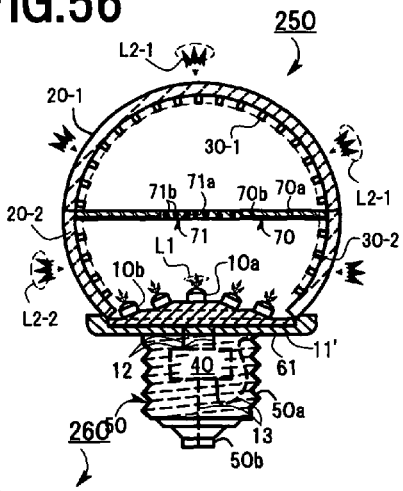
FIG. 56 is a schematic sectional view showing an LED 250.
Figure 57:
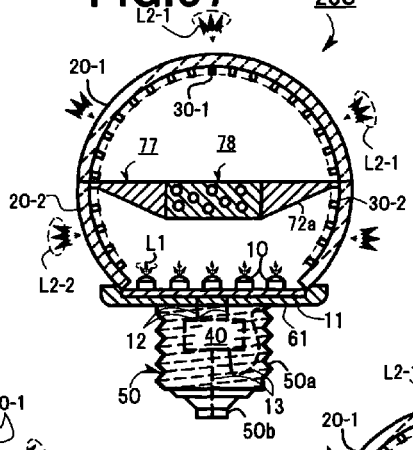
FIG. 57 is a schematic sectional view showing an LED lamp 260.
Figure 58:
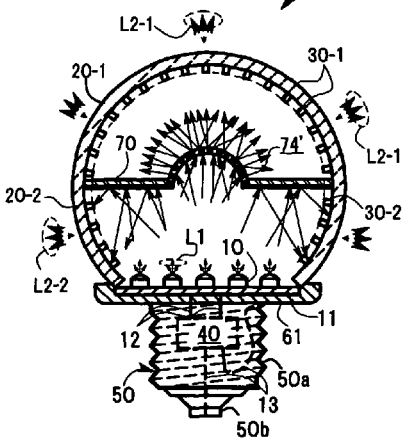
FIG. 58 is a schematic sectional view showing an LED lamp 270.
Figure 59:
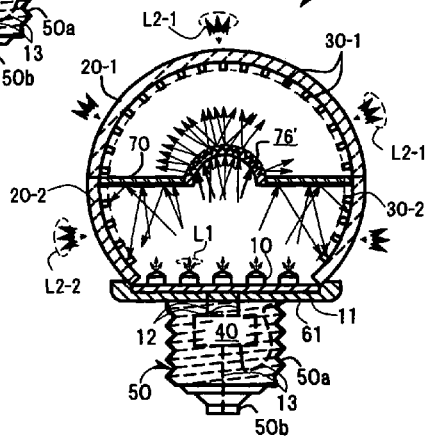
FIG. 59 is a schematic sectional view showing an LED lamp 280.

FIG. 53 is a schematic sectional view showing an LED lamp 220. FIG. 54 is a schematic sectional view showing an LED lamp 230. FIG. 55 is a schematic sectional view showing an LED 240. FIG. 56 is a schematic sectional view showing an LED 250. FIG. 57 is a schematic sectional view showing an LED lamp 260. FIG. 58 is a schematic sectional view showing an LED lamp 270. FIG. 59 is a schematic sectional view showing an LED lamp 280.

As shown in FIG. 53 to FIG. 59, an LED lamp 220, 230, 240, 250, 260, 270 or 280 is composed of a spherical envelope (10-1 and 10-2), a light unit (10 and 11) and a reflector 70, in which the light unit (10 and 11) and the reflector 70 are accommodated in an inner cavity of the spherical envelope (10-1 and 10-2), in which the spherical envelope is further composed of light transmitting first and second globe segments (20-1 and 20-2) having first and second fluorescent protrusions (30-1 and 30-2) on first and second inner surfaces and the light unit is further composed of a printed circuit board 11 (or 11') and LEDs 10 mounted on an upper surface of the circuit board 11 (or 11').

A circular support member 61 is provided so that the light unit (10 and 11/11') is fixed on the upper surface and a peripheral edge part of the support member 61 is fixed to a bottom of the second globe segment 20-2.

Referring to FIG. 53 to FIG. 59, similarly to FIG. 41 to FIG. 44, an LED lamp 220, 230, 240, 250, 260, 270 or 280 is provided with the disk-like reflector 70 (or a conic reflector 77) having a total reflecting or semi-reflecting surface is accommodated in the inner cavity of the substantially spherical (ball like) envelope (20-1 and 20-2).

The LED lamp 220, 230, 240, 250, 260, 270 or 280 shown in FIG. 53 to FIG. 59 is further provided with a light spreading member 71, 74, 74', 76, 76' or 78 arranged at a circular center opening of the reflector 70 or 77.

As shown in FIG. 53, the light spreading member 74 in the LED lamp 220 is a semi-spherical light diffusing member projected upwardly from the circular center opening of the disk-like reflector 70, which is composed of a semi-spherical transparent member and plural light diffusing elements contained to be mixed therein.

As shown in FIG. 54, the light spreading member 75 in the LED lamp 230 is a semi-spherical transparent member 75 projected upwardly from the circular center opening of the disk-like reflector 70, in which the semi-spherical transparent member 75 has a semi-spherical light diffusing layer 74' containing plural light diffusing elements on the top semi-spherical surface.

As shown in FIG. 55, the light spreading member 76 in the LED lamp 240 is a semi-spherical transparent member 76 projected upwardly from the circular center opening of the disk-like reflector 70, in which the semi-spherical transparent member 76 is a concavo-convex light diffusing part 76' formed on the semi-spherical surface having multiple rough surface or concavo-convex prism surface.

As shown in FIG. 56, the light spreading member 71 in the LED lamp 250 is the same member 71 as shown in FIG. 41 to FIG. 44, which is a dome-like light diffusing member 71 containing light diffusing elements 71*b* in a disk-like transparent member 71*a*.

As shown in FIG. 57, in the LED lamp 260 is provided with a reflector 77 having a reverse conical trapezoid prism having a cylindrical cavity in that center portion and a light spreading cylindrical member 78 containing light diffusing elements located in the cylindrical cavity As shown in FIG. 58, the light spreading member 74' in the LED lamp 270 is a semi-spherical diffusing member 75 projected upwardly from the circular center opening of the disk-like reflector 70, in which the semi-spherical diffusing member 75 is composed of a dome-like transparent member containing plural light diffusing elements therein.

As shown in FIG. 59, the light spreading member 76' in the LED lamp 280 is a semi-spherical diffusing member projected upwardly from the circular center opening of the disk-like reflector 70, in which the semi-spherical diffusing member 76' is composed of a dome-like transparent member having a concavo-convex surface such as a rough surface or a multiple prisms surface.

Other Embodiment of the Invention: Use of a Vertical Light Unit

Figure 60:
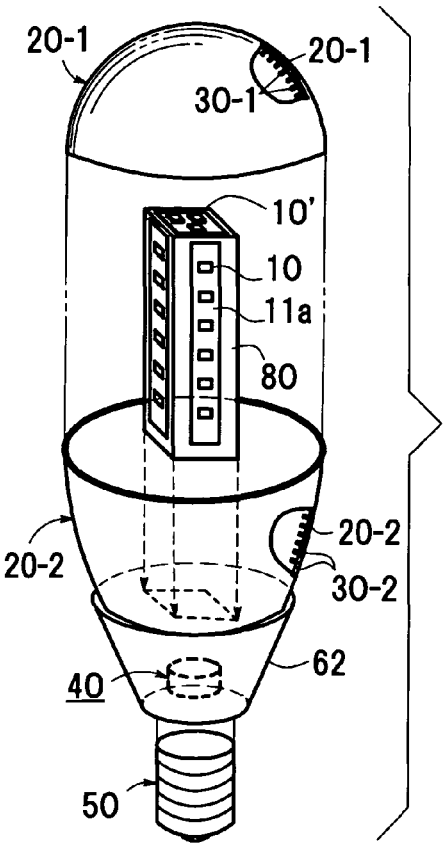
FIG. 60 is a schematic exploded perspective view of an LED lamp 290.
Figure 61:
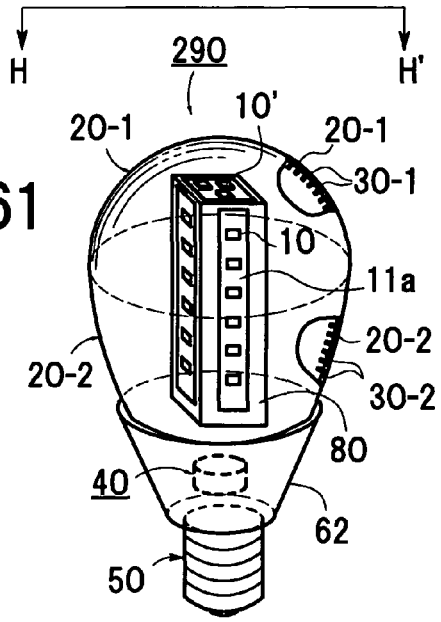
FIG. 61 is a schematic perspective view of the LED lamp 290.
Figure 62:
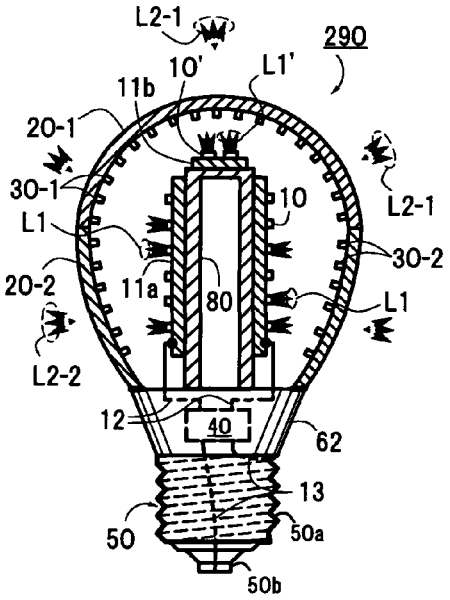
FIG. 62 is a schematic sectional view of an LED lamp 290.

Other embodiment of the invention to use a vertical light unit is explained based on FIG. 60 to FIG. 62.

In this embodiment, a description of the same part/portions as the above-mentioned various embodiments is omitted as much as possible. (Same reference numeral or mark is given to the same part/portions.)

FIG. 60 is a schematic exploded perspective view of an LED lamp 290. FIG. 61 is a schematic perspective view of the LED lamp 290. FIG. 62 is a schematic sectional view of an LED lamp 290 cut along the line H-H' of FIG. 61.

As shown in FIG. 60 to FIG. 62, similarly to some above-mentioned embodiments, an LED lamp 290 in an embodiment of the invention may be composed of a light transmitting envelope having an inner cavity and a light unit having one or more printed circuit boards 11*a* and LEDs (10,10') mounted thereon, in which the light unit (11*a* and 10/10') is accommodated in the inner cavity and the light transmitting envelope is composed of first and second globe segments (20-1 and 20-2) having first and second fluorescent protrusions (30-1 and 30-2) formed on first and second inner surfaces of the envelope.

As shown in FIG. 60 to FIG. 62, the vertical light unit is further composed of a polygonal supporting post 80 having side surfaces, in which first printed circuit boards 11*a* to mount first LEDs 10 are fixed on the side surfaces.

The polygonal supporting post 80 has preferably a top surface, in which a second printed circuit board 11*b* to mount second LED/LEDs 10' is fixed on the top surface.

In this embodiment, the polygonal supporting post 80 may be composed of a thermally conductive hollow pole having multiple side surfaces to support the LEDs mounted circuit boards (10 and 11*a*) and instead of the hollow pole, a thermally conductive solid pole may be used.

The vertical light unit having the supporting post 80, the circuit boards 11*a*, 11*b* and the LEDs 10, 10' is fixed to an upper part of a housing 62 with a funnel shape at a bottom of the vertical light unit and the vertical light unit is arranged to extend vertically in the inner cavity of the globe (20-1 and 20-2).

The housing 62 accommodates a lighting circuit 40 to drive the LEDs 10, 10' in that inner cavity and a light bulb type power supply base 50 is fixed to a bottom of the housing 62, so that the light bulb type LED lamp 290 is capable of attaching and detaching to conventional external power supply sockets for incandescent light bulbs.

The short wavelength light L1 emitted from the first LEDs 10 mounted on the circuit board 11*a* advances mainly in a lateral direction and can irradiate almost all the fluorescent protrusions 30-1 and 30-2 except the protrusions in an top area, which are formed in the first and second light transmitting globes 20-1 and 20-2.

The short wavelength light L1 emitted from the second LED/LEDs 10' mounted on the circuit board 11*b* advances mainly in an upper direction to irradiate almost all the fluorescent protrusions 30-1 and 30-2 in the top area.

Referring to FIG. 68A, FIG. 68B, FIG. 68C and FIG. 68D, various kinds of supporting posts to mount LEDs are described as follows.

FIG. 68A, FIG. 68B, FIG. 68C and FIG. 68D are schematic plane views of the supporting posts 80, 80-1, 80-2, 80-3 and 80-4 shown in FIG. 60 to FIG. 62.

Figure 68A:
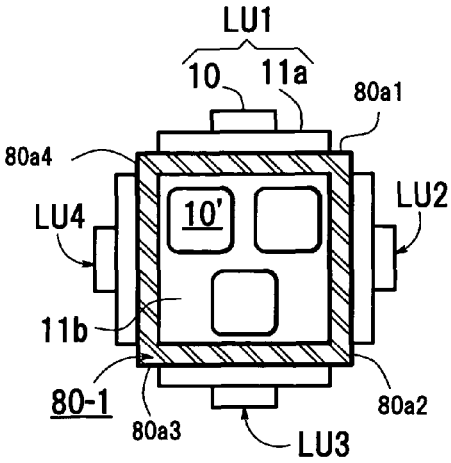
FIG. 68A, FIG. 68B, FIG. 68C and FIG. 68D are schematic plane views of the supporting posts 80, 80-1, 80-2, 80-3 and 80-4.
Figure 68C:
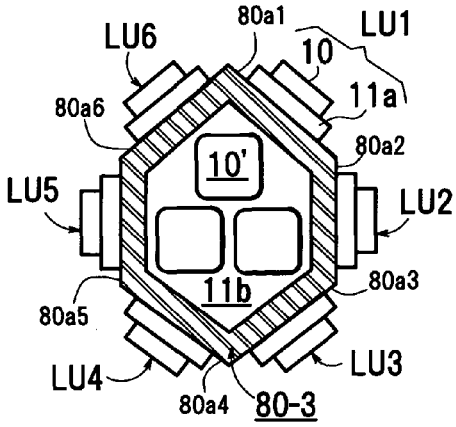

As shown in FIG. 68A, the supporting posts 80-1 (80) is composed of a square hollow or solid pole having four vertical mounting side surfaces 80*a*1, 80*a*2, 80*a*3 and 80*a*4 and one horizontal top surface.

Light units LU1, LU2, LU3 and LU4 each having a printed circuit board 11*a* to mount LEDs 10 are fixed on the vertical mounting side surfaces 80*a*1, 80*a*2, 80*a*3 and 80*a*4, and one light unit having a printed circuit board 11*b* to mount LEDs 10' is fixed on the horizontal mounting top surface.

Figure 68B:
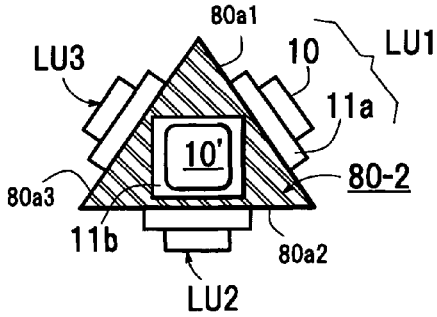

FIG. 68B is a schematic plane view showing a supporting post 80-2 which is composed of a triangular hollow or solid pole having three vertical mounting side surfaces 80*a*1, 80*a*2 and 80*a*3 and one horizontal top surface.

The triangular supporting post 80-2 is provided with three vertical mounting side surfaces 80*a*1, 80*a*2 and 80*a*3, and one top mounting surface.

Light units LU1, LU2 and LU3 each having a printed circuit board 11*a* to mount LEDs 10 are fixed on the vertical mounting side surfaces 80*a*1, 80*a*2, 80*a*3 and 80*a*4, and one light unit having a printed circuit board 11*b* to mount LEDs 10' is fixed on the horizontal mounting top surface.

FIG. 68 C is a schematic plane 80-3 view showing a supporting post 80-3 having a pentagonal hollow or solid pole which is provided with five vertical mounting surfaces 80*a*1, 80*a*2, 80*a*3, 80*a*4 and 80*a*5 and one horizontal mounting top surface.

Light units LU1, LU2, LU3, LU4 and LU5 each having a printed circuit board 11*a* to mount LEDs 10 are fixed on the vertical mounting side surfaces 80*a*1, 80*a*2, 80*a*3, 80*a*4 and 80*a*5, and one light unit having a printed circuit board 11*b* to mount LEDs 10' is fixed on the horizontal mounting top surface.

Figure 68D:
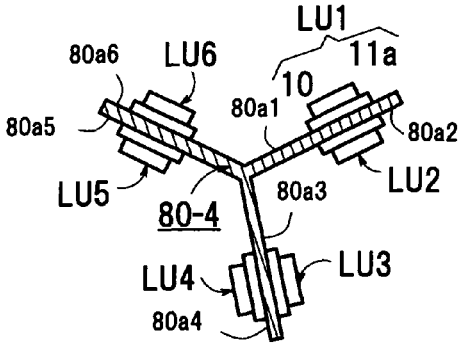

FIG. 68D is a schematic plane view showing a wing like supporting post 80-4 having a "Y" shape plane view, which is composed of three wing plates and six vertical mounting surfaces 80*a*1, 80*a*2, 80*a*3, 80*a*4, 80*a*5 and 80*a*6, on which six light units LU2, LU3, LU4, LU5, and LU6 are fixed, each light unit having a printed circuit board 11*a* and LEDs 10 mounted thereon.

Other Embodiment of the Invention: Use of Dual Sides Emitting Light Unit

Figure 63:
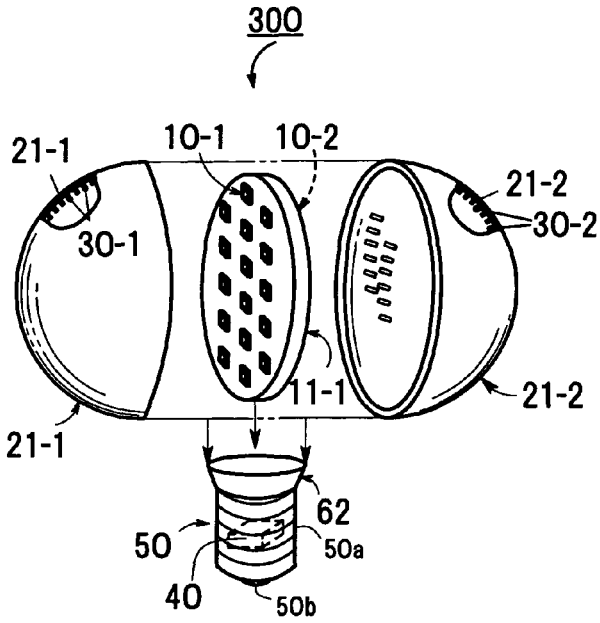
FIG. 63 is a schematic exploded perspective view of an LED lamp 300.
Figure 64:
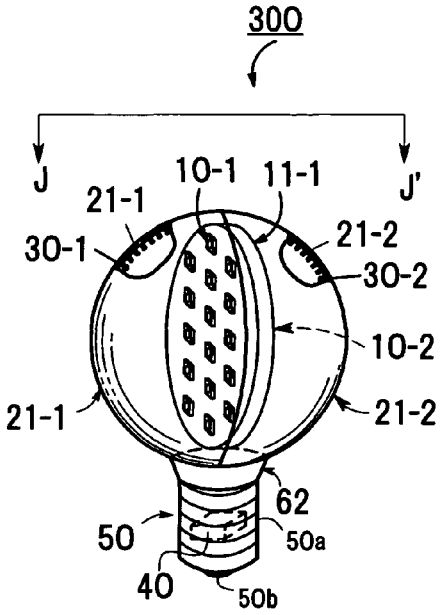
FIG. 64 is a schematic perspective view of the LED lamp 300.
Figure 65:
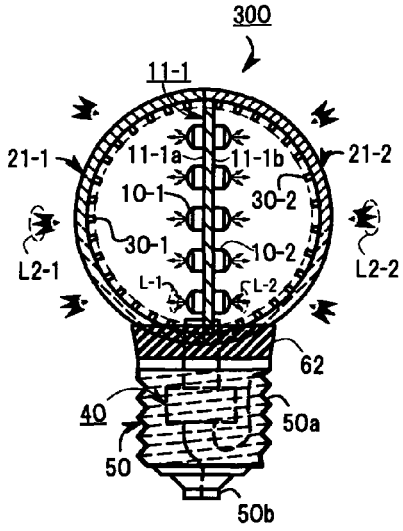
FIG. 65 is a schematic sectional view of the LED lamp 300.

Other embodiment of the invention which uses a dual sides emitting light unit is described based on FIG. 63 to FIG. 65.

In this embodiment, a description of the same part/portion as the various embodiments of the invention described hereinbefore is omitted as much as possible. (The same reference numeral or mark is given to the same part/portion.)

FIG. 63 is a schematic exploded perspective view of an LED lamp 300 showing other embodiment. FIG. 64 is a schematic perspective view of the LED lamp 300. FIG. 65 is a schematic sectional view of the LED lamp 300 cut along the line J-J' of FIG. 64.

As shown in FIG. 63 to FIG. 65, an LED lamp 300 is composed of a spherical light transmitting envelope (21-1 and 21-2) having a spherical inner cavity and a dual sides emitting light unit (11-1 and 10-1/10-2) accommodated in the spherical inner cavity.

The envelope (21-1 and 21-2) is composed of first and second semi-spherical transparent globe segments (21-1 and 21-2) coupled together to form a spherical globe and first and second fluorescent protrusions (30-1 and 30-2) and fluorescent layer formed on first and second inner surfaces of the globe segments (21-1 and 21-2).

Referring to FIG. 65, the dual sides emitting light unit (11-1 and 10-1/10-2) may be composed of a spherical both sided circular printed circuit board 11-1 having both mounting surfaces (11-1*a* and 11-1*b*) and first and second LEDs (10*a* and 10*b*) to emit short wavelength light (L-1 and L-2) mounted on the both mounting surfaces (11-1*a* and 11-1*b*), in which the circular printed circuit board 11-1 is located vertically within the spherical envelope (the left globe segment 21-1 and the right globe segment 21-2) and the first and second LEDs (10-1 and 10-2) are mounted on the left and right mounting surfaces (11-1*a* and 11-1*b*) respectively.

A support member 62 may be provided between a bottom portion of the unified spherical globe (20-1 and 20-2) and an upper portion of a power supply base 50 for conventional electric light bulbs, in which a lighting circuit 40 to control a lighting of the light unit (11-1, 10-1 and 10-2) may be provided in a inner cavity of the power supply base 50.

The electric light bulb type LED lamp 300 as shown in FIG. 63-FIG. 65 can be easily attached or detached to the conventional power supply socket for conventional electric light bulbs.

The first and second LEDs 10-1/10-2 mounted in the left and right surfaces 11-1*a*/11*b* of the both sided printed circuit board 11-1 of the light unit emit short wavelength light L1-1/L1-2 to irradiate the first and second protrusions 30-1/30-2 and the first and second fluorescent films formed on the first and second inner surfaces of the first and second globe segments 21-1/21-2.

Thereby, the first and second fluorescent protrusions 30-1/30-2 and the first and second fluorescent films change a first wavelength of a part of the short wavelength light L1-1/L1-2 into visible light L2-1/L2-2 with a second wavelength longer than the first wavelength, and visible light L2-1/L2-2 exits from the first and second globe segment 20-1/20-2 to left and right outer spaces respectively.

Light Collector

Figure 66:
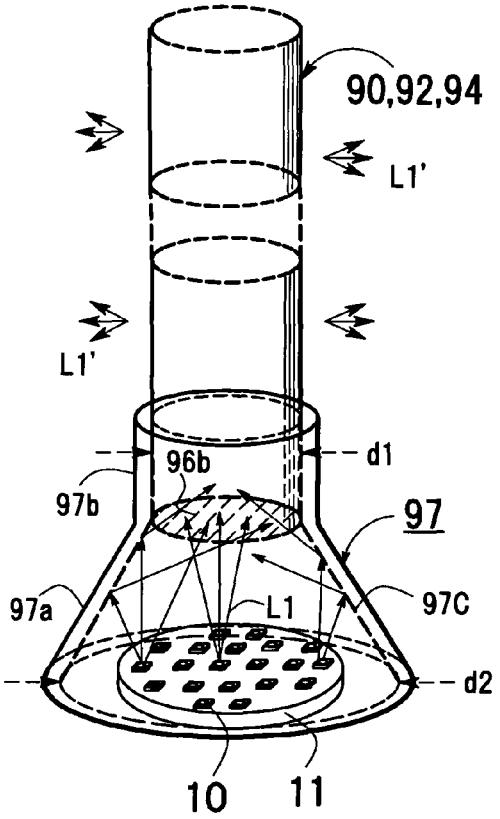
FIG. 66 is a schematic perspective view showing a light collector 97.
Figure 67:
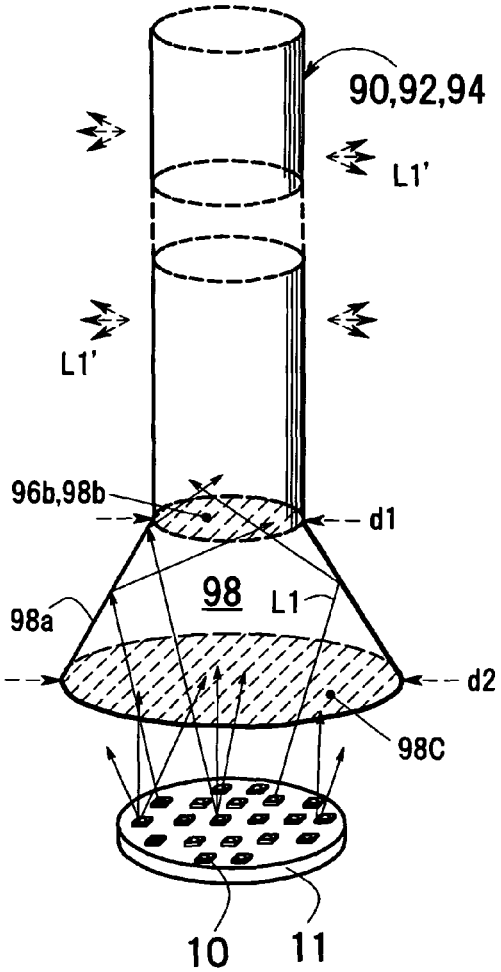
FIG. 67 is a schematic perspective view showing another light collector 98.

FIG. 66 and FIG. 67 show light collectors 97 and 98 for collecting light L1 from a light unit having the LED/LEDs 10 and the printed circuit board 11 to the leaky light guides 90, 92 and 93 in the LED lamps 130, 140 and 150 described hereinbefore.

FIG. 66 is a schematic perspective view showing a light collector 97. FIG. 67 is a schematic perspective view showing other light collector 98.

As shown in FIG. 66, the light collector 97 is composed of a substantially conic or funnel like hollow light guide 97*a* having an inclined inner surface 97*c*, a large circular opening with a large inner diameter d2, a small circular opening with a small inner diameter d1 and a circular pipe 97*b* extended from the small circular opening.

The light unit (the LEDs 10 mounted on the printed circuit board 11) is preferably located near the large opening with the diameter d1 of the funnel shaped light guide member 97*a*.

The cylindrical leaky light guide 90, 92 and 94A is supported on the light collector 97 with the funnel shaped hollow light guide in such a way that the light receiving end face 96*b* of the leaky cylindrical light guide 90, 92 and 94 is inserted into the circular pipe 97*b*.

The funnel shaped hollow light collector 97 and the printed circuit board 11 with LEDs 10 are located on the top surface of the housing 62 (see FIG. 26, FIG. 34, FIG. 38).

A part of light L1 from the LEDs 10 enters directly into the light receiving end face of the leaky light guide 90, 92 and 94, the remainder of light L1 reflects one or more times the inclined inner surface 97*c* with a light reflecting surface, and almost all the light L1 from the LEDs 10 can enter into the light receiving end face.

As shown in FIG. 67, other light collector 98 is a conic solid light guide 98 having an inclined surface 98*a*, a large circular light receiving end face 98*c* having a diameter d2 and a small circular light exit end face 98*b* having a diameter d1.

The light unit (the LEDs 10 mounted on the printed circuit board 11) is preferably located near the large circular light receiving end face 98*c* of the conic solid light collector 98.

The small circular light exit end face 98*b* of the conic solid light collector 98 is preferably coupled to a light receiving end 96*b* of the leaky cylindrical light guide 90, 92, 94.

Other Embodiment of the Invention: Use of a Dual Sides Emitting Light Unit

Other embodiment of the invention which uses a dual sides emitting light unit is described based on FIG. 69 to FIG. 71.

In this embodiment, a description of the same part/portion as described in the various embodiments hereinbefore is omitted as much as possible. (The same reference numeral or mark is given to the same part/portion.)

FIG. 69 is a schematic exploded perspective view of a semiconductor lamp 310. FIG. 70 is a schematic perspective view of the semiconductor lamp 310. FIG. 71 is a schematic sectional view of the semiconductor lamp 310.

As shown in FIG. 69 to FIG. 71, an LED lamp 310 is composed of a light transmitting envelope (20-1 and 20'-2) having an inner cavity and a dual sides emitting light unit (11-1 and 10-1/10-2) accommodated in the inner cavity.

The envelope (20-1 and 20'-2) is composed of a conventional light bulb shaped globe having a first semi-spherical transparent globe segment 20-1 and a second funnel shaped transparent globe segment 20'-2 coupled together and first and second fluorescent protrusions (30-1 and 30-2) and fluorescent layers formed on first and second inner surfaces of the globe segments (20-1 and 20'-2).

The dual sides emitting light unit is composed of a circular dual sides printed circuit board 11-1 and first and second LEDs 10-1 and 10-2 mounted on the upper and under surfaces.

The both sided printed circuit board 11-1 with the upper and under LEDs 10-1 and 10-2 is accommodated in an inner cavity of the upper and under globe segments 20-1 and 20'-2, in which the circular printed circuit board 11-1 is located near a middle position of the inner cavity.

A conic reflector 63 is preferably provided in a bottom of the under globe segment 20'-2.

The conventional light bulb shaped envelope (20-1 and 20'-2) is fixed on a support member 62 at the bottom the under globe segment 20'-2, a power supply base 50 with a cavity is fixed to the support member 62 and a lighting circuit 40 is housed in an inner cavity of the power supply base 50.

An output DC power of the lighting circuit 40 is supplied to the LEDs 10-1 and 10-2 mounted on the both sided printed circuit board 11-1 via electric wires 12 and 12'.

The first LEDs 10-1 mounted on the upper surface of the both sided printed circuit board 11-1 emits short wavelength light L1 upwardly to irradiate the upper fluorescent protrusions 30-1 on the dome like upper globe segment 20-1 and the LEDs 10-2 mounted on the under surface of the both sided printed circuit board 11-1 emits short wavelength light L1 downwardly to irradiate the under fluorescent protrusions 30-2 on the funnel like under globe segment 20'-2.

The upper and under fluorescent protrusions 30-1 and 30-2 convert a first wavelength light L1 into visible light L2 with a second wavelength longer than the first wavelength and the visible light L2 exits from the upper and under globe segments 20-1 and 20'-2 to an outer space for a use in illumination, thereby the LED lamp 310 can illuminate with a very wide angle as the same as conventional incandescent light bulbs.

The LED lamp 310 is preferably provided with a conic reflector 63 in a bottom of the under globe segment 20'-2 so that a part of the light L1 from the LEDs 10-2 which advances to the support member 62 reflects laterally at the conic reflector 63*a* to irradiate a part of the under fluorescent protrusions 30-2 of the under globe segment 20'-2*a*, thereby the LED lamp 310 emits the visible light L2 from all surface area of the envelope (10-1 and 10'-2).

Other Embodiment of the Invention: Use of a Both Side Emitting Light Unit

Figure 72:
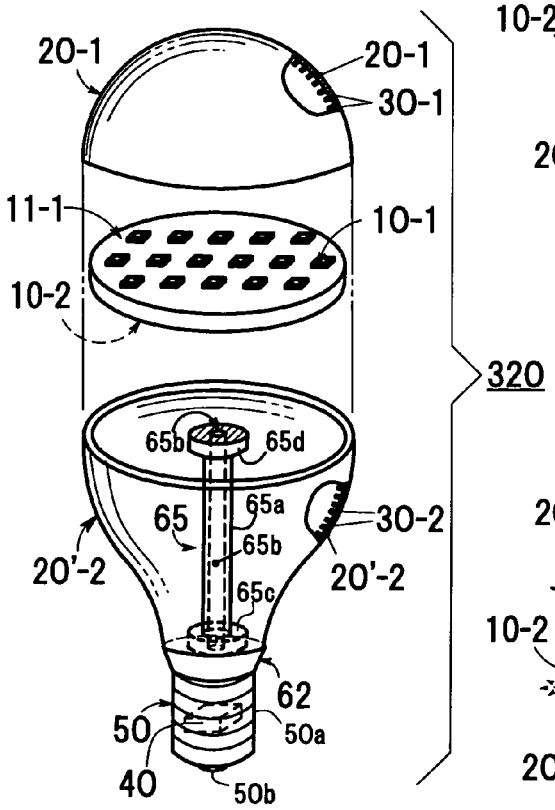
FIG. 72 is a schematic exploded perspective view of an LED lamp 320.
Figure 73:
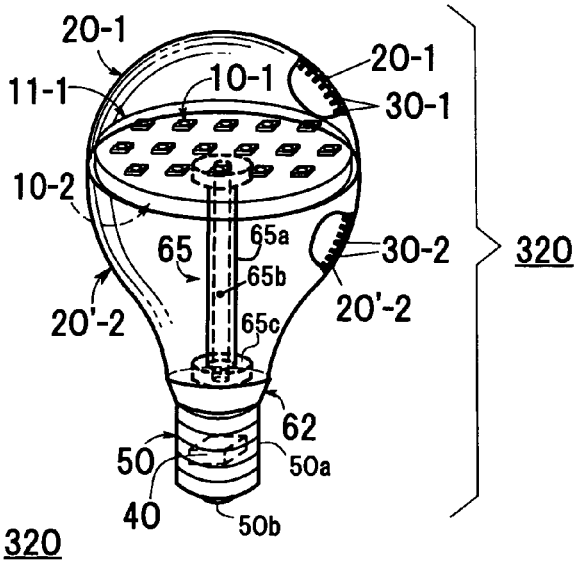
FIG. 73 is a schematic perspective view of the LED lamp 320.
Figure 74:
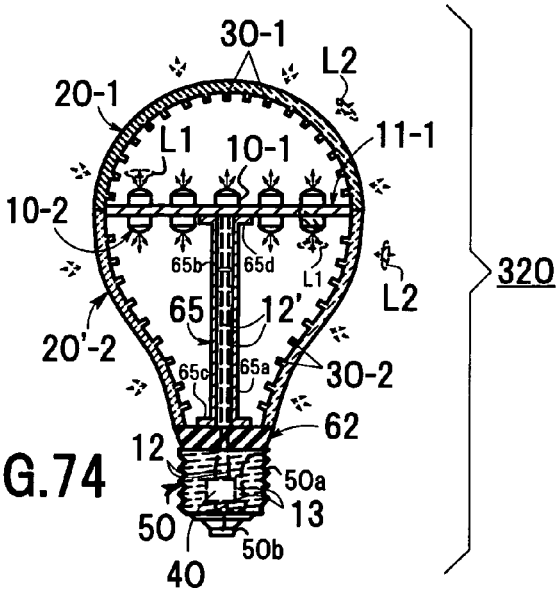
FIG. 74 is a schematic sectional view of the LED lamp 320.

This embodiment is related to an LED lamp 320 described based on FIG. 72 to FIG. 74, which is a modification of the LED lamp 310 described based on FIG. 69 to FIG. 71.

In this embodiment, a description of the same part/portion as described in the various embodiments hereinbefore is omitted as much as possible. (The same reference numeral or mark is given to the same part/portion.)

FIG. 72 is a schematic exploded perspective view of an LED lamp 320. FIG. 73 is a schematic perspective view of the LED lamp 320. FIG. 74 is a schematic sectional view of the LED lamp 320.

As shown in FIG. 72 to FIG. 74, an LED lamp 320 is composed of a light transmitting envelope (20-1 and 20'-2) having an inner cavity and a dual sides emitting light unit (11-1 and 10-1/10-2) accommodated in the inner cavity, which is the same as the LED lamp 310 described hereinbefore.

The envelope (20-1 and 20'-2) is composed of a conventional light bulb shaped globe having a first semi-spherical transparent globe segment 20-1 and a second funnel like transparent globe segment 20'-2 coupled together and first and second fluorescent protrusions (30-1 and 30-2) and fluorescent layers formed on first and second inner surfaces of the globe segments (20-1 and 20'-2), which is the same as the LED lamp 310 described hereinbefore.

The dual sides emitting light unit is composed of a circular dual sides printed circuit board 11-1 and first and second LEDs 10-1 and 10-2 mounted on the upper and under surfaces, which is the same as the LED lamp 310 described hereinbefore.

The LED lamp 320 in the embodiment referring to FIG. 72 to FIG. 74 is provided with a hollow supporting post 65 located along a center axis of the inner cavity of the envelope with the upper and under globe segments (20-1 and 20'-2), which differs from the LED lamp 310 described hereinbefore.

The hollow supporting post 65 is composed of a tubular member 65*a* with a through hole 65*b*, top and bottom disk like plates 65*c* and 65*d*, in which the hollow supporting post 65 supports the both sided printed circuit board 11-1 at the top disk like plate 65*b*, the tubular member 65*a* accommodates into the through hole 65*b* a pair of electric wires 12' to supply a driving electric power to the upper and under LEDs 10-1 and 10-2 mounted on the both surfaces of the circuit board 11-1.

The hollow supporting post 65 extends from the bottom disk like plate 65*c* on the support member 62 to the top disk like plate 65*d* at a center of the under surface of the printed circuit board 11-1, so that the printed circuit board 11-1 is located near a middle position in the inner cavity surrounded the dome like upper globe segment 20-1 and the funnel like under globe segment 20'-2.

The conventional light bulb shaped envelope (20-1 and 20'-2) is fixed on a support member 62 at the bottom the under globe segment 20'-2, a power supply base 50 with a cavity is fixed to the support member 62 and a lighting circuit 40 is housed in an inner cavity of the power supply base 50.

Other Embodiment: Linear LED Lamp

Figure 75:
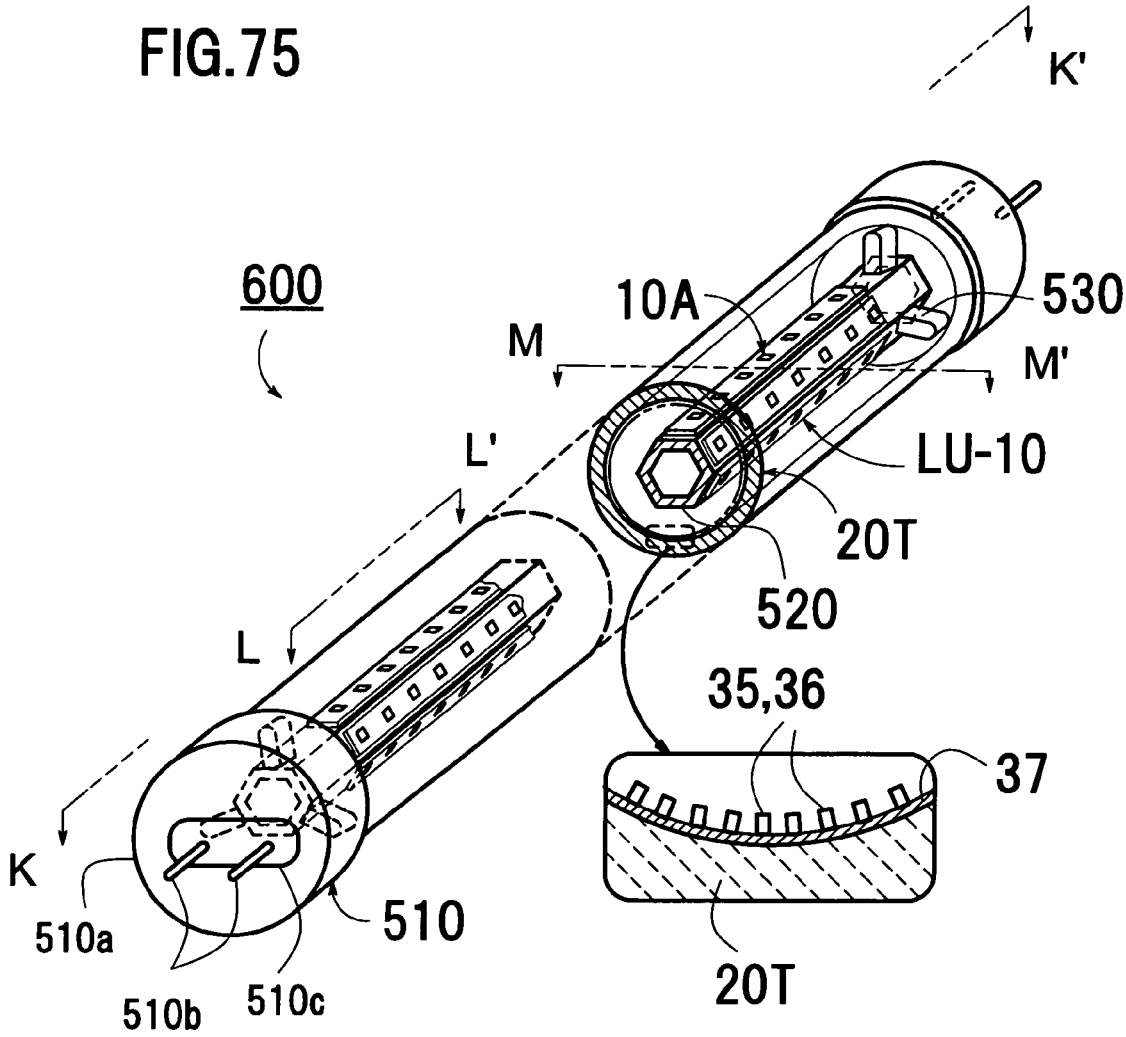
FIG. 75 is a schematic fragmentary perspective view showing a linear LED lamp 600.
Figure 76:
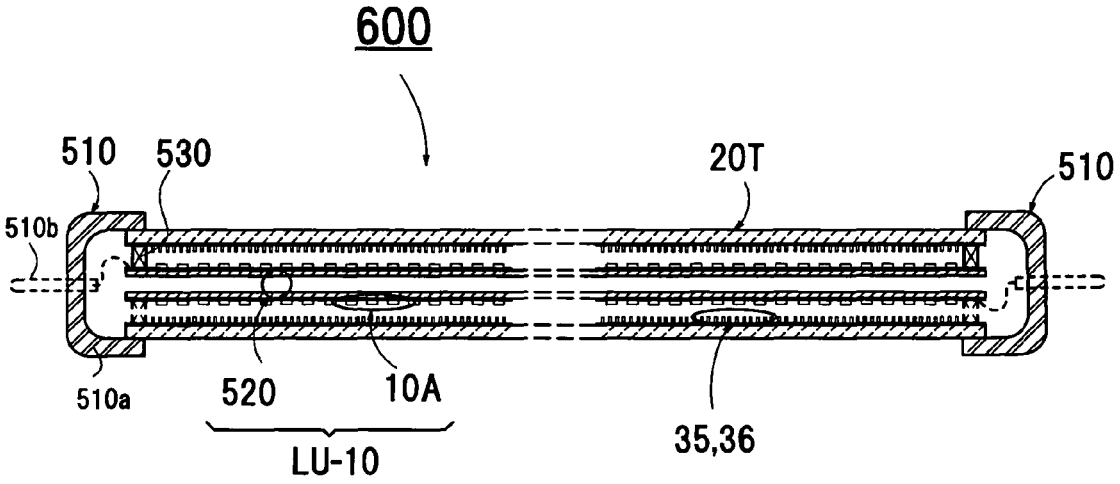
FIG. 76 is a schematic sectional view of the linear LED lamp 600 cut along the line K-K' of FIG. 75.
Figure 77:
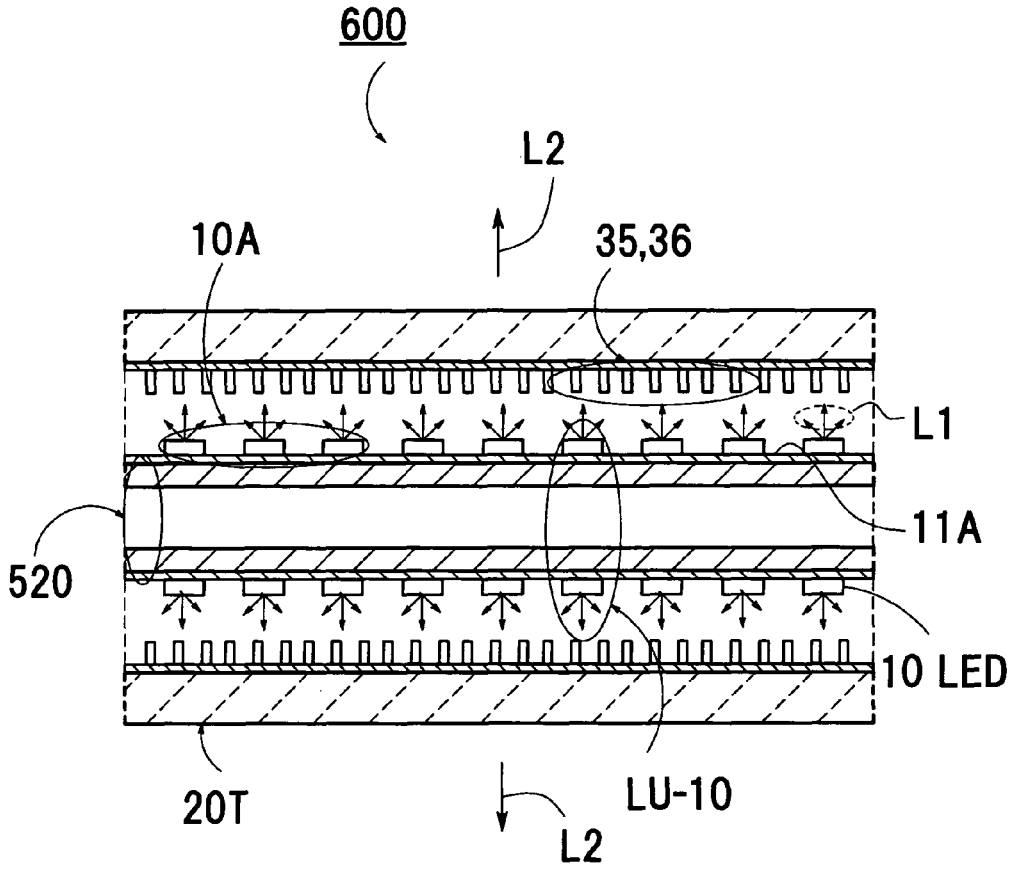
FIG. 77 is a schematic partial enlarged sectional view of the linear LED lamp 600 cut along the line L-L' of FIG. 75.

A linear LED lamp of other embodiment is described based on FIG. 75 to FIG. 77.

Figure 78:
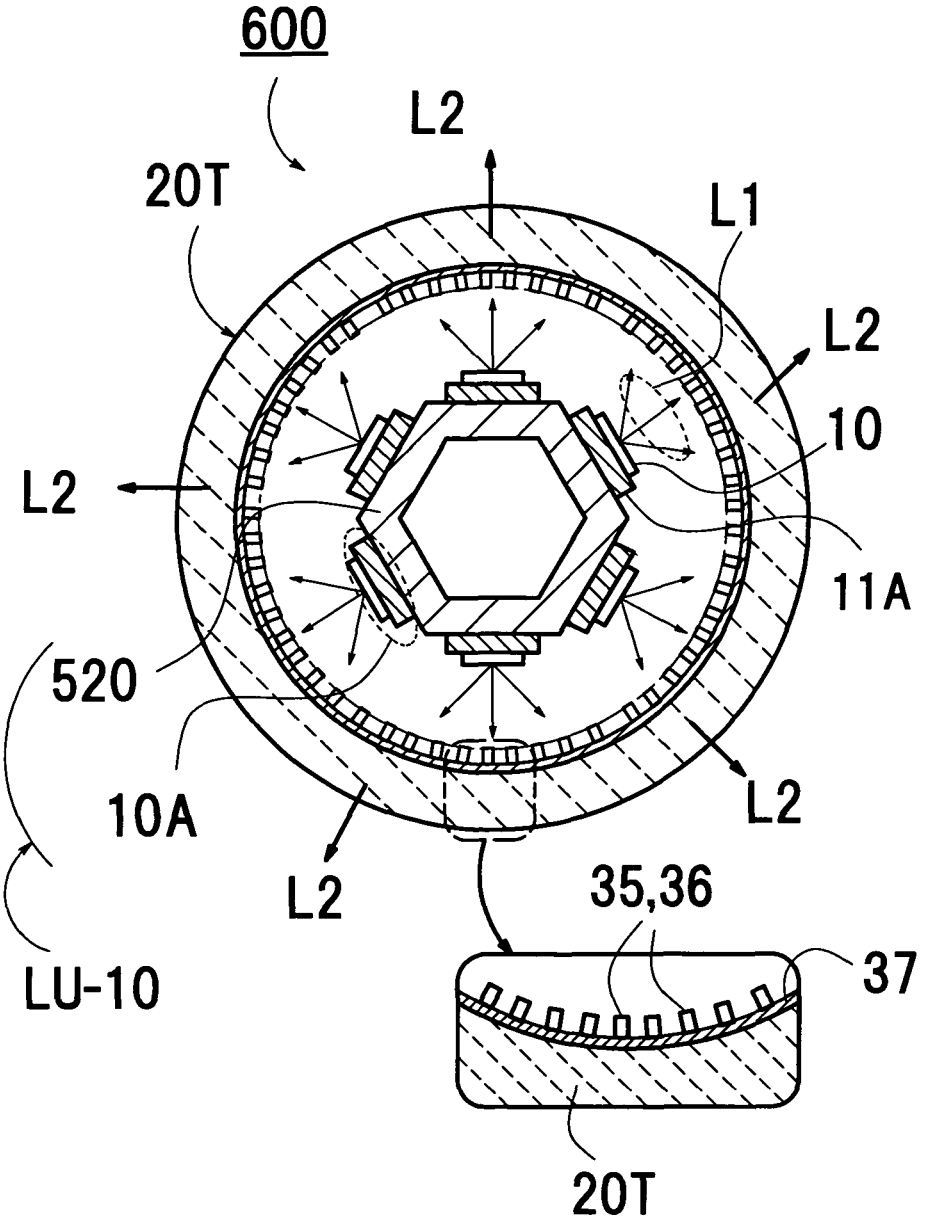
FIG. 78 is a schematic enlarged sectional view of the linear LED lamp 600 cut along the line M-M' of FIG. 75.

FIG. 75 is a schematic fragmentary perspective view showing a linear LED lamp 600. FIG. 76 is a schematic sectional view of the linear LED lamp 600 cut along the line K-K' of FIG. 75. FIG. 77 is a schematic partial enlarged sectional view of the linear LED lamp 600 cut along the line L-L' of FIG. 75. FIG. 78 is a schematic enlarged sectional view of the linear LED lamp 600 cut along the line M-M' of FIG. 75.

In a description of this embodiment, the description of the same or similar portions/parts already made hereinbefore is omitted as much as possible, in which the same reference numerals or marks are given to the same or similar portions/parts.

Referring to FIG. 75 to FIG. 78, a linear LED lamp 600 may be composed of a) a light transmitting hollow tubular globe/envelope 20T (i.e. linear globe/envelope) with e.g. a cylindrical external shape, b) a linear light unit LU-10 composed of a plurality of linear LED arrays 10A fixed on a linear supporting member 520 and c) the linear light unit LU-10 is located along a linear inner cavity of the tubular globe/envelope 20T.

A plurality of fluorescent fibers 35, 36 (fluorescent protrusions) are formed on a fluorescent layer 37 or on an inner surface of the tubular globe/envelope 20T the tubular globe/envelope 20T.

The linear LED array 10A is composed of a plurality of LEDs 10 and an elongated printed circuit board 11A to arrange the LEDs 10 along a length of the circuit board 11A.

For example, the linear supporting member 520 may have a polygonal hollow or solid member having at least three surfaces to fix at least three linear LED arrays 10A such as a hexagonal member (see FIG. 75, FIG. 78), triangular, square or pentagonal members.

The light unit LU-10 may be arranged along a central axis of a cylindrical space (cavity) in the cylindrical tubular member 20T, in which both spacers 530 are located between the light unit LU-10 and the inner surface of the tubular member 20T at both ends of the tubular member 20T to keep a predetermined distance there-between.

Cap members (end caps) 510 are provided at both ends of the tubular member 20T to seal openings of the tubular member 20T, each of the cap members 510 may be composed of a cap 510*a*, an insulated plate 510*c* and a pairs of power supply pin shaped terminals (power receiving pin connectors) 510*a* located in the insulated plate 510*c*.

When the LEDs 10 emits a short wavelength primary light L1 (blue, UV light), the fluorescent fibers 35/36 and the fluorescent layer 37 receive the primary light L1 so that the phosphor contained in the fluorescent fibers 35/36 and the fluorescent layer 37 is excited to irradiate visible secondary light L2 with a wavelength range larger than the primary light L1 and most of visible secondary light L2 (and a part of the primary blue light L1) exit from the light transmitting tubular member 20T to an exterior space as visible illumination light.

This tubular LED lamp 600 may replace a conventional tubular fluorescent lamp.

The components, parts and portions disclosed in the description and drawings of various embodiments disclosed hereinbefore may be optionally combined.

Although various kinds of embodiments of the invention are described above with reference to the accompanying drawings, the invention should not be limited to these embodiments, it is possible to carry out various modifications, design changes, improvement and construction of an equivalent based on the spirit and claims of the invention.

EXPLANATION OF REFERENCE NUMERALS

100,110,120,130,140,150,160,170,180,190,200,210,220,230,240,250,260,270, 280,290,300,310,320, 600: semiconductor lamp, LED lamp;

10,10-1,10-2,10': semiconductor light emitting element, light emitting diode (LED), laser diode (LD);

11,11-1,11*a*: printed circuit board, circuit board, substrate;

14,15: cubic printed circuit board;

20,20-1,20-2; globe, globe segment, envelope;

20T; hollow tubular member tube, tubular globe, tubular envelope;

30*a*: light transmitting protrusion (projection);

30*b*: phosphor film/layer;

30,30-1,30-2: fluorescent protrusion, fluorescent convex;

30': fluorescent groove, fluorescent concave;

31: phosphor film/layer;

35,36: fluorescent fiber;

40: lighting circuit;

50: power supply connector, power supply base, Edison base;

60,60-1,62: housing, support member;

63: reflector;

67: coupling means;

70,72,73: reflector;

71,74,74',76,76',78: light diffusing member, light spreading member;

80,80-1,80-2,80-3: polygonal supporting post (supporting member);

80-4: wing like supporting post (supporting member);

90,92,90A,90B,90C,90D,90E,90F,90G,90H,90J,90K: linear light guide;

93 93A,93B,93C,93D: light spreading ball;

94: curved leaky light guide, U shaped leaky light guide;

L1,L1-1,L1-2: short wavelength light, blue light, ultraviolet (UV) light;

L2,L2-1,L2-2: visible light, yellow light, white light;

LU, LU',LU-1,LU-2,LU-3 LU-4,LU-5,LU-6,LU-10: light unit, light emitting unit.

What is claimed is:

1. A semiconductor lamp comprising:

a light transmitting envelope having a plurality of fluorescent elements containing a phosphor disposed thereon;

at least one semiconductor light emitting element for emitting a short wavelength light for directing to the fluorescent elements; and wherein the fluorescent elements comprise one of protrusions and grooves.

2. The semiconductor lamp according to claim 1, wherein the fluorescent elements are formed on an inner surface of the light transmitting envelope, and wherein the short wavelength light from the semiconductor light emitting element directs to the fluorescent elements to convert the light into visible light.

3. The semiconductor lamp according to claim 1, wherein the phosphor is a yellow phosphor which converts one of blue and purple light of the short wavelength light into yellow color light.

4. The semiconductor lamp according to claim 1, wherein the phosphor is three primary color phosphors which converts one of UV and purple light of the short wavelength light into a white light including three primary colors.

5. The semiconductor lamp according to claim 1, wherein each of the protrusions comprises a fluorescent fiber having one of a core and a core covered by a dad, and wherein one of the core and the clad contains the phosphor.

6. The semiconductor lamp according to claim 1, further comprising a light unit composed of a circuit board for mounting the at least one semiconductor light emitting element being one of light emitting diode/diodes (LED/LEDs) and laser diode/diodes (LD/LDs).

7. The semiconductor lamp according to claim 1, wherein the light transmitting envelope comprises dual segments which are coupled together to construct a single envelope having an inner cavity to accommodate the at least one semiconductor light emitting element.

8. The semiconductor lamp according to claim 1, further comprising:

a light unit having a dual sided circuit board having dual mounting surfaces and the at least one semiconductor light emitting element mounted on each of the dual mounting surfaces, and wherein the light unit is accommodated in a substantially middle position of an inner cavity of the envelope for irradiating all inner surface of the envelope.

9. The semiconductor lamp according to claim 8, further comprising a conic reflector positioned to face one surface of the dual sided circuit board.

10. The semiconductor lamp according to claim 1, further comprising:

a light unit composed of a circuit board and the at least one semiconductor light emitting element mounted thereon, and wherein the light unit is supported by the envelope.

11. The semiconductor lamp according to claim 1, further comprising:

a light unit composed of a circuit board and the at least one semiconductor light emitting element mounted thereon, and wherein the light unit is supported by a supporting member extending from a bottom of the envelope.

12. The semiconductor lamp according to claim 1, further comprises one of fluorescent film and layer containing the phosphor formed on an inner surface of the envelope.

13. The semiconductor lamp according to claim 1, further comprises at least one leaky light guide member with one of linear and curved shape, having a proximate end to receive the short wavelength light and a side leaky surface to leak the short wavelength light.

14. The semiconductor lamp according to claim 1, further comprises a linear light guide member and one of light direction changing means and light spreading member, wherein the linear light guide member is composed of a proximate end, a side surface and a distal end, and wherein the one of light direction changing means and light spreading member is located on the distal end.

15. The semiconductor lamp according to claim 1, wherein one of reflector and mirror and the at least one semiconductor light emitting element are accommodated in an inner cavity within the light transmitting envelope, and wherein the one of reflector and mirror is located at a middle position of the inner cavity and the semiconductor light emitting element is located at one end of the inner cavity.

16. The semiconductor lamp according to claim 1, further comprises one of polygonal and wing like supporting members having plural surfaces, and wherein a plurality of circuit boards to mount the at least one semiconductor light emitting element are fixed on the surfaces.

17. An LED lamp comprising:

a light transmitting envelope having a plurality of fluorescent elements containing a phosphor;

a light unit having a circuit board and at least one light emitting diode (LED/LEDs) mounted on the circuit board for emitting a short wavelength light for directing to the fluorescent elements to convert the short wavelength light into visible light;

wherein the fluorescent elements comprise one of protrusions and grooves; and wherein the light unit is accommodated in an inner cavity of the light transmitting envelope.

18. The LED lamp according to claim 17, wherein the LED lamp is a linear LED lamp comprising:

the light transmitting envelope having a light transmitting tubular member, the light unit having a linear supporting member and at least one linear LED array fixed on the linear supporting member; and wherein the light unit is arranged along the inner cavity of the tubular member.

19. A light bulb type LED lamp comprising:

a light transmitting globe having a plurality of the fluorescent elements containing a phosphor;

a light unit having a circuit board and at least one light emitting diode (LED/LEDs) mounted on the circuit board for emitting a short wavelength light for directing to the fluorescent elements to convert the short wavelength light into visible light, wherein the fluorescent elements comprise one of protrusions and grooves;

a lighting circuit to drive the LED/LEDs; and a light bulb type power supply connector;

thereby the LED lamp can replace an incandescent light bulb.

20. The light bulb type LED lamp according to claim 19, wherein each of the protrusions comprises a fluorescent fiber having one of a core and a core covered by a dad, and wherein the one of the core and the clad contains the phosphor.

* * * * *